US011911670B2

(12) United States Patent
Serrano et al.

(10) Patent No.: US 11,911,670 B2
(45) Date of Patent: Feb. 27, 2024

(54) COMPACT PUTTER HEAD

(71) Applicant: KARSTEN MANUFACTURING CORPORATION, Phoenix, AZ (US)

(72) Inventors: Anthony D. Serrano, Phoenix, AZ (US); Tony P. Finau, Lehi, UT (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/315,842

(22) Filed: May 11, 2023

(65) Prior Publication Data

US 2023/0364479 A1 Nov. 16, 2023

Related U.S. Application Data

(60) Provisional application No. 63/406,657, filed on Sep. 14, 2022, provisional application No. 63/366,131, filed on Jun. 9, 2022, provisional application No. 63/364,709, filed on May 13, 2022.

(51) Int. Cl.
*A63B 53/04* (2015.01)

(52) U.S. Cl.
CPC ..... *A63B 53/0487* (2013.01); *A63B 53/0408* (2020.08); *A63B 2053/0491* (2013.01)

(58) Field of Classification Search
CPC ..... A63B 53/0487; A63B 53/048; A63B 2053/0491
USPC ..... 473/324–350, 287–292, 313–314, 473/305–315; D21/736–746
See application file for complete search history.

(56) References Cited

U.S. PATENT DOCUMENTS

| | | | | |
|---|---|---|---|---|
| 1,589,926 A | | 6/1926 | Beamer | |
| 3,043,596 A | * | 7/1962 | Ehmke | A63B 69/3685 473/240 |
| 3,430,963 A | | 3/1969 | Wozniak | |
| 3,819,180 A | * | 6/1974 | Murphy | A63B 53/0487 473/330 |

(Continued)

FOREIGN PATENT DOCUMENTS

| | | |
|---|---|---|
| DE | 202012007179 | 9/2012 |
| DE | 202011106754 | 1/2013 |

(Continued)

OTHER PUBLICATIONS

Hello World: Final Project "Tiny Putter," (Dec. 11, 2014) https://tinygolf.wordpress.com/2014/12/11/final-project-tiny-putter/.

(Continued)

*Primary Examiner* — Sebastiano Passaniti

(57) ABSTRACT

A compact putter-type club head comprising a compact body profile and a small strike surface area is described herein. The compact putter head achieves distinct alignment and delivery advantages under a variety of putting conditions and is uniquely suited to produce accurate putting from the rough or fringe. The small body dimensions, including the strike face, force the player to focus on making a center strike, while also providing minimal resistance when travelling through tall grass. Certain features and characteristics of the compact putter head are specifically tailored to produce one of these benefits, while certain other features or characteristics provide benefits across multiple areas.

18 Claims, 34 Drawing Sheets

(56) References Cited

U.S. PATENT DOCUMENTS

| | | | | |
|---|---|---|---|---|
| 3,989,256 | A * | 11/1976 | Cicero | A63B 53/0487 473/340 |
| 4,314,701 | A | 2/1982 | Swanson | |
| 4,324,404 | A | 4/1982 | Dian | |
| 4,390,184 | A * | 6/1983 | Rudell | A63B 60/02 473/253 |
| D360,671 | S * | 7/1995 | Landreth | D21/746 |
| D375,131 | S | 10/1996 | Williams | |
| 5,599,241 | A | 2/1997 | Pritchett | |
| 5,700,207 | A * | 12/1997 | Guthrie | A63B 53/0487 D21/736 |
| 5,928,088 | A | 7/1999 | Matthews | |
| 5,993,330 | A | 11/1999 | Akerstrom | |
| 6,244,974 | B1 * | 6/2001 | Hanberry, Jr. | A63B 53/007 473/340 |
| 6,428,424 | B2 | 8/2002 | Franco | |
| 6,776,727 | B1 | 8/2004 | Engdahl | |
| 6,951,517 | B2 * | 10/2005 | Lindsay | A63B 53/0487 473/340 |
| 7,270,609 | B2 | 9/2007 | Yamaguchi | |
| 7,390,267 | B2 * | 6/2008 | Grace | A63B 53/0487 473/340 |
| 7,462,111 | B2 | 12/2008 | Little | |
| 7,922,597 | B2 | 4/2011 | Feret | |
| 8,105,176 | B2 * | 1/2012 | Upenieks | A63B 53/0487 473/340 |
| 8,382,605 | B2 | 2/2013 | Treadwell | |
| D719,225 | S | 12/2014 | Pfaff | |
| 8,956,245 | B2 * | 2/2015 | Brandt | A63B 53/04 473/340 |
| 9,050,510 | B2 | 6/2015 | Ines | |
| 9,782,645 | B2 * | 10/2017 | Dolezel | A63B 53/0487 |
| 10,279,228 | B2 * | 5/2019 | Smith | A63B 53/14 |
| 10,300,348 | B2 | 5/2019 | Morris | |
| 11,058,933 | B2 | 7/2021 | Varshney | |
| 2002/0151374 | A1 * | 10/2002 | Imamura | A63B 53/0487 473/236 |
| 2005/0026715 | A1 | 2/2005 | Sloboda | |
| 2005/0107186 | A1 * | 5/2005 | Snowdon | A63B 53/02 473/340 |
| 2006/0040762 | A1 | 2/2006 | Chupka | |
| 2006/0100030 | A1 * | 5/2006 | Hasegawa | A63B 60/02 473/340 |
| 2007/0093314 | A1 | 4/2007 | Johnson | |
| 2007/0191137 | A1 * | 8/2007 | Nishino | A63B 53/04 473/340 |
| 2007/0243951 | A1 * | 10/2007 | Nishino | A63B 53/0487 473/340 |
| 2008/0045354 | A1 * | 2/2008 | Drew | A63B 53/0487 473/340 |
| 2009/0176593 | A1 | 7/2009 | Raley | |
| 2011/0111884 | A1 * | 5/2011 | Franklin | A63B 60/02 473/340 |
| 2011/0244980 | A1 | 10/2011 | Belcher | |
| 2012/0034990 | A1 * | 2/2012 | Cohen | A63B 53/0487 473/250 |
| 2017/0216689 | A1 * | 8/2017 | Bamber | A63B 53/007 |
| 2020/0001150 | A1 | 1/2020 | Matthesen | |

FOREIGN PATENT DOCUMENTS

| | | |
|---|---|---|
| KR | 0129235 | 10/1999 |
| KR | 20040050254 | 6/2004 |
| KR | 200413329 | 4/2006 |
| KR | 20080002655 | 7/2008 |
| KR | 20090026006 | 3/2009 |
| KR | 20100090332 | 8/2010 |
| KR | 101224399 | 1/2013 |
| KR | 101452459 | 10/2014 |

OTHER PUBLICATIONS

Rare Fussell Prototype Milled Stubby Putter Practice Putter Choose Your Length, ebay (last visited Feb. 1, 2023).

Takumi Japan Golf OH-2 Training Putter 22inch Grip Blue, ebay (Feb. 1, 2023) https://www.ebay.com/tm/175403949143.

Cleveland Golf Smart Square Stubby Putter, golfballs.com (last visited Apr. 20, 2023) https://www.golfballs.com/Golf-Clubs/Putters/Cleveland-Golf-Smart-Square-Stubby-Putter.htm.

International Search Report/Written Opinion, PCT Application No. PCT/US2023/021860, dated Jul. 24, 2023.

* cited by examiner

COMPACT PUTTER HEAD

CROSS REFERENCE PRIORITIES

This claims priority to U.S. Provisional Application No. 63/406,657 filed Sep. 14, 2022, U.S. Provisional Application No. 63/366,131 filed Jun. 9, 2022, and U.S. Provisional Application No. 63/364,709 filed May 13, 2022, all of which are incorporated in their entirety.

TECHNICAL FIELD

This disclosure relates generally to golf club heads and, more particularly, relates to putter-type golf club heads with compact profiles.

BACKGROUND

When putting a golf ball, the ability to roll the ball smoothly along an intended target line with proper speed leads to more accurate putting, and therefore, more putts holed. Several factors influence the accuracy of a putt. These factors include the ability to strike the golf ball at or near the center of a club head strike face and the ability to cause the ball to roll smoothly after impact rather than the ball skipping or bouncing. The accuracy of a putt is influenced by a combination of the putter-type club head design and how the golfer delivers the club head to the ball at impact.

Many golfers have difficulty consistently striking the ball on the center of the strike face. Further, many prior art putter heads are not optimized to roll the ball smoothly. Both of these issues lead to putts that travel offline relative to the target or do not carry the proper speed. There is a need in the art for a putter-type golf club head that produces smooth rolling putts and forces the player to manually align the club head and strike the ball on the center of the strike face.

BRIEF DESCRIPTION OF THE DRAWINGS

To facilitate further description of the embodiments, the following drawings are provided in which.

Figure 1:
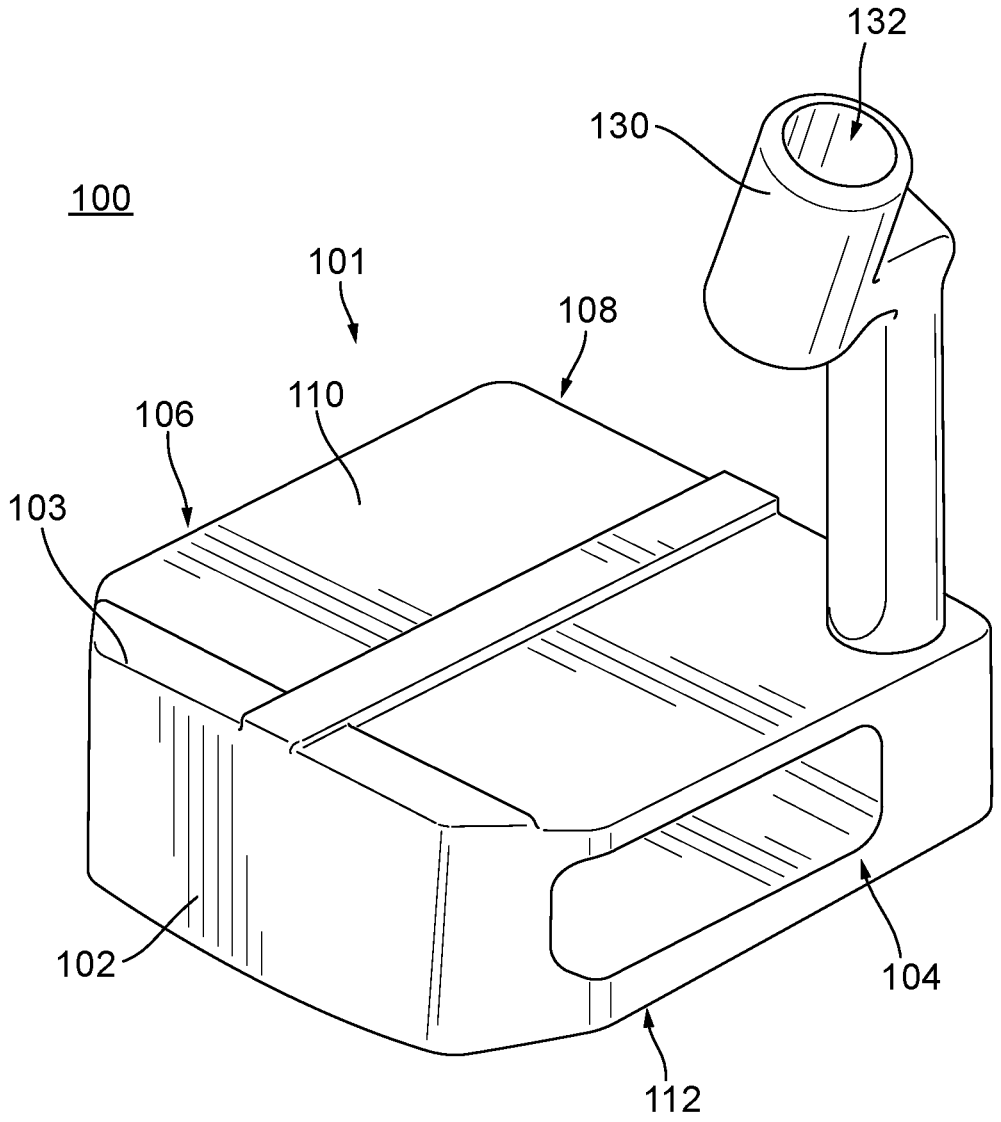
FIG. 1 illustrates a front-perspective view of a compact putter-type golf club head comprising a rearward hosel, according to a first embodiment.

Described herein is a putter-type golf club head with improved performance having a small face and body. The club head comprises a compact design that forces the player to manually align the putter head and focuses the player to strike the golf ball on the center of the face. The club head further comprises a desirable CG position and shaft axis orientation that forces the player to execute proper delivery characteristics that produce a smooth roll at impact.

The compact design of the club head focuses the player and increases the ability of the player to strike the golf ball accurately and consistently on the center of the strike face (hereafter referred to as a "center strike"). Facets of the compact club head design include a compact overall body profile and a strike face with a small surface area. The compact club head provides a more precise target for the golfer to focus on when aligning the club head and during the putting stroke. The precise target provided by the compact club head encourages the player to strike the ball more consistently on the center of the strike face, in comparison to a putter head with a larger profile and/or larger strike face. For example, with a typical putter head having a wider face and a larger overall profile, the player must attempt to focus on striking the ball near the center of a strike face by relying on various alignment aids, due to the fact that the overall putter body and face are much larger than the golf ball. The compact nature of the present club head itself provides alignment benefits and encourages the player to produce centered putts. Although certain embodiments may include additional alignment features, such alignment features are provided to supplement the alignment benefits of the compact club head design.

As discussed above, the compact club head comprises a small strike face, which is not much wider than the golf ball. The compact strike face forces the player to properly align the club head and execute an accurate stroke. In many embodiments, the strike face is 50% wider than the diameter of a golf ball or less. With the smaller strike face of the compact club head, the player simply needs to focus on making contact between the ball and the compact strike face in order to produce a center strike. The smaller area available to contact the golf ball forces the player to strike the golf ball near the center of the strike face. The compact club head further comprises a body that is wider than the strike face, providing a higher MOI in comparison to a club head with a similar, small strike face size that lacks a wider body. Combining a small strike face and a small body, yet providing the body wider than said small strike face creates a club head that balances forgiveness with a focusing effect.

The compact design further forces the player to manually align the club head. To "manually align" the club head requires the player to actively hold the club head in place at address, whether the club head is resting on the ground or suspended in air. Manual alignment of the club head forces the player to focus more closely on whether or not the club head is properly aligned. Certain features of the club head, including the keel point location and the hosel location, can force the player to manually align the club head. The club head is designed to provide feedback to the hands of the player at address, helping the player determine whether the club head is properly aligned.

The club head further comprises various features that aid the player in accurate alignment. The club head can be shaped with various wall geometries, that provide reference to the orientation of the club head, such as walls that converge at the center of the golf ball at address or sidewalls that run perpendicular to the strike face. In addition to the body of the club head itself being an alignment feature, the club head can comprise various superficial alignment features, such as an alignment aid on the surface of the crown. These features supplement the alignment benefits of the compact club head design by providing reference to the strike face center location and the alignment of the club head.

As discussed above, the club head can comprise CG and hosel locations that produce a "smooth roll." A smooth roll is produced once the ball is rolling smoothly along the ground, instead of skipping, jumping, sliding, or bouncing along the ground. The sooner after impact a putt is rolling smoothly, the more likely the putt is to travel along the intended target line and carry the intended speed. Smooth rolling putts are typically more accurate The degree to which a golf ball rolls smoothly is influenced by the angle of attack of the club head at impact and the location of the club head CG. In general, a greater angle of attack and a lower CG influences topspin on the ball, which contributes to a smooth roll. In many embodiments, the club head of the present invention comprises a hosel location that promotes an increased angle of attack. The club head can further comprise a desirable CG location that produces a smooth roll. The hosel and CG locations provide a club head that produces smooth rolling putts. Other designs and embodiments are envisioned for the compact club head.

The compact putter head can be advantageous for players desiring to putt from off the green. In many cases, when faced with shots from the fringe of the green or in the rough, a player may elect to putt the ball rather than chip or pitch. The compact design of the present club head reduces the resistance acting on the club head by the taller grass found on the fringe or in the rough. The club head comprises a compact profile and a relatively high MOI, each of which reduces the tendency of the club head to twist or catch in the grass, leading to more predictable putting strokes from off the green. Further, the club head can comprise one or more features or geometries designed to aid the club head in gliding through tall grass, such as a narrow sole, sloped surfaces, and/or sidewalls that push the grass away from the body and guide the club head through the tall grass.

The compact putter head provides versatile benefits. The compact putter head achieves distinct alignment and delivery advantages under a variety of putting conditions and is uniquely suited to produce accurate putting from the rough or fringe. Certain features and characteristics of the compact putter head are specifically tailored to produce one of these benefits, while certain other features or characteristics provide benefits across multiple areas. For example, a rearward hosel location can influence the player to deliver the club head at an increased angle of attack, promoting a smoother roll. The same rearward hosel location can also create an imbalance in the club head at address that encourages the player to manually align the club head. Similarly, sidewalls that extend perpendicular to the strike face (discussed in further detail below) can provide alignment benefits while also providing the additional benefit of helping guide the club head through tall grass on putts from the rough. In general, the compact nature of the putter head produces significant focusing benefits and advantages on putts executed from the rough or fringe. The small body dimensions, including but not necessarily limited to the reduced size of the strike face, force the player to focus on making a center strike, while also providing minimal resistance when travelling through tall grass.

It should be noted that putter performance is, in many cases, player specific. Certain players will excel with different types and shapes of putter heads. The compact putter head described herein provides advantages related to focusing on alignment of the putter stroke, as well as delivery characteristic advantages and CG locations that will benefit certain subgroups of players more than others. The compact putter head provides a viable option for a significant subgroup of golfers.

Definitions

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting, either directly or indirectly, two or more elements or signals, electrically, mechanically and/or otherwise.

Figure 8:
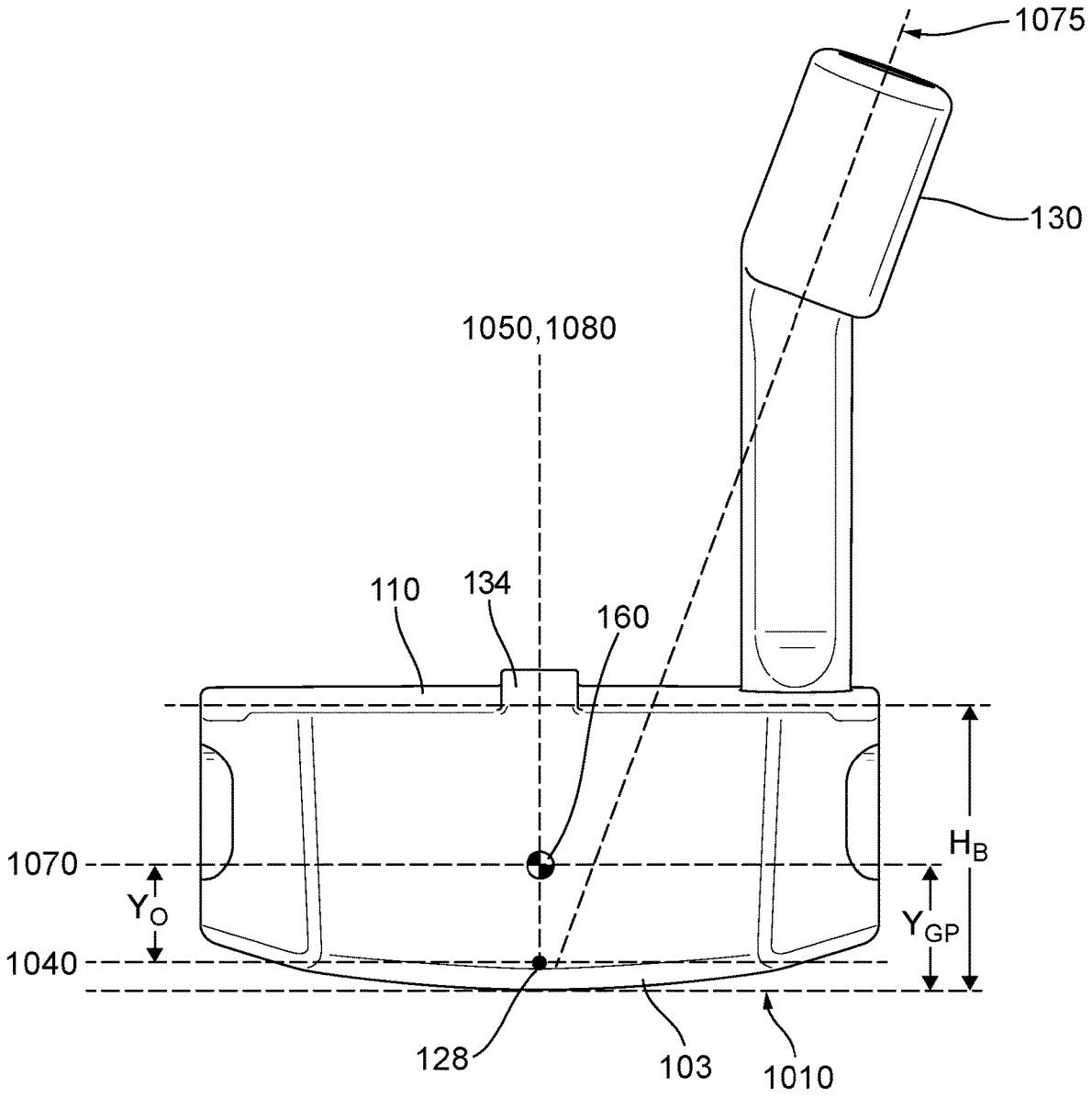
FIG. 8 illustrates a front view of the compact putter-type golf club head of FIG. 1.
Figure 9:
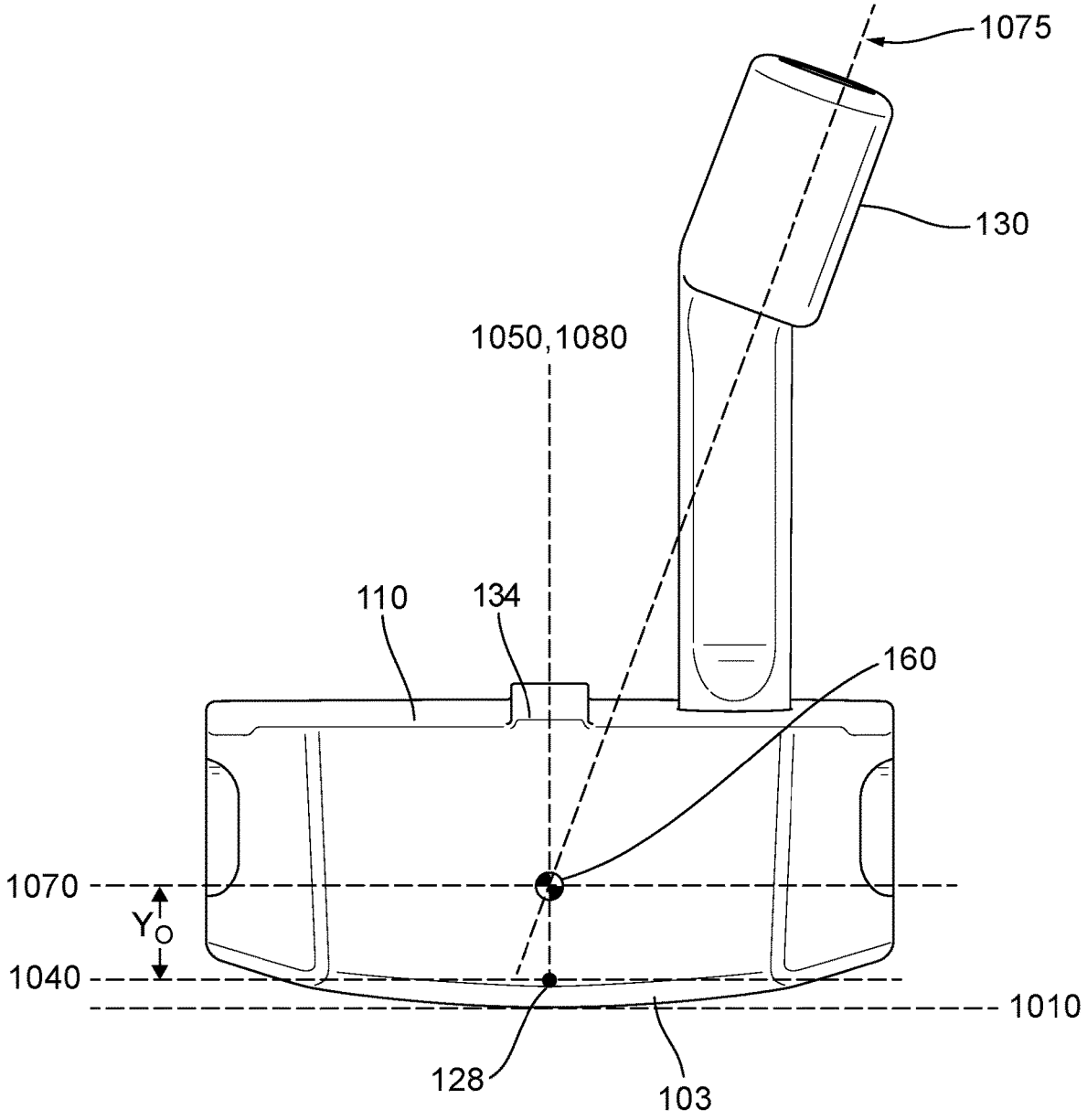
FIG. 9 illustrates a front view of a compact putter-type golf club head comprising a rearward hosel, according to a second embodiment.
Figure 11:
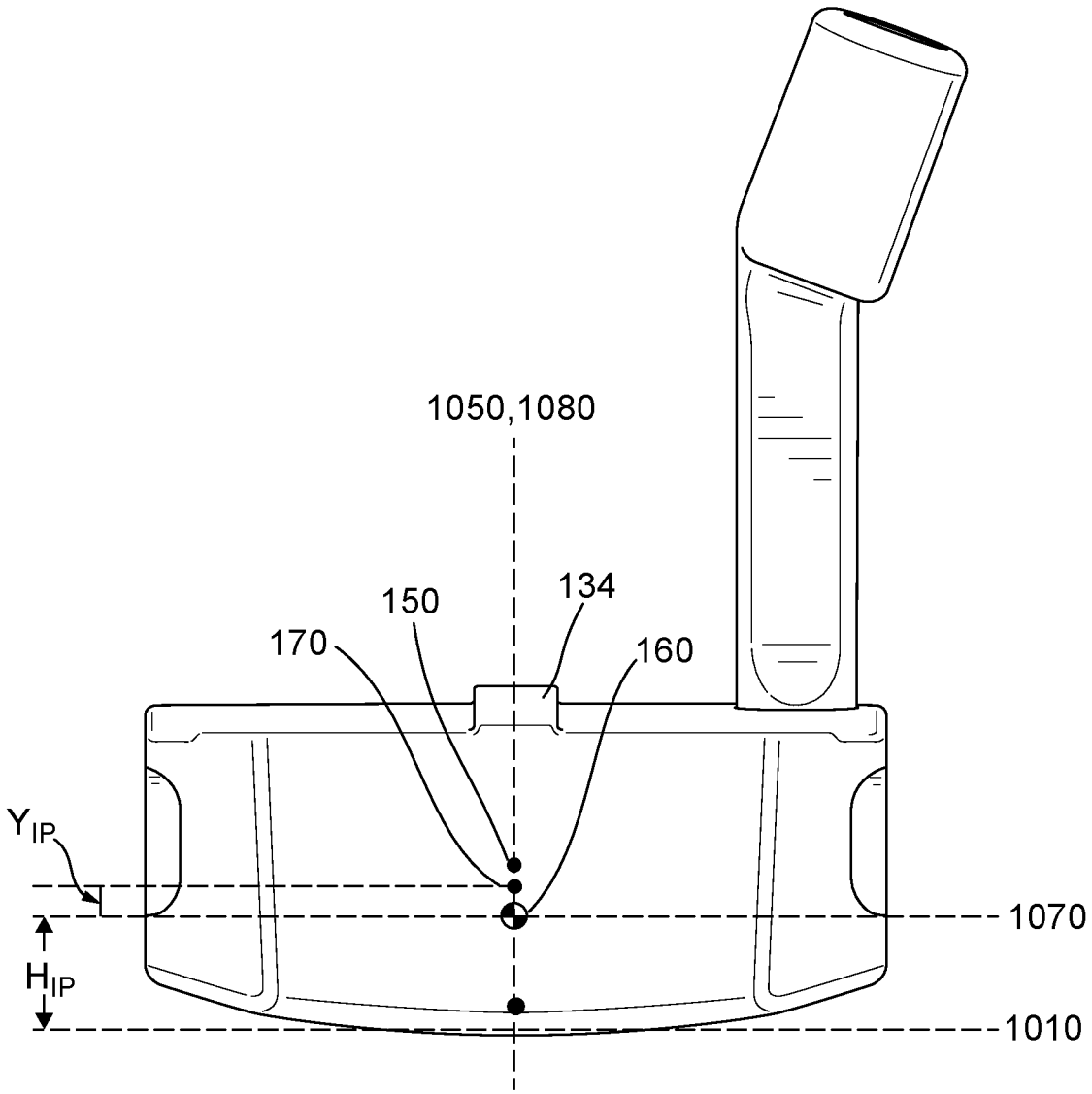
FIG. 11 illustrates a front view of the compact putter-type golf club head of FIG. 1.

The term "ground plane," as used herein, can refer to a reference plane associated with the surface on which a golf ball is placed. Referring to FIGS. 8, 9, and 11, the ground plane 1010 can be a horizontal plane tangent to the sole at an address position.

The term "strike face" of the club head, as used herein, can refer to a front surface of the club head that is configured to strike a golf ball. The term "strike face" can be used interchangeably with "face."

The term "strike face perimeter" of the club head, as used herein, can refer to an edge of the strike face. The strike face perimeter can be located along an outer edge of the strike face where the curvature deviates from a bulge and/or roll of the strike face.

The term "loft plane" of the club head, as used herein, can refer to a reference plane that is tangent to the geometric centerpoint of the strike face.

The term "loft angle," as used herein, can refer to an angle measured between the loft plane and a vertical plane.

The term "lie angle" of the club head, as used herein, can refer to an angle measured between a shaft axis, extending through the hosel, and the ground plane. The lie angle can be measured from a front view.

The "leading edge" of the club head, as described herein, can refer to the most sole-ward portion of the strike face perimeter. For example, a club head leading edge is the transition from the strike face to the sole of the club head.

The "origin" or "origin point" of the club head, as described herein, can refer to a point located at the center (in a heel-to-toe direction) of the leading edge.

Figure 5:
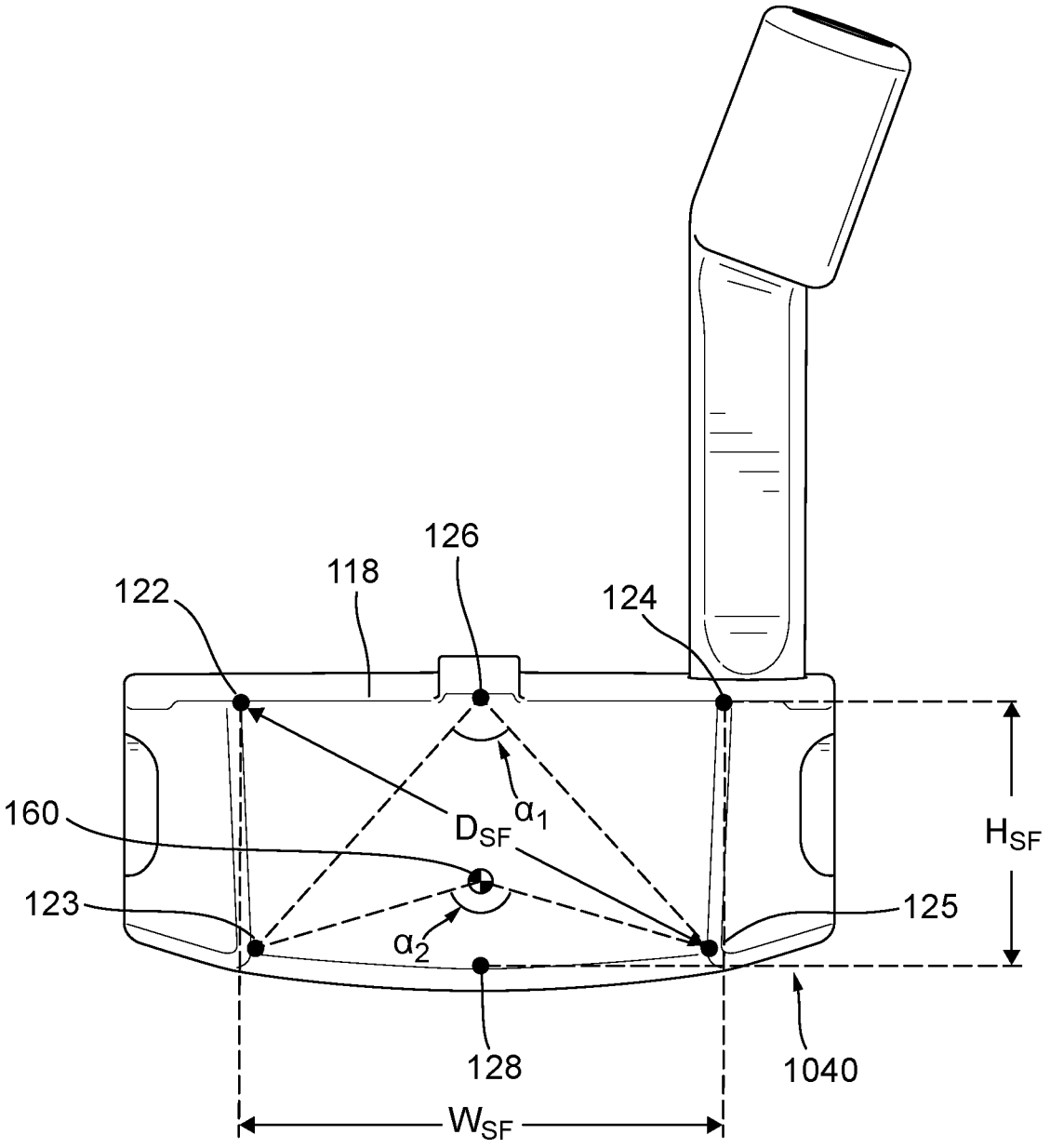
FIG. 5 illustrates a front view of the compact putter-type golf club head of FIG. 1.
Figure 10:
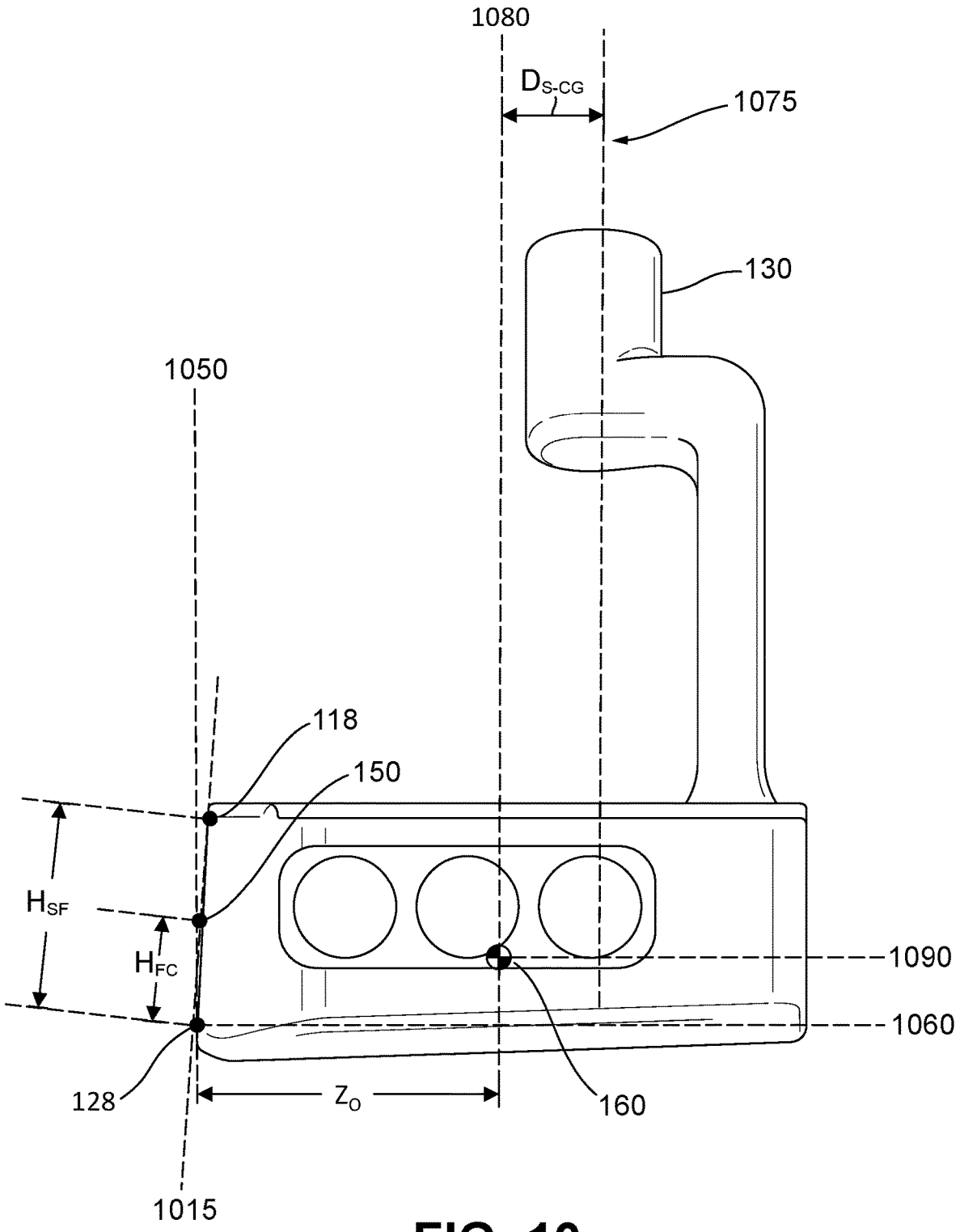
FIG. 10 illustrates a heel side view of the compact putter-type golf club head of FIG. 1.

The "strike face height" $H_{SF}$ of the club head, as described herein, can refer to a distance measured from the lowest to the highest point on the strike face. Referring to FIGS. 5 and 10, the height $H_{SF}$ can be measured parallel to the loft plane 1015, from the origin point 128 to a top edge 118 of the strike face 102, wherein the top edge 118 represents the most crown-ward portion of the strike face 102 perimeter.

The "strike face width" $W_{SF}$ of the club head, as described herein, can refer to a horizontal distance measured across the strike face in a heel-to-toe direction. Referring to FIGS. 5 and 8, the strike face width $W_{SF}$ can be measured parallel to the ground plane 1010, from a heel-most extent of the strike face perimeter to a toe-most extent of the strike face perimeter.

The "face center" of the club head, as described herein, can refer to the geometric center point of the strike face perimeter. In the same or other examples, the face center also can be centered with respect to an engineered impact zone, which can be defined by a region of grooves on the strike face. As another approach, the face center can be located in accordance with the definition of a golf governing body such as the United States Golf Association (USGA). The term "face center" can be used interchangeably with the term "geometric center."

The "face center height" $H_{FC}$ of the club head, as described herein, can refer to a distance measured from the lowest point on the strike face to the face center. Referring to FIG. 10, the height $H_{FC}$ can be measured parallel to the loft plane 1015 from the origin point 128 to the face center 150. The height $H_{FC}$ can be approximately half the strike face height $H_{SF}$. The height $H_{FC}$ can be between 0.25 inch and 0.50 inch. In some embodiments, the height $H_{FC}$ can be between 0.25 inch and 0.40 inch, 0.30 inch and 0.50 inch, or 0.45 inch and 0.50 inch.

As illustrated in FIGS. 8-10, the club head can define a primary coordinate system centered about the origin point 128. The primary coordinate system can comprise an X-axis 1040, a Y-axis 1050, and a Z-axis 1060. The X-axis 1040 can extend in a heel-to-toe direction. The X-axis 1040 can be positive towards the heel end 104 and negative towards the toe end 106. The Y-axis 1050 can extend in a crown-to-sole direction and can be orthogonal to both the Z-axis 1060 and the X-axis 1040. The Y-axis 1050 can be positive towards the crown 110 and negative towards the sole 112. The Z-axis 1060 can extend in front-to-rear direction, parallel to the ground plane 1010 and can be orthogonal to both the X-axis 1040 and the Y-axis 1050. The Z-axis 1060 can be positive towards the strike face 102 and negative towards the rear end 108.

Figure 6:
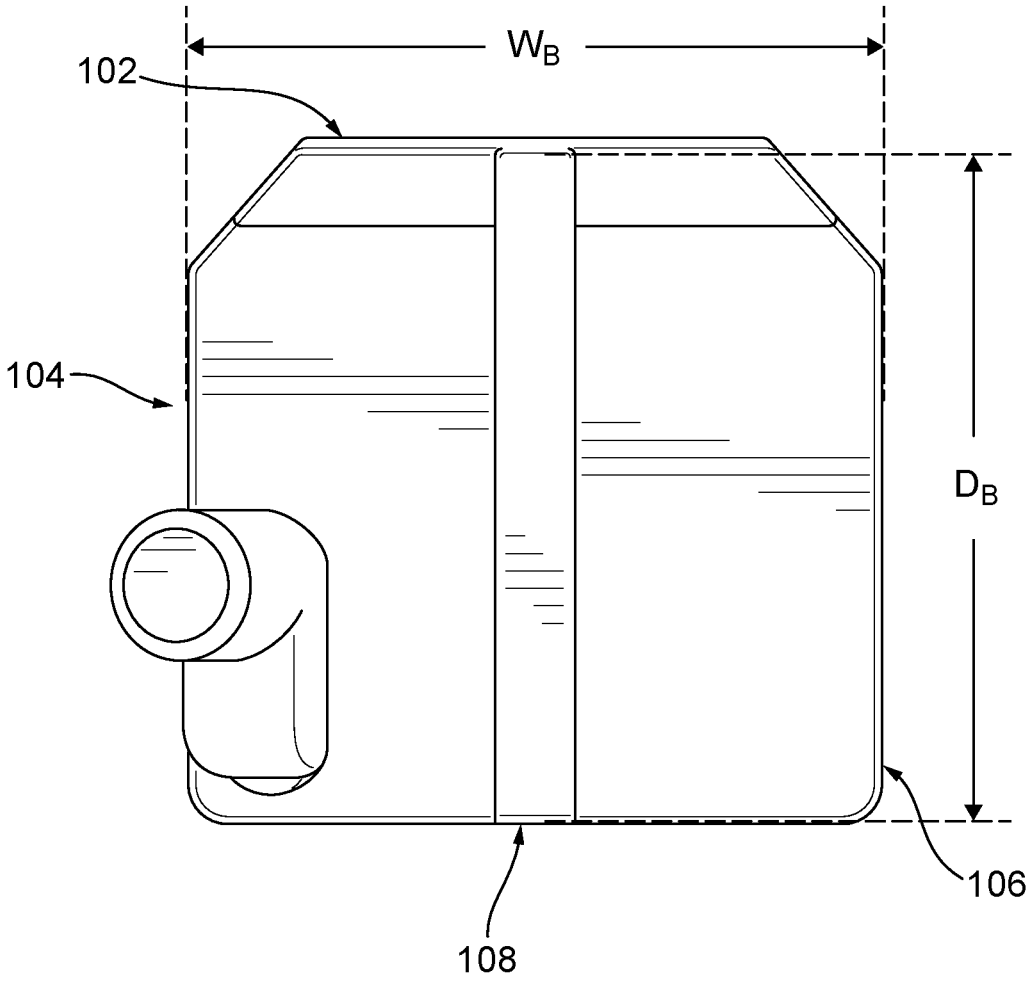
FIG. 6 illustrates a top view of the compact putter-type golf club head of FIG. 1.

The "body depth" $D_B$ of the club head, as described herein, can refer to a front-to-rear dimension measured across the body. Referring to FIG. 6, the body depth $D_B$ can be measured parallel to the Z-axis 1060 from the strike face 102 to the rearward most point of the body 101.

The "body height" $H_B$ of the club head, as described herein, can refer to a crown-to-sole dimension measured across the body. Referring to FIG. 8, the body height $H_B$ can be measured as a vertical distance (parallel to the Y-axis 1050) between the ground plane 1010 and the highest point of the crown 110. In many embodiments, the height $H_B$ can be measured according to a golf governing body such as the United States Golf Association (USGA).

The "body width" $W_B$ of the club head, as described herein, can refer to a heel-to-toe dimension measured across the body. Referring to FIG. 6, the body width $W_B$ can be measured parallel to the X-axis 1040 from the heel end 104 to the toe end 106. In many embodiments, the body width $W_B$ can be measured according to a golf governing body such as the United States Golf Association (USGA). The ranges specified for the body depth, body height, and body width can be designed in accordance with the USGA regulations.

The "center of gravity" or "CG" of the club head, as described herein, can refer to the point at which the mass is centered within the club head.

Figure 12:
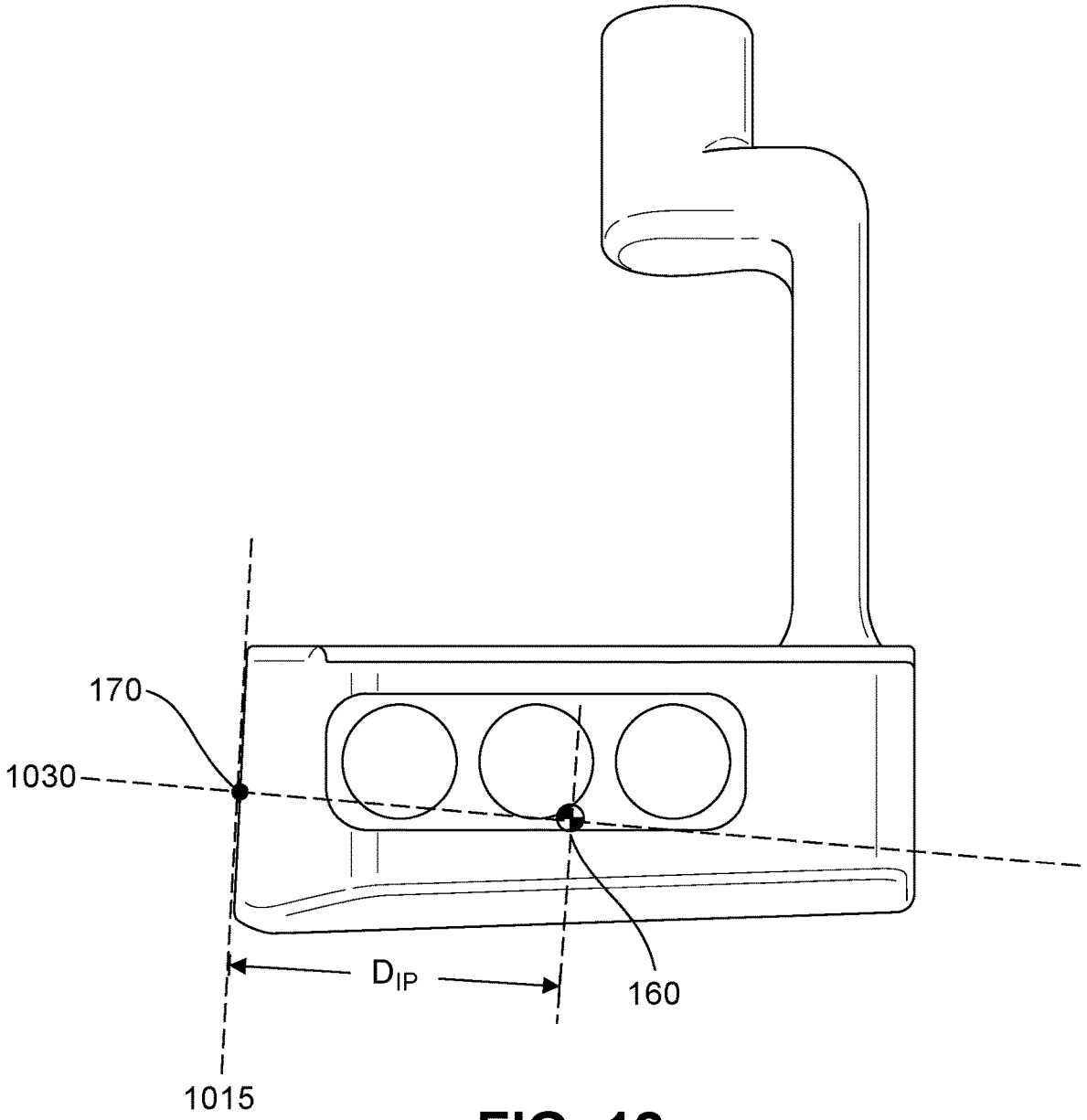
FIG. 12 illustrates a heel side view of the compact putter-type golf club head of FIG. 1.

The "CG position" or "CG location" of the club head, as described herein, can refer to the location of the center of gravity (CG). With respect to the primary coordinate system, the CG position can be characterized by locations along the X-axis 1040, the Y-axis 1050, and the Z-axis 1060, measured from the origin point 128. Referring to FIGS. 8-10, the CG 160 can be located at a horizontal distance $X_O$ (not pictured) along the X-axis 1040, a height $Y_O$ along the Y-axis 1050, and a depth $Z_O$ along the Z-axis 1060. With respect to the ground plane 1010, the CG position can be characterized by a location along the Y-axis 1050. Referring to FIG. 8, the CG 160 can be located at a height $Y_{GP}$ along the Y-axis 1050 measured vertically from the ground plane 1010. With respect to the shaft axis 1075, the CG 160 can be characterized by a horizontal offset distance either forward or rearward of the shaft axis 1075. With respect to the impact point (IP) axis, the CG position can be characterized by a distance along the IP axis 1030, and a vertical and horizontal offset distance from the IP axis 1030. Referring to FIG. 12, the CG 160 can be located at a distance $D_{IP}$ along the IP axis 1030 measured rearward from the impact point 170. Referring to FIG. 11, the CG 160 can be further located at a horizontal offset distance $X_{IP}$ (not pictured) measured parallel to the ground plane 1010, and a vertical offset distance $Y_{IP}$ measured perpendicular to the ground plane 1010 from the impact point 170.

As illustrated in FIGS. 8-10, the golf club head can further define a secondary coordinate system centered about the center of gravity (CG) 160. The secondary coordinate system can be different from the primary coordinate system, which can originate at the origin point 128. The secondary coordinate system can comprise an X'-axis 1070, a Y'-axis 1080, and a Z'-axis 1090. The X'-axis 1070 can extend in a heel-to-toe direction and can be positive towards the heel end 104 and negative towards the toe end 106. The Y'-axis 1080 can extend in a crown-to-sole direction and can be positive towards the crown 110 and negative towards the sole 112. The Z'-axis 1090 can extend in a front-to-rear direction and can be positive towards the strike face 102 and negative towards the rear end 108.

The "moment of inertia" or "MOI" of the club head, as described herein, can refer to a value derived using the center of gravity (CG) location. The MOI can be calculated assuming the club head includes the body and the hosel structure. The term "$MOI_{xx}$" or "$I_{xx}$" can refer to the MOI measured about the X'-axis 1070. The term "$MOI_{yy}$" or "$I_{yy}$" can refer to the MOI measured about the Y'-axis 1080. The term "$MOI_{zz}$" or "$I_{zz}$" can refer to the MOI measured about the Z'-axis 1090. The MOI values $MOI_{xx}$, $MOI_{yy}$, and $MOI_{zz}$ can determine how forgiving the golf club head is for off-center impacts with a golf ball.

The "volume" of the club head, as described herein, can refer to the volume of the body. In some embodiments, the volume can be less than approximately 75 $cm^3$, 70 $cm^3$, 65 $cm^3$, 60 $cm^3$, 55 $cm^3$, 50 $cm^3$, or 45 $cm^3$. In some embodiments, the volume can be between 30 $cm^3$ and 50 $cm^3$, 40 $cm^3$ and 50 $cm^3$, 45 $cm^3$ and 50 $cm^3$, or between 50 $cm^3$ and 60 $cm^3$. In one exemplary embodiment, the volume is 44.7 $cm^3$.

Figure 2:
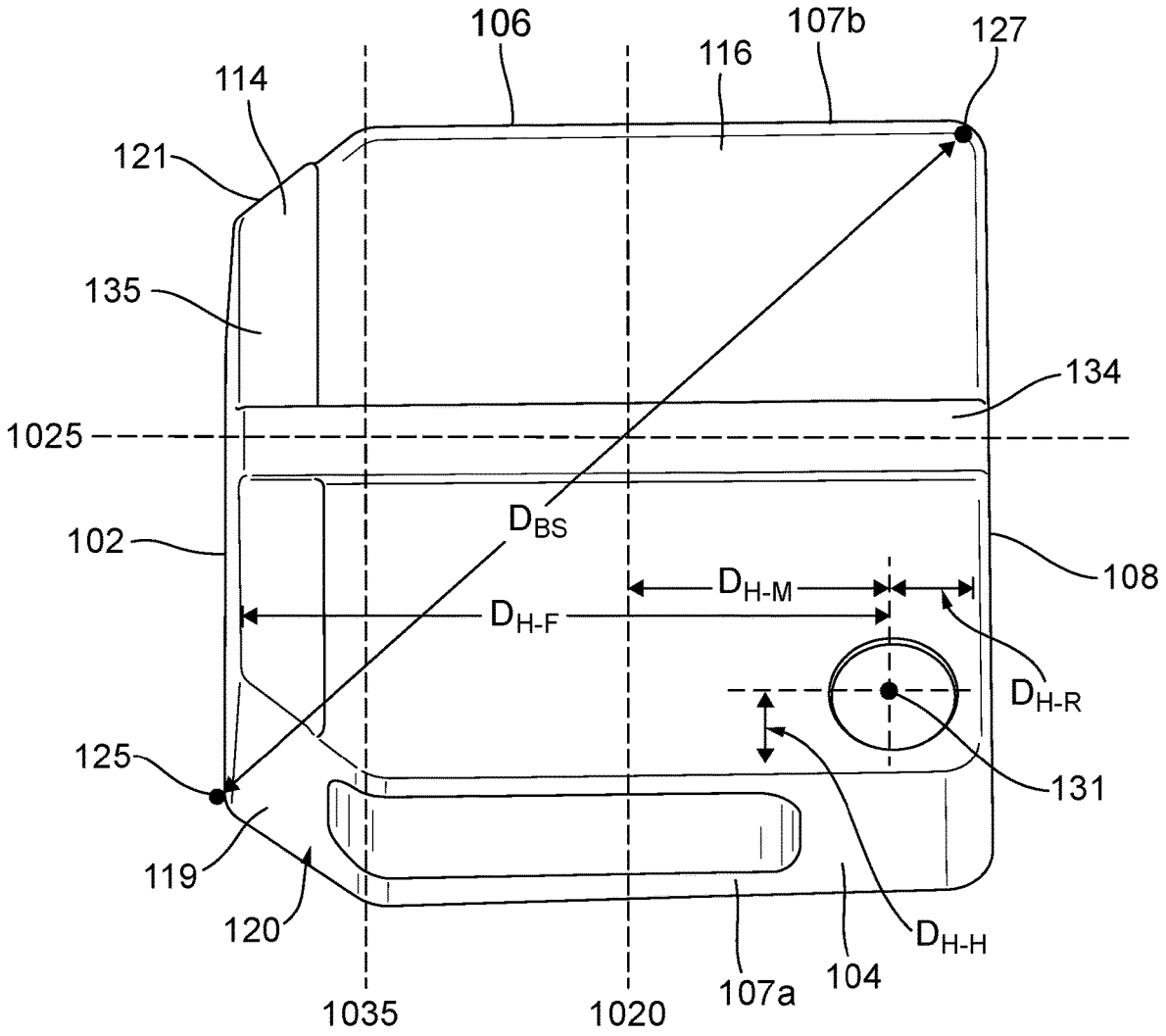
FIG. 2 illustrates a top-perspective view of the compact putter-type golf club head of FIG. 1.

The "heel-toe midplane" of the club head, as described herein, can refer to a midplane of the body that runs from the heel end to the toe end. Referring to FIG. 2, the heel-toe midplane 1020 can extend from the heel end 104 to the toe end 106 and can be located at a midpoint between the strike face 102 and the rear end 108. The heel-toe midplane 1020 can divide the body 101 into a forward half and a rearward half.

The "front-rear midplane" of the club head, as described herein, can refer to a midplane of the body that runs from the strike face to the rear end. Referring to FIG. 2, the front-rear midplane 1025 can extend from the strike face 102 to the rear end 108 and can be located at a midpoint between the heel end 104 and the toe end 106. The front-rear midplane 1025 can divide the body 101 into a heel portion and a toe portion.

DESCRIPTION

I. General Club Head Description

Described herein are embodiments of putter-type golf club heads comprising a compact profile that focuses the player to strike the golf ball on the center of the face, improves impact and delivery characteristics to produce smooth rolling, accurate putts, and forces the player to manually align the putter head. The compact profile of the club head aligns and focuses the player on a small, precise target for striking a golf ball. In many embodiments, the club head further comprises a desirable hosel location and CG location, both of which combine to improve the impact characteristics of the club head, allowing the golf ball to roll across the ground rather than skid or bounce. Facets of a compact putter can include, but are not limited to, any one of or combination of body dimensions such as a strike face width $W_{SF}$ less than 1.55 inches, a body width $W_B$ less than 2.30 inches, a body depth $D_B$ less than 2.50 inches, a strike face area less than 1.50 $in^2$, and a strike face area that is less than 80% of the strike face surface area of a typical prior art putter-type club head. Further aspects of a compact putter can include, but are not limited to, any one of or combination of ratios that compare various characteristics of the putter such as a ratio $W_{SF}/W_B$ of the strike face width $W_{SF}$ to the body width $W_B$ less than 0.75, and a ratio $MOI_{yy}/A_{SF}$ of the moment of inertia $MOI_{yy}$ to the strike face surface area $A_{SF}$ greater than 230 g. While the aforementioned examples outline certain characteristics of the compact putter, further parameters are outlined below.

The features discussed below are demonstrated on club head 100. For ease of discussion, the features shown on club head 100 are applicable to various embodiments of the club head according to the present invention. Any one or more of the features described in the various embodiments below can be used in combination with one another.

Referring to FIG. 1, the club head 100 comprises a body 101, wherein the body 101 comprises a strike face 102 formed at a front end of the body 101, a heel end 104, a toe end 106 opposite the heel end 104, a rear end 108 opposite the strike face 102, a crown 110 defining a top of the body 101, and a sole 112 opposite the crown 110, wherein the sole 112 defines a bottom of the body 101. In some embodiments, the body 101 can be divided into a first portion 114 at the front end of the club head 100 and a second portion 116 rearward of the first portion 114, as illustrated in FIG. 2. In such an embodiment, the first portion 114 can comprise the strike face 102 and a transition region 120, and the second portion 116 can comprise the remainder of the body 101. Further, the first portion 114, and the second portion 116 can be divided by a theoretical transition plane 1035 that extends from the heel end 104 to the toe end 106.

The strike face 102 forms a substantially flat striking surface configured to impact a golf ball. As described in further detail below, the strike face 102 is substantially smaller than the strike faces of many prior art putter-type golf club heads (i.e. less than 80% of the size of a prior-art strike face). The small strike face 102 focuses the player on the face center 150 by providing a smaller, more precise target location for the player to strike the ball. In some embodiments, as discussed in further detail below, the strike face 102 comprises a loft angle greater than the loft angle of a typical putter-type golf club head (i.e. greater than 5 degrees). In such embodiments, the increased loft angle contributes to the improved delivery characteristics of the club head 100.

As illustrated by FIG. 2, the transition region 120 connects the strike face 102 to the second portion 116. The transition region 120 can comprise the strike face 102, a first transition wall 119, a second transition wall 121, and a forward portion of the body 101. In many embodiments, the majority of the body 101 is wider than the strike face 102. In many embodiments, the transition region 120 can be tapered to gradually form a transition between the strike face 102 and the second portion 116. In some embodiments, discussed in further detail below, the transition region 120 can provide alignment benefits by aligning the club head with the golf ball and helping to focus the player on the face center 150.

Referring to FIG. 1, the club head 100 further comprises a hosel 130 configured to couple a golf club shaft (not shown) to the club head 100. The hosel 130 comprises a hosel bore 132 configured to receive the end of a golf shaft and secure the golf shaft therein. The hosel 130 is coupled to the body 101 at a hosel connection point 131, as illustrated in FIG. 2. In many embodiments, the hosel connection point 131 is located substantially rearwardly on the body 101 and can be located closer to the rear end 108 than the strike face 102 (closer to the back than the face). The rearward location of the hosel 130 contributes to the improved delivery characteristics by encouraging the player to deliver the strike face 102 upward at impact and gives a better angle of attack and thereby a better roll. In some alternative embodiments, the hosel connection point 131 is located substantially forward on the body 101 and can be located closer to the strike face 102 than the rear end 108. The forward location of the hosel 130 contributes to the improved delivery characteristics by positioning the hosel 130 forward of the CG 160 for improved forgiveness.

In many embodiments, the hosel 130 is formed separately and attached to the body 101. In many embodiments, the hosel 130 is comprised of a material different than the body material. In many embodiments, the body 101 can comprise a first material with a first density, and the hosel 130 can comprise a second material with a second density, wherein the second density is less than the first density. Providing the hosel 130 with a lower-density material than that of the body 101 allows for the creation of discretionary mass that can be allocated to other portions of the club head 100 to improve the club head mass properties without increasing the overall mass or profile of the club head 100. In other embodiments, the hosel can be made of the same material as the body 101. In some embodiments, rather than being separately formed and attached to the body 101, the hosel 130 can be integrally formed with the body 101 to create a unitary club head 100.

In some embodiments, the sole 112 comprises one or more sole features (not shown) that create an imbalanced feel at address that forces the player to manually align the club head. The sole features create keel points in strategic areas of the sole 112 such that when the club head 100 is at rest on the ground, the club head 100 naturally sits in a position that does not properly align with the golf ball. The sole features provide feedback to the player's hands and force the player to actively hold the club head 100 in place through the imbalanced feel created at address. The sole features can create strategically placed keel points through the natural curvature or geometry of the sole 112, through asymmetry in the sole 112 geometry through protrusions that extend from the sole 112, or by any other suitable structure.

A. Strike Face Relationships

As discussed above, the strike face 102 is substantially smaller than the strike face of a typical prior art putter-type golf club head (i.e. less than 80% of the size of a prior-art strike face). The small strike face 102 provides a more precise target location for striking a golf ball than a larger strike face. The smaller strike face 102 focuses the player on the forward portion of the club head closest to the golf ball. This substantially smaller strikeface draws the eye of the player to a point adjacent the strike face, focusing the user on a position adjacent the ball. This can prevent distraction and encourage focus on the ball throughout the putting stroke. In many embodiments, the inclusion of an alignment feature 134 and/or a transition region 120 can further contribute to focusing the player on the ball throughout the stroke. As discussed above, the transition region 120 can be configured to orient the player's focus on the golf ball.

The compact nature of the strike face 102 provides the additional benefit of allowing the club head 100 to move smoothly through the tall grass on putts from the rough or fringe. The small strike face 102 presents a substantially small surface area normal to the direction of the putting stroke. As such, the force of the tall grass or other obstructions acting against the club head 100 is minimized during the stroke.

In many embodiments, the strike face 102 comprises a surface area between 1.00 $in^2$ and 1.50 $in^2$. In some embodiments, the surface area of the strike face 102 can be less than 1.50 $in^2$, 1.45 $in^2$, 1.40 $in^2$, 1.35 $in^2$, 1.30 $in^2$, 1.25 $in^2$, 1.20 $in^2$, 1.15 $in^2$, 1.10 $in^2$, 1.05 $in^2$, or 1.00 $in^2$. In some embodiments, the surface area of the strike face 102 can be between 1.00 $in^2$ and 1.15 $in^2$, 1.10 $in^2$ and 1.25 $in^2$, 1.20 $in^2$ and 1.45 $in^2$, or 1.20 $in^2$ and 1.50 $in^2$. In many embodiments, the surface area of the strike face 102 can be less than 80% of the strike face surface area of a typical prior art putter-type club head. In some embodiments, the surface area of the strike face 102 can be less than 70% or less than 60% of the surface area of a prior art putter head.

Referring to FIG. 5, the club head 100 comprises a strike face width $W_{SF}$ that can be between 1.25 inches and 1.75 inches. In some embodiments, the strike face width $W_{SF}$ can be between 1.25 inches and 1.50 inches, 1.40 inches and 1.60 inches, or between 1.50 inches and 1.75 inches. In many embodiments, the strike face width $W_{SF}$ can be less than 1.75 inches. In some embodiments, the strike face width $W_{SF}$ can be less than 1.70 inches, 1.65 inches, 1.60 inches, 1.55 inches, 1.50 inches, 1.45 inches, 1.40 inches, 1.35 inches, or less than 1.30 inches. The strike face width $W_{SF}$ is substantially smaller than the strike face width of a typical prior art putter-type golf club head. The reduced strike face width $W_{SF}$ creates an overall smaller strike face 102, helping the player focus on the center 150 of the strike face 102.

The compact strike face width $W_{SF}$ can be further characterized in relation to the diameter of a golf ball. In many embodiments, the strike face width $W_{SF}$ can be between 75% and 150% of the diameter of a golf ball. In some embodiments, the strike face width $W_{SF}$ can be between 75% and 100%, 90% and 120%, 100% and 125%, 110% and 130%, or between 125% and 150% of the diameter of a golf ball. In some embodiments, the strike face width $W_{SF}$ can be substantially equal to the diameter of a golf ball. In many other embodiments, the strike face width $W_{SF}$ can be only slightly larger than a golf ball. In many embodiments, the strike face width $W_{SF}$ can be less than the diameter of a golf ball. In many embodiments, the strike face width $W_{SF}$ can be less than 90% of the diameter of a golf ball. In some embodiments, the strike face width $W_{SF}$ can be less than 50% wider than the diameter of a golf ball. In some embodiments, the strike face width $W_{SF}$ can be less than 150%, 145%, 140%, 135%, 130%, 125%, 120%, 115%, 110%, 105%, 100%, 95% 90%, 85%, or less than 80% of the diameter of a golf ball. In some embodiments, the strike face width $W_{SF}$ can be approximately 90% of the diameter of a golf ball.

Referring to FIGS. 5 and 10, the club head 100 comprises a strike face height $H_{SF}$ (measured parallel to the loft plane 1015) that can be between 0.50 and 1.00 inches. In some embodiments, the height $H_{SF}$ can be between can be between 0.50 inches and 0.75 inches, 0.60 inches and 0.80 inches, or between 0.75 inches and 1.00 inches. In some embodiments, the height $H_{SF}$ can be less than 1.00 inch, 0.95 inch, 0.90 inch, 0.85 inch, 0.80 inch, 0.75 inch, 0.70 inch, 0.65 inch, 0.60 inch, or less than 0.55 inch.

In many embodiments, the strike face 102 can comprise a substantially square profile, wherein the strike face width $W_{SF}$ is substantially similar to the strike face height $H_{SF}$. In many embodiments, the strike face can define a $W_{SF}/H_{SF}$ ratio comparing the strike face width $W_{SF}$ to the strike face height $H_{SF}$. In many embodiments, the $W_{SF}/H_{SF}$ ratio can be between 1.50 and 2.00. In some embodiments, the $W_{SF}/H_{SF}$ ratio can be between 1.50 and 1.60, 1.55 and 1.75, or between 1.65 and 2.00. Due to the small strike face width $W_{SF}$ of the club head 100, the $W_{SF}/H_{SF}$ ratio is substantially smaller than the $W_{SF}/H_{SF}$ ratio of a typical prior art putter-type golf club head. The small strike face 102 having a $W_{SF}/H_{SF}$ ratio between 1.50 and 2.00 helps the player focus on the center 150 of the strike face 102.

The small strike face 102 can further be characterized by the length of the strike face perimeter. In many embodiments, the strike face perimeter length can be less than 5.0 inches. In some embodiments, the strike face perimeter length can be less than 4.75 inches, less than 4.50 inches, less than 4.25 inches, or less than 4.0 inches. The club head 100 can comprise a strike face perimeter length substantially less than a typical prior art club head with a larger strike face.

Referring to FIG. 5, the strike face 102 comprises an apex 126 located at the intersection between the top edge 118 and the Y-axis 1050. The apex 126 is directly above the origin point 128. The strike face 102 further comprises a high-toe corner 122, a low-toe corner 123, a high-heel corner 124, and a low-heel corner 125. The high-toe corner 122 defines the most crown-ward and toe-ward point of the strike face perimeter. The low-toe corner 123 defines the most sole-ward and toe-ward point of the strike face perimeter. The high-heel corner 124 defines the most crown-ward and heelward point of the strike face perimeter. The low-heel corner 125 defines the most sole-ward and heelward point of the strike face perimeter.

Referring again to FIG. 5, the size of the strike face 102 can further be characterized by a corner-to-corner diagonal distance $D_{SF}$ across the strike face 102. The distance $D_{SF}$ is measured as the diagonal distance between the low-heel corner 125 and the high-toe corner 122, measured along the surface of the strike face 102. In many embodiments, the distance $D_{SF}$ can be between 1.25 inches and 1.80 inches. In some embodiments, the distance $D_{SF}$ can be between 1.25 inches and 1.50 inches, 1.40 inches and 1.60 inches, or 1.50 inches and 1.80 inches. In many embodiments, the distance $D_{SF}$ can be less than 1.80 inches, 1.75 inches, 1.70 inches, 1.65 inches, 1.60 inches, 1.55 inches, 1.50 inches, 1.45 inches, 1.40 inches, 1.35 inches, or less than 1.30 inches. A distance $D_{SF}$ between 1.25 inches and 1.80 inches creates an overall smaller strike face 102 and helps the player focus on the center 150 of the strike face 102.

The size and shape of the strike face 102 can further be characterized by an apex angle $\alpha_1$ that relates the location of the apex 126 of the strike face 102 to the low-toe corner 123 and the low-heel corner 125, as illustrated in FIG. 5. The apex angle $\alpha_1$ is defined as the angle between a first reference line connecting the low-toe corner 123 and the apex 126 and a second reference line connecting the low-heel corner 125 and the apex 126. In many embodiments, the apex angle $\alpha_1$ can be between 70 degrees and 90 degrees. In some embodiments, the apex angle $\alpha_1$ can be between 70 degrees and 80 degrees, 75 degrees and 85 degrees, or between 80 degrees and 90 degrees. In many embodiments, the apex angle $\alpha_1$ can be less than 90 degrees, 85 degrees, 80 degrees, or less than 75 degrees. The substantially square shape of the strike face 102 creates a relatively small apex angle $\alpha_1$ in comparison to that of a more oblong rectangular strike face.

The size and shape of the strike face 102 can further be characterized by a center of gravity (CG) angle $\alpha_2$ that relates a CG projection point (i.e. the location of the CG 160 projected perpendicular to the loft plane 1015 on to the strike face 102) to the low-toe corner 123 and the low-heel corner 125, as illustrated in FIG. 5. The CG angle $\alpha_2$ is defined as the angle between a first line connecting the low-toe corner 123 and the CG projection point and a second line connecting the low-heel corner 125 and the CG projection point. In many embodiments, the CG angle $\alpha_2$ can be between 115 degrees and 130 degrees. In some embodiments, the CG angle $\alpha_2$ can be between 115 degrees and 125 degrees, or between 120 degrees and 130 degrees. In many embodiments, the CG angle $\alpha_2$ can be less than 130 degrees, 125 degrees, or less than 120 degrees. The substantially square shape of the strike face 102 creates a relatively small CG angle $\alpha_2$ in comparison to that of a more oblong rectangular strike face.

In some embodiments, the club head 100 can comprise a loft angle that is greater than that of a typical putter-type golf club head. In many embodiments, the loft angle can be between 5 degrees and 14 degrees. In some embodiments, the loft angle can be approximately 5 degrees, 6 degrees, 7 degrees, 8 degrees, 9 degrees, 10 degrees, 11 degrees, 12 degrees, 13 degrees, or approximately 14 degrees. In some embodiments, the loft angle can be greater than 5 degrees. The increased loft angle of the club head 100 produces smoother rolling putts. The increased loft angle provides a slightly upward force on the golf ball at impact that allows the ball to roll sooner, rather than a downward force that presses the golf ball into the ground after impact and causes it to skip or bounce.

B. Body Dimensions and Relationships

The club head 100 comprises a compact body profile, wherein the body width $W_B$ and/or body depth $D_B$ can be substantially smaller than the body widths and body depths of a typical prior art putter-type golf club head. The compact body profile contributes to focusing the player on the center 150 of the strike face 102 and forces the player to deliver the club head more accurately for more consistent impact with the golf ball.

In many embodiments, the body width $W_B$ can be between 1.90 inches and 2.50 inches. In some embodiments, the body width $W_B$ can be between 1.90 inches and 2.10 inches, 2.00 inches and 2.25 inches, 2.15 inches and 2.35 inches, or between 2.25 inches and 2.50 inches. In many embodiments, the body width $W_B$ can be less than 2.50 inches. In some embodiments, the body width $W_B$ can be less than 2.45 inches, 2.40 inches, 2.35 inches, 2.30 inches, 2.25 inches, 2.20 inches, 2.15 inches, 2.10 inches, 2.05 inches, 2.00 inches, or less than 1.95 inches.

In many embodiments, the body depth $D_B$ can be between 1.90 inches and 2.50 inches. In some embodiments, the body depth $D_B$ can be between 1.90 inches and 2.10 inches, 2.00 inches and 2.25 inches, 2.15 inches and 2.35 inches, or between 2.25 inches and 2.50 inches. In many embodiments, the body depth $D_B$ can be less than 2.50 inches. In some embodiments, the body depth $D_B$ can be less than 2.45 inches, 2.40 inches, 2.35 inches, 2.30 inches, 2.25 inches, 2.20 inches, 2.15 inches, 2.10 inches, 2.05 inches, 2.00 inches, or less than 1.95 inches.

In many embodiments, the body height $H_B$ (measured parallel to the Y-axis 1050) can be between 0.50 inches and 1.00 inch. In some embodiments, the body height $H_B$ can be between 0.50 inches and 0.75 inches, 0.60 inches and 0.80 inches, or between 0.75 inches and 1.00 inches. In many embodiments, the body height $H_B$ can be less than 1.00 inch. In some embodiments, the body height $H_B$ can be less than 1.00 inch, 0.95 inch, 0.90 inch, 0.85 inch, 0.80 inch, 0.75 inch, 0.70 inch, 0.65 inch, 0.60 inch, or less than 0.55 inch. The combination of the aforementioned body width $W_B$, body depth $D_B$, and body height $H_B$ create a compact putter-type club head that is significantly smaller than many typical prior art club heads.

In many embodiments, the body profile can be substantially square. The square body profile can be characterized by a $W_B/D_B$ ratio, which compares the body width $W_B$ to the body depth $D_B$. In many embodiments, the $W_B/D_B$ ratio can be between 1.00 and 1.15. In many embodiments, the ratio $W_B/D_B$ can be less than 1.15. In some embodiments, the $W_B/D_B$ ratio can be less than 1.15, 1.14, 1.13, 1.12, 1.11, 1.10, 1.09, 1.08, 1.07, 1.06, 1.05, 1.04, 1.03, 1.02, or less than 1.01. In accordance with USGA regulations for a conforming putter-type club head, which requires the width of the club head to be greater than the depth of the club head, the ratio $W_B/D_B$ is greater than 1.

The strike face 102 can be substantially smaller than the remainder of the body 101. The club head 100 can define a $W_{SF}/W_B$ ratio comparing the strike face width $W_{SF}$ to the body width $W_B$. In many embodiments, the $W_{SF}/W_B$ ratio can be between 0.60 and 0.80. In many embodiments, the $W_{SF}/W_B$ ratio can be less than 0.80. In some embodiments, the $W_{SF}/W_B$ ratio can be less than 0.75, 0.70, or less than 0.65. In accordance with USGA regulations for a conforming putter-type club head, which requires the width of the strike face to be greater than or equal to half the width of the club head, the $W_{SF}/W_B$ ratio is greater than or equal to 0.5. A $W_{SF}/W_B$ ratio between 0.60 and 0.80 creates an overall smaller strike face 102 relative to the body 101, which helps the player focus on the center 150 of the strike face 102. Providing a strike face 102 that is less wide than the body 101 provides the focusing effect associated with the small strike face 102, while allowing for a slightly larger overall club head 100 profile that increases MOI.

Figure 7:
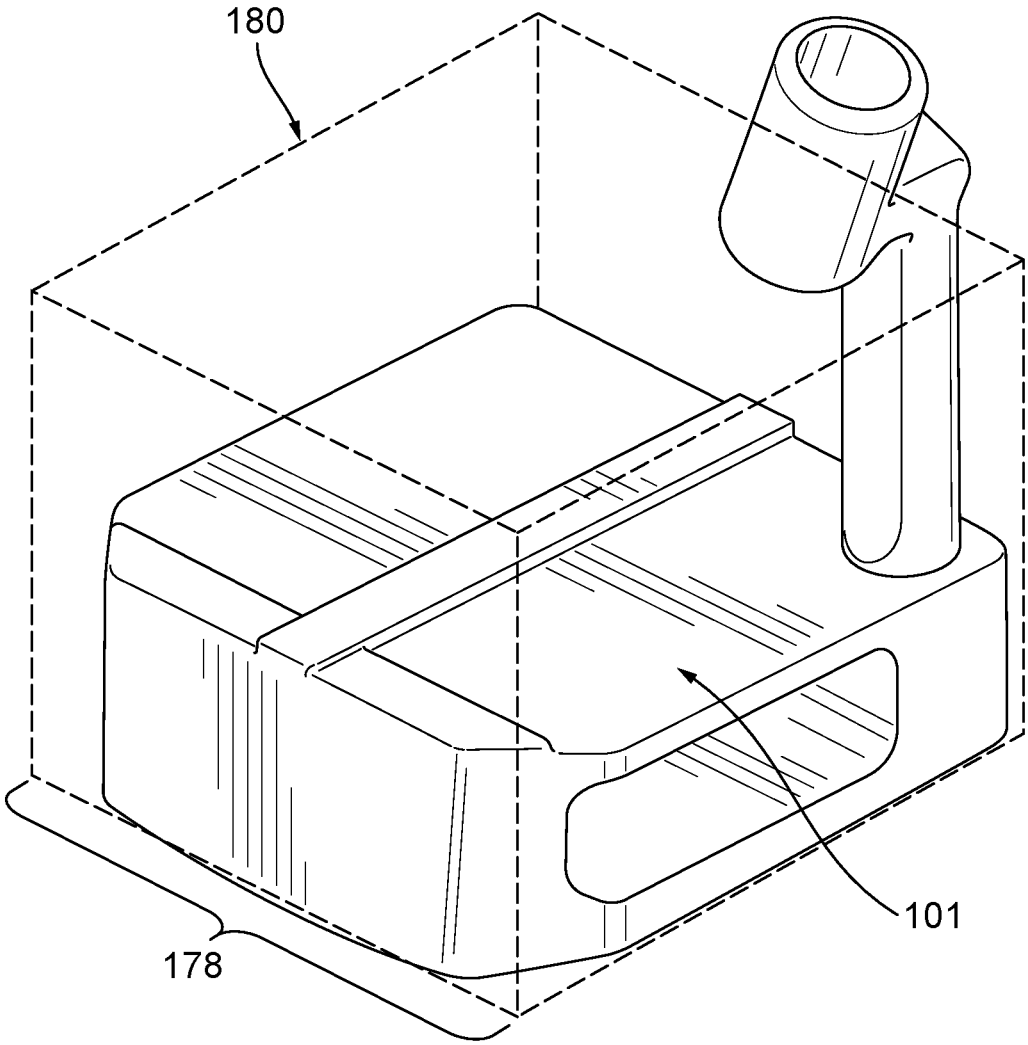
FIG. 7 illustrates a front-perspective view of the compact putter-type golf club head of FIG. 1.

The compact body profile can further be characterized by the length of a greatest rectangular body dimension 178, as illustrated in FIG. 7. The greatest rectangular body dimension 178 can be defined as the greatest dimensional value selected from the group consisting of the body width $W_B$, the body depth $D_B$, and the body height $H_B$. In many embodiments, the greatest rectangular body dimension 178 can be between 1.90 inches and 2.50 inches. In some embodiments, the greatest rectangular body dimension 178 can be between 1.90 inches and 2.10 inches, 2.00 inches and 2.25 inches, 2.15 inches and 2.35 inches, or between 2.25 inches and 2.50 inches. In some embodiments, the greatest rectangular body dimension 178 can be less than 2.50 inches, 2.45 inches, 2.40 inches, 2.35 inches, 2.30 inches, 2.25 inches, 2.20 inches, 2.15 inches, 2.10 inches, 2.05 inches, 2.00 inches, or less than 1.95 inches. In many embodiments, the greatest rectangular body dimension 178 is the body width $W_B$.

The profile of the body 101 can be characterized by comparing the volume of the body 101 to a cubical reference volume 180. Referring to FIG. 7, the cubical reference volume 180 is defined as the volume of a reference cube with sides equal in length to the greatest rectangular body dimension 178. In many embodiments, the volume of the body 101 can be between 15% and 40% of the cubical reference volume 180. In some embodiments, the volume of the body 101 can be between 15% and 25%, 20% and 30%, or between 25% and 40% of the cubical reference volume 180. In many embodiments, the volume of the body 101 can be greater than 15% of the cubical reference volume 180. In some embodiments, the volume of the body 101 can be greater than 20%, 25%, 30%, or greater than 35% of the cubical reference volume 180. The compact putter-type club head 100 having a volume greater than 15% of the cubical reference volume 180 is achievable due to the aforementioned body dimensions. The cubical nature of the club head body 101 profile allows the body 101 to fill a greater percentage of the cubical reference volume 180 than a typical prior-art club head.

Figure 14:
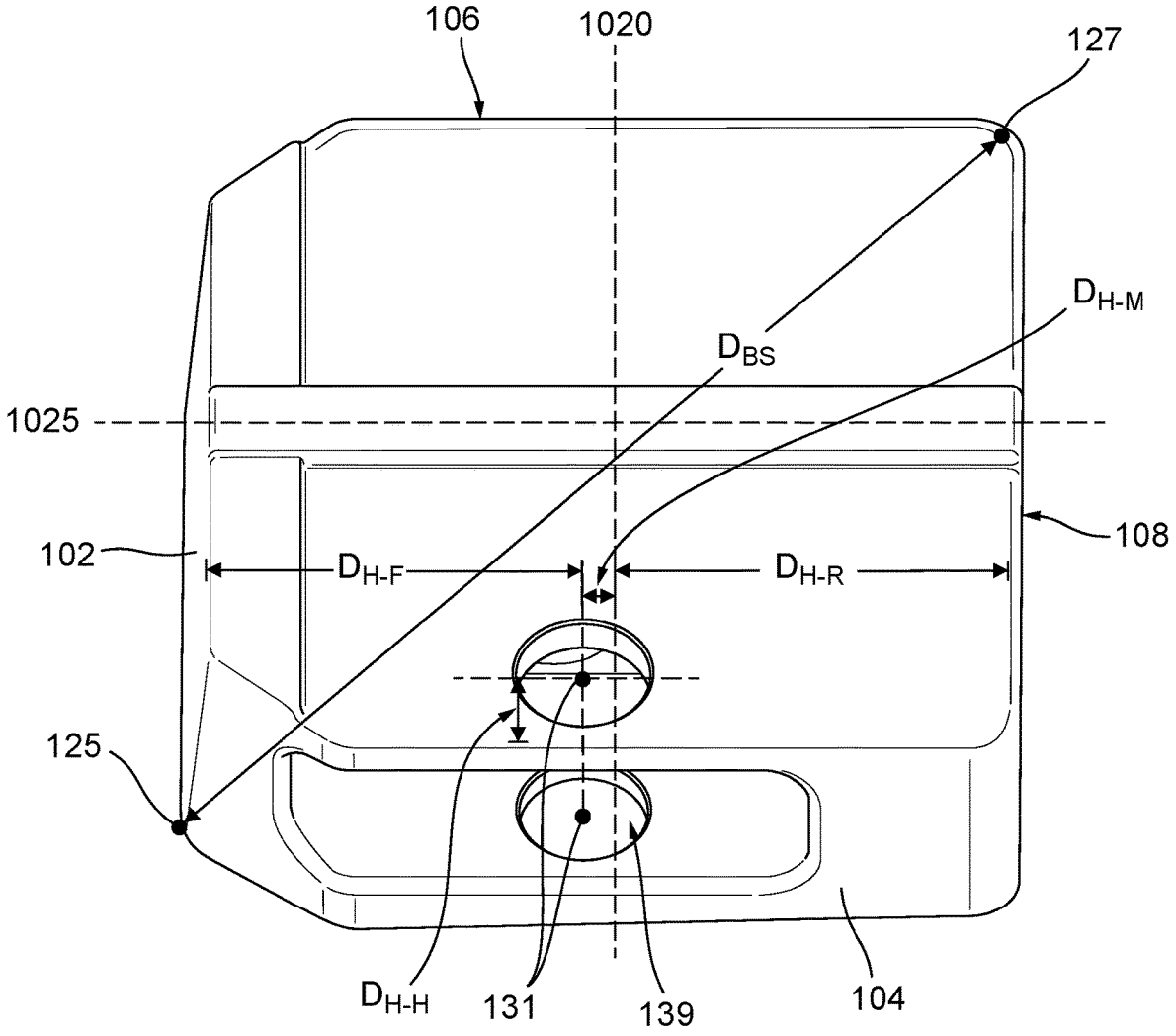
FIG. 14 illustrates a top-perspective view of the compact putter-type golf club head of FIG. 13.

The compact body profile can further be characterized by a body span distance $D_{BS}$, across the body 101, as illustrated in FIG. 14. The body 101 can define a rear high-toe corner 127, which is the most toe-ward and rearward point of the crown 110. The distance $D_{BS}$ is measured as the diagonal distance between the strike face low-heel corner 125 and the rear high-toe corner 127. In many embodiments, the distance $D_{BS}$ can be between 2.25 inches and 3.25 inches. In many embodiments, the distance $D_{BS}$ can be between 2.25 inches and 2.50 inches, 2.40 inches and 2.70 inches, 2.50 inches and 2.90 inches, 2.75 inches and 3.00 inches, 2.90 inches and 3.15 inches, or between 3.00 inches and 3.25 inches. In many embodiments, the distance $D_{BS}$ can be less than 3.25 inches. In some embodiments, the distance $D_{BS}$ can be less than 3.20 inches, 3.15 inches, 3.10 inches, 3.05 inches, 3.00 inches, 2.95 inches, 2.90 inches, 2.85 inches, 2.80 inches, 2.75 inches, 2.70 inches, 2.65 inches, 2.60 inches, 2.55 inches, 2.50 inches, 2.45 inches, 2.40 inches, 2.35 inches, or less than 2.30 inches. The compact putter-type club head 100 having a body span distance $D_{BS}$ between 2.25 inches and 3.25 inches is significantly smaller than many typical prior art club heads.

The compact body profile can further be characterized by a projected area of the body 101. The body 101 can comprise a front projected area $PA_F$ defined as a 2-dimensional area of the club head 100 viewed from the front (as in FIG. 11) and projected on to a vertical plane parallel to both the X-axis 1040 and the Y-axis 1050. The body 101 can comprise a front projected area between 1.5 and 2.25 $in^2$. In many embodiments, the front projected area $PA_F$ can be less than 2.25 $in^2$, less than 2.0 $in^2$, less than 1.75 $in^2$, or less than 1.5 $in^2$. The front projected area $PA_F$ of the body 101 can be less than that of a typical prior art putter head. Providing the body 101 with a front small projected area helps the user putt from the rough or fringe by allowing the club head 100 to glide through tall grass with little resistance.

C. Hosel and Shaft Axis Relationships

As discussed above, the club head 100 comprises a hosel 130 coupled to the body 101 at a hosel connection point 131. In many embodiments, the hosel connection point 131 is located in a rearward position of the body 101 (closer to the rear end 108 than to the strike face 102). The rearward hosel 130 location encourages the player to impact the golf ball with an upward delivery, influencing the golf ball to roll end over end rather than skip or bounce after impact. In some alternative embodiments, the hosel connection point 131 is located in a forward position of the body 101 (closer to the strike face 102 than to the rear end 108). The forward hosel 130 location contributes to the improved forgiveness of the club head 100.

Referring to FIG. 2, the club head 100 can comprise a heel-toe midplane 1020 extending through the body 101 and located halfway between the strike face 102 and the rear end 108. The heel-toe midplane 1020 extends parallel to the X-axis 1040 and the Y-axis 1050 and divides the body 101 into a forward and rearward half.

In many embodiments, as illustrated in FIG. 2, the hosel connection point 131 can be located rearward of the heel-toe midplane 1020. In such embodiments, the hosel 130 is attached to the rearward half of the body 101. The hosel connection point 131 can be located a distance $D_{H-M}$ rearward of the heel-toe midplane 1020, wherein the distance $D_{H-M}$ is measured perpendicular to the heel-toe midplane 1020. In many embodiments, the distance $D_{H-M}$ can be between 0.10 inch and 0.90 inch rearward of the heel-toe midplane 1020. In some embodiments, the distance $D_{H-M}$ can be between 0.10 inch and 0.25 inch, 0.20 inch and 0.50 inch, 0.40 inch and 0.75 inch, 0.50 inch and 0.80 inch, or between 0.75 inch and 0.90 inch rearward of the heel-toe midplane 1020. In many embodiments, the distance $D_{H-M}$ can be greater than 0.10 inch rearward of the heel-toe midplane 1020. In some embodiments, the distance $D_{H-M}$ can be greater than 0.20 inch, 0.30 inch, 0.40 inch, 0.50 inch, 0.60 inch, 0.70 inch, or greater than 0.80 inch rearward of the heel-toe midplane 1020.

In many embodiments, such as the example illustrated in FIG. 14, the hosel connection point 131 can be located forward of the heel-toe midplane 1020. In such embodiments, the hosel 130 is attached to the forward half of the body 101. The hosel connection point can be located a distance $D_{H-M}$ forward of the heel-toe midplane 1020, wherein the distance $D_{H-M}$ is measured perpendicular to the heel-toe midplane 1020. In many embodiments, the distance $D_{H-M}$ can be between 0.01 inch and 0.25 inch forward of the heel-toe midplane 1020. In some embodiments, the distance $D_{H-M}$ can be between 0.01 inch and 0.15 inch, 0.10 inch and 0.25 inch, or between 0.20 inch and 0.25 inch forward of the heel-toe midplane 1020. In many embodiments, the distance $D_{H-M}$ can be less than 0.25 inch forward of the heel-toe midplane 1020. In some embodiments, the distance $D_{H-M}$ can be less than 0.20 inch, 0.15 inch, 0.10, or less than 0.05 inch forward of the heel-toe midplane 1020.

The location of the hosel connection point 131 can further be characterized by a forward perpendicular distance $D_{H-F}$ from the strike face 102, measured perpendicular to the strike face 102, as illustrated in FIGS. 2 and 14. In many embodiments, the distance $D_{H-F}$ can be between 1.00 inch and 2.00 inches. In some embodiments, the distance $D_{H-F}$ can be between 1.00 inch and 1.30 inches, 1.25 inches and 1.50 inches, 1.40 inches and 1.60 inches, 1.50 inches and 1.80 inches, or between 1.75 inches, and 2.00 inches. In many embodiments, the distance $D_{H-F}$ can be greater than 1.00 inch. In some embodiments, the distance $D_{H-F}$ can be greater than 1.10 inch, 1.20 inch, 1.30 inch, 1.40 inch, 1.50 inch, 1.60 inch, 1.70 inch, 1.80 inch, or greater than 1.90 inch.

The location of the hosel connection point 131 can further be characterized by a rearward perpendicular distance $D_{H-R}$ from the rear end 108. As illustrated in FIGS. 2 and 14, the distance $D_{H-R}$ is the distance between the hosel connection point 131 and a rearmost point of the rear end 108, measured perpendicular to the strike face 102. In many embodiments, the distance $D_{H-R}$ can be between 0.25 inch and 1.30 inches. In some embodiments, the distance $D_{H-R}$ can be between 0.25 inch and 0.50 inch, 0.40 inch and 0.80 inch, 0.50 inch and 0.90 inch, 0.75 inch and 1.00 inch, 0.90 inch and 1.15 inches, or between 1.00 inch and 1.30 inches. In many embodiments, the distance $D_{H-R}$ can be less than 1.30 inches. In some embodiments, the distance $D_{H-R}$ can be less than 1.20 inches, 1.10 inches, 1.00 inch, 0.90 inch, 0.80 inch, 0.70 inch, 0.60 inch, 0.50 inch, 0.40 inch, or less than 0.30 inch.

The location of the hosel connection point 131 can further be characterized by a perpendicular distance $D_{H-H}$ from the heel end 104. As illustrated in FIGS. 2 and 14. the distance $D_{H-H}$ is the distance between the hosel connection point 131 and a heelward-most point of the heel end 104, measured parallel to the strike face 102. In many embodiments, the distance $D_{H-H}$ can be between 0.25 inch and 0.75 inch. In some embodiments, the distance $D_{H-H}$ can be between 0.25 inch and 0.50 inch, 0.40 inch and 0.60 inch, or between 0.50 inch and 0.75 inch. In many embodiments, the distance $D_{H-H}$ can be less than 0.70 inch, 0.65 inch, 0.60 inch, 0.55 inch, 0.50 inch, 0.45 inch, 0.40 inch, 0.35 inch, or less than 0.30 inch.

The various locations of the hosel connection point 131 can provide different benefits for delivery characteristics and alignment to different players. In many embodiments, a rearward location of the hosel connection point 131 can influence an upward delivery of the club head 100 at impact, producing a smoother roll. Further, in some embodiments, the rearward location of the hosel connection point 131 can create an imbalance of the club head 100 at address that forces the player to focus on manually aligning the club head 100. In other embodiments, a forward location of the hosel connection point 131 can create a more traditional feeling when aligning the club head 100, which may feel more desirable for certain players.

Referring to FIGS. 8-10, the club head 100 comprise a shaft axis 1075 extending through the hosel 130. The shaft axis 1075 is concentric with the hosel bore 132, which is configured to receive and couple a golf shaft to the club head 100. The shaft axis 1075 therefore represents the orientation of a golf shaft in relation to the club head 100. The orientation of the shaft axis 1075 relative to the body 101 influences how the putter feels in the hands of the player and where the player's hands point when holding the putter. In general, the orientation of the shaft axis 1075 is influenced by the location of the hosel connection point 131 and the design of the hosel 130 itself.

In many embodiments, referring to FIGS. 8-10, the shaft axis 1075 intersects the body 101. In many embodiments, referring to FIG. 10, the shaft axis 1075 can be located rearward of the CG 160. The rearward location of the shaft axis 1075 relative to the CG 160 orients the player's hands towards the rear end 108 of the body 101, which encourages the player to deliver the club head 100 in an upward direction at impact. In some alternative embodiments, the shaft axis 1075 can be located forward of the CG 160.

Referring to FIG. 10, the shaft axis 1075 can be offset a forward or rearward horizontal distance $D_{S\text{-}CG}$ from the CG 160. The offset distance $D_{S\text{-}CG}$ measured between the shaft axis 1075 and the CG 160 creates a desirable imbalance in the feel of the club head 100 when held in the air. In many embodiments, the $D_{S\text{-}CG}$ offset distance can be between 0.01 inch and 0.90 inch rearward of the CG 160. In some embodiments, the $D_{S\text{-}CG}$ offset distance can be between 0.01 inch and 0.15 inch, 0.10 inch and 0.25 inch, 0.20 inch and 0.50 inch, 0.40 inch and 0.75 inch, 0.50 inch and 0.80 inch, or between 0.75 inch and 0.90 inch rearward of the CG 160. In many embodiments, the $D_{S\text{-}CG}$ offset distance can be between 0.01 inch and 0.90 inch forward of the CG 160. In some embodiments, the $D_{S\text{-}CG}$ offset distance can be between 0.01 inch and 0.15 inch, 0.10 inch and 0.25 inch, 0.20 inch and 0.50 inch, 0.40 inch and 0.75 inch, 0.50 inch and 0.80 inch, or between 0.75 inch and 0.90 inch forward of the CG 160. Because the shaft axis 1075 is offset from the CG 160 (as characterized by $D_{S\text{-}CG}$), gravity will cause the club head 100 to naturally rotate away from a properly aligned position. The offset between the shaft axis 1075 and the CG 160 forces the player to have to actively resist the natural rotation of the club head 100 and manually align the club head 100 in the proper position.

In many other embodiments, the shaft axis 1075 can intersect the IP axis 1030, which is discussed in more detail below. In some embodiments, the shaft axis 1075 can intersect the IP axis 1030 at a location rearward of the CG 160. Providing a shaft axis 1075 that extends through the IP axis 1030 balances the club head 100 in the player's hands and increases the ability of the player to strike the golf ball at the impact point 170.

D. Mass Properties

The club head 100 described herein is configured to provide top spin to a golf ball by positioning the CG 160 along or below an axis perpendicular to the strike face at an expected, optimal impact point. Referring to FIGS. 11 and 12, an impact point 170 is defined on the strike face 102, and an IP axis 1030 extends tangential to the strike face 102 at the impact point 170.

A golf ball struck at the impact point 170 will transmit the desired amount of energy and provide the desired amount of "gearing" between the strike face 102 and the golf ball to impart a top spin on the golf ball. The impact point 170 is located at an impact point height $H_{IP}$ located above the origin point 128. The height $H_{IP}$ is derived from the geometry of a golf ball, where an average optimal impact location is determined for the golf ball. Therefore, the impact point 170 is a relatively constant point on the strike face 102 as the physical dimensions of the golf ball do not get larger or smaller in response to a change in the club head dimensions. The impact point 170 is independent of the strike face height $H_{SF}$.

In many embodiments, the impact point 170 is located below the centerline of a golf ball such that the height $H_{IP}$ is less than approximately half of the height of a golf ball. Referring to FIG. 11, the impact point height $H_{IP}$ is measured perpendicularly from the ground plane 1010. In some embodiments, the height $H_{IP}$ is between 0.25 inch to 0.60 inch. In some embodiments, the height $H_{IP}$ is approximately 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.45 inch, 0.46 inch, 0.47 inch, 0.48 inch, 0.49 inch or 0.50 inch, 0.51 inch, 0.52 inch, 0.53 inch, 0.54 inch, 0.55 inch, 0.56 inch, 0.57 inch, 0.58 inch, 0.59 inch, or approximately 0.60 inch. In many embodiments, the impact point 170 can be positioned below the centerline of a golf ball to influence spin. In other embodiments, the impact point 170 can be located at or above the centerline of a golf ball such that the height $H_{IP}$ is greater than or equal to approximately half of the height of a golf ball. The impact point 170 can alternatively be positioned at the face center 150.

The impact point 170 defines a point where the strike face 102 intersects the IP axis 1030. The IP axis 1030 extends rearward from and perpendicular to the strike face 102 from the average optimal impact location between the strike face 102 and a golf ball. The CG 160 location relative to the IP axis 1030 influences the top spin imparted on the golf ball and the ability for the club head 100 to produce smooth rolling putts.

In some embodiments, the CG 160 can be located directly on the IP axis 1030. In some embodiments, the CG 160 can be located below the IP axis 1030. In such embodiments, the force of impact causes the strike face 102 to rotate rearward about the CG 160, increasing the dynamic loft at impact and creating a gearing effect between the strike face 102 and the golf ball. The gearing effect imparts a top spin on the golf ball and produces a smoother roll.

In many embodiments, the CG position can be described relative to the impact point (IP) axis 1030. Referring to FIGS. 11 and 12, the CG position can be located relative to the impact point 170 at a distance $D_{IP}$ along the IP axis 1030, a horizontal offset distance $X_{IP}$ (not pictured) measured parallel to the ground plane 1010, and a vertical offset distance $Y_{IP}$ measured perpendicular to the ground plane 1010. The distance $D_{IP}$ can describe the rearward distance from the impact point 170 to the CG 160. In many embodiments, the distance $D_{IP}$ can be between 1.00 inch to 1.25 inches. In some embodiments, the distance $D_{IP}$ can be between 1.00 inch and 1.05 inch, between 1.05 inch and 1.10 inch, between 1.10 inch and 1.15 inch, between 1.15 inch and 1.20 inch, or between 1.20 inch and 1.25 inch.

The distance $X_{IP}$ can describe the horizontal offset between the CG 160 and the impact point 170. In many embodiments, the distance $X_{IP}$ can be between 0.0 inch to 0.25 inch. In some embodiments, the distance $X_{IP}$ can be between 0.0 inch and 0.15 inch, 0.10 inch and 0.25 inch, or between 0.20 inch and 0.25 inch. In some embodiments, the distance $X_{IP}$ can be less than 0.25 inch, 0.20 inch, 0.15 inch, 0.10, or less than 0.05 inch. A distance $X_{IP}$ less than 0.25 inch helps the putter-type club head 100 deliver more accurately for more consistent impact with the golf ball.

Referring to FIG. 11, the distance $Y_{IP}$ can describe the vertical offset between the CG 160 and the impact point 170. In some embodiments, the impact point 170 can be located above the CG 160 such that the distance $Y_{IP}$ can be a distance below the impact point 170 to the CG 160. In other embodiments, the impact point 170 can be located below the CG 160 such that the distance $Y_{IP}$ can be a distance above the impact point 170 to the CG 160. Therefore, the distance $Y_{IP}$ is measured as an absolute value, even when the reference to an absolute value is not expressly stated. In many embodiments, the distance $Y_{IP}$ can be between 0.01 inch and 0.25 inch. In some embodiments, the distance $Y_{IP}$ can be between 0.01 inch and 0.15 inch, 0.10 inch and 0.25 inch, or between 0.20 inch and 0.25 inch. A distance $Y_{IP}$ less than 0.25 inch helps the putter-type club head 100 produce a smoother roll. To achieve this optimized CG position, the club head components can be carefully arranged to position the CG 160 on or near the IP axis 1030.

As discussed above, the center of gravity (CG) 160 can be optimally located to improve certain club head characteristics such as moment of inertia (MOI), launch angle, or spin. In many embodiments, the CG position can alternatively be described relative to the primary coordinate system based at the origin point 128. Referring to FIGS. 8-10, the CG position can be located relative to the origin point 128 at a horizontal distance $X_O$ (not pictured) along the X-axis 1040, a height $Y_O$ along the Y-axis 1050, and a depth $Z_O$ along the Z-axis 1060.

The distance $X_O$ can describe the horizontal offset between the CG 160 and the origin point 128. In many embodiments, the distance $X_O$ can be between 0.01 inch and 0.10 inch. In some embodiments, the distance $X_O$ can be between 0.01 inch and 0.03 inch, 0.02 inch and 0.05 inch, 0.04 inch and 0.08 inch, or between 0.06 inch and 0.10 inch. In many embodiments, the distance $X_O$ can be less than 0.10 inch. In some embodiments, the distance $X_O$ can be less than 0.09 inch, 0.08 inch, 0.07 inch, 0.06 inch, 0.05 inch, 0.04 inch, 0.03 inch, or less than 0.02 inch.

The height $Y_O$, as illustrated in FIGS. 8 and 9, can describe the vertical offset between the CG 160 and the origin point 128. In many embodiments, the height $Y_O$ can be between 0.15 inch and 0.65 inch. In some embodiments, the height $Y_O$ can be between 0.15 inch and 0.25 inch, 0.20 inch and 0.40 inch, 0.30 inch and 0.50 inch, or between 0.40 inch and 0.65 inch. In many embodiments, the height $Y_O$ can be less than 0.65 inch. In some embodiments, the height $Y_O$ can be less than 0.60 inch, 0.55 inch, 0.50 inch, 0.45 inch, 0.40 inch, 0.35 inch, 0.30 inch, 0.25 inch, or less than 0.20 inch.

The depth $Z_O$, as illustrated in FIG. 10, can describe the horizontal offset between the CG 160 and the origin point 128. In many embodiments, the depth $Z_O$ can be between 1.00 inch and 1.25 inches. In many embodiments, the depth $Z_O$ can be between 1.00 inch and 1.10 inches, 1.05 inches and 1.15 inches, or between 1.10 inches and 1.25 inches. In many embodiments, the depth $Z_O$ can be greater than 1.00 inch. In some embodiments, the depth $Z_O$ can be greater than 1.05 inches, 1.10 inches, 1.15 inches, or greater than 1.20 inches.

In many embodiments, the CG position can be described relative to the ground plane 1010. Referring to FIG. 8, the CG 160 can be located at a height $Y_{GP}$ along the Y-axis 1050 above the ground plane 1010. In many embodiments, the height $Y_{GP}$ can be between 0.25 inch to 0.75 inch. In some embodiments, the height $Y_{GP}$ can be between 0.25 inch and 0.50 inch, 0.40 inch and 0.60 inch, or between 0.50 inch and 0.75 inch. In many embodiments, the height $Y_{GP}$ can be less than 0.75 inch. In some embodiments, the height $Y_{GP}$ can be less than 0.70 inch, 0.65 inch, 0.60 inch, 0.55 inch, 0.50 inch, 0.45 inch, 0.40 inch, 0.35 inch, or less than 0.30 inch. CG positions within the ranges described above relating to distance $X_O$, height $Y_O$, depth $Z_O$, and height $Y_{GP}$ can provide the club head 100 improved launch and delivery characteristics for more consistent impact with the golf ball.

The club head 100 defines a total mass including the mass of the body 101 and the mass of the hosel 130. In many embodiments, the total mass is between 325 grams to 400 grams. The club head 100 further defines a body mass including only the mass of the body 101. In many embodiments, the body mass is between 300 grams to 375 grams. In many embodiments, the club head 100 defines a body mass comparable to the body mass of many prior art putter-type club heads despite the compact profile of the body 101. As discussed above, the club head 100 comprises a volume in a range of 20 $cm^3$ to 75 $cm^3$. In many embodiments, the club head 100 can define a ratio of the body mass/volume comparing the body mass to the volume of the body 101.

Due to the compact profile and size of the club head 100, the club head inherently comprises a moment of inertia that is generally lower than the typical prior art putter head comprising a larger overall profile. However, the moment of inertia is maximized relative to the compact size of the club head 100. The club head 100 therefore comprises the greatest possible forgiveness without sacrificing the alignment and focusing benefits of the compact profile.

The club head 100 defines a moment of inertia ($MOI_{xx}$) measured about the X'-axis 1070, a moment of inertia ($MOI_{yy}$) measured about the Y'-axis 1080, and a moment of inertia ($MOI_{zz}$) measured about the Z'-axis 1090. The MOI values $MOI_{xx}$, $MOI_{yy}$, and $MOI_{zz}$ are maximized to maximize the forgiveness of the club head 100 on off-center impacts with a golf ball. In many embodiments, the $MOI_{xx}$ is between 1000 $g \cdot cm^2$ and 2000 $g \cdot cm^2$. In some embodiments, the MOI is between 1000 $g \cdot cm^2$ and 1300 $g \cdot cm^2$, 1200 $g \cdot cm^2$ and 1500 $g \cdot cm^2$, 1400 $g \cdot cm^2$ and 1700 $g \cdot cm^2$, 1600 $g \cdot cm^2$ and 1900 $g \cdot cm^2$, or between 1700 $g \cdot cm^2$ and 2000 $g \cdot cm^2$. In many embodiments, the $MOI_{yy}$ is between 1700 $g \cdot cm^2$ and 3000 $g \cdot cm^2$. In some embodiments, the $MOI_{yy}$ is between 1700 $g \cdot cm^2$ and 2300 $g \cdot cm^2$, 2000 $g \cdot cm^2$ and 2500 $g \cdot cm^2$, 2400 $g \cdot cm^2$ and 2700 $g \cdot cm^2$, 2600 $g \cdot cm^2$ and 2900 $g \cdot cm^2$, or between 2700 $g \cdot cm^2$ and 3000 $g \cdot cm^2$. In many embodiments, the $MOI_{zz}$ is between 1000 $g \cdot cm^2$ and 2000 $g \cdot cm^2$. In some embodiments, the $MOI_{zz}$ is between 1000 $g \cdot cm^2$ and 2000 $g \cdot cm^2$. In some embodiments, the $MOI_{xx}$ is between 1000 $g \cdot cm^2$ and 1300 $g \cdot cm^2$, 1200 $g \cdot cm^2$ and 1500 $g \cdot cm^2$, 1400 $g \cdot cm^2$ and 1700 $g \cdot cm^2$, 1600 $g \cdot cm^2$ and 1900 $g \cdot cm^2$, or between 1700 $g \cdot cm^2$ and 2000 $g \cdot cm^2$.

The compact putter-type club head 100 strikes a balance between forgiveness and the focusing effect. The focusing effect requires the club head 100 to comprise a small strike face 102 and a compact body profile, which generally correlates to a low MOI. However, the features described herein (such as the transition walls and mass reducing features) provide a maximized MOI relative to the small body profile. The maximized MOI provides a maximum amount of forgiveness, given the compact size of the body 101. The maximized MOI can also provide the additional benefit of stabilizing the club head 100 on putts through the rough or fringe. As mentioned above, the compact size of the club head 100 minimizes the forces of tall grass acting against the club head 100 during the putting stroke. The maximized MOI stabilizes the club head 100 by providing increased resistance to twisting or rotating caused by said forces on putts through taller grass.

As discussed above, in many embodiments, the body width $W_B$ can be between 1.9 inch and 2.5 inch. In many embodiments, the club head 100 can define a $MOI_{yy}/W_B$, ratio comparing the body width $W_B$ to the moment of inertia ($MOI_{yy}$) of the club head 100. In many embodiments, the $MOI_{yy}/W_B$ ratio can be greater than 300 g·cm. In some embodiments, the $MOI_{yy}/W_B$ ratio can be greater than 305 g·cm, 310 g·cm, 315 g·cm, 320 g·cm, 325 g·cm, 330 g·cm, 335 g·cm, 340 g·cm, 345 g·cm, 350 g·cm, 355 g·cm, 360 g·cm, 365 g·cm, 370 g·cm, 375 g·cm, 380 g·cm, 385 g·cm, 390 g·cm, 395 g·cm, or greater than 400 g·cm. A $MOI_{yy}/W_B$ ratio greater than 300 g·cm is achievable due to the relatively small body width $W_B$ and relatively large $MOI_{yy}$ of the compact putter-type club head 100.

As discussed above, in many embodiments, the strike face 102 comprises a strike face surface area $A_{SF}$ between 1.00 and 1.50 $in^2$. In many embodiments, the club head 100 can define a $MOI_{yy}/A_{SF}$ ratio, comparing the strike face area to the moment of inertia ($MOI_{yy}$) of the club head 100. In many embodiments, the $MOI_{yy}/A_{SF}$ ratio can be greater than 230 grams. In some embodiments, the $MOI_{yy}/A_{SF}$ ratio can be greater than 235 grams, 240 grams, 245 grams, 250 grams, 255 grams, 260 grams, 265 grams, 270 grams, 275 grams, 280 grams, 285 grams, 290 grams, 295 grams, or greater than 300 grams. A $MOI_{yy}/A_{SF}$ ratio greater than 230 grams is achievable due to the relatively small strike face area and relatively large $MOI_{yy}$ of the compact putter-type club head 100.

Any of the mass properties discussed above can apply to any of the various club head embodiments described herein. In particular, any of the various club head embodiments described herein can comprise MOI values, CG positions, or any other associated ratios and relationships within the ranges listed above.

E. Additional Features

Many embodiments of the club head 100 described herein provide enhanced alignment features to help the golfer focus while executing a putting stroke. In addition, many embodiments of the club head 100 described herein provide enhanced structural characteristics to improve other club head properties such as CG and MOI.

In many embodiments, the club head 100 comprises an alignment feature 134, as illustrated by FIG. 2. The alignment feature 134 can be any one or combinations of the following: a line, a circle, a dashed line, a triangle, a rectangle, a channel, a protrusion, or any other desired alignment feature. In many embodiments, the alignment feature 134 can be centered on the front-rear midplane 1025. In some embodiments, the alignment feature 134 can extend from the leading edge 103 to the rear edge 109. In some embodiments, the alignment feature 134 can extend rearward from the leading edge and terminate forward of the rear edge 109. In some embodiments, the alignment feature 134 can extend rearward from the leading edge just past the transition plane 1035. In some embodiments, the alignment feature 134 can be rearwardly offset from the strike face 102. In such an embodiment, the alignment feature 134 can be positioned within 0.25 inches from the strike face 102.

In some embodiments the alignment feature 134 can define a recess, or a plurality of recesses that are recessed into the top surface of the crown 110. In such an embodiment, each recess can be any one of the following: a line, a circle, a dashed line, a triangle, a rectangle, a channel, a protrusion, or any other desired alignment feature. In some embodiments, the alignment feature 134 can be a protrusion, or a plurality of protrusions that protrude from the crown 110. In such an embodiment, each protrusion can be any one of the following: a line, a circle, a dashed line, a triangle, a rectangle, a channel, a protrusion, or any other desired alignment feature. The alignment feature 134 provides visual feedback as to whether the club head 100 is properly aligned at address. In addition to the alignment feature 134, the body 101 of the club head 100 itself acts as an aid in alignment by focusing the player on the center 150 of the strike face 102 and forcing the player to manually align the club head 100.

Figure 4:
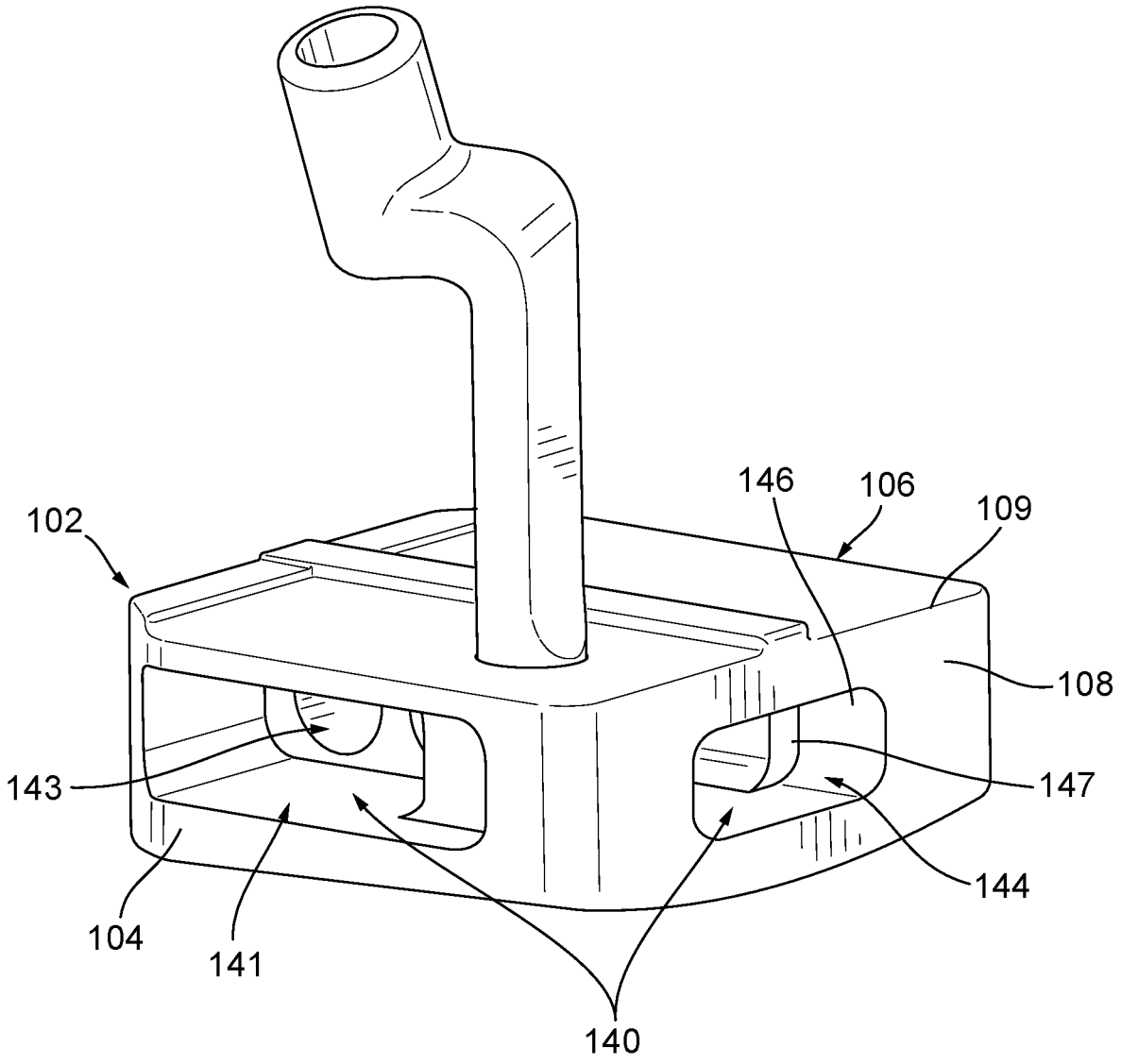
FIG. 4 illustrates a rear-heel perspective view of the compact putter-type golf club head of FIG. 1.

In many embodiments, such as the example illustrated by FIG. 4, the body 101 can comprise one or more mass reducing features 140 selectively positioned to create discretionary mass and improve the mass properties of the club head 100. In general, the one or more mass reducing features can be considered as portions of the body 101 from which mass has been removed. In many embodiments, the one or more mass reducing features 140 take the form of one or more voids, apertures, recesses, cavities, gaps, hollows, holes, spaces, channels, slits, slots, or openings formed within a portion of the body 101. In many embodiments, the one or more mass reducing features 140 are centrally located with respect to the body 101. In doing so, the mass reducing features 140 remove mass from near the center of gravity (CG) 160, allowing the discretionary mass created by the inclusion of the mass reducing features 140 to be allocated towards the periphery of the club head 100 to increase the club head moment of inertia (MOI).

The club head 100 can be formed of a single material or multiple materials. One or more portions of the club head can be formed by one or any combination of the following materials: 8620 alloy steel, S25C steel, carbon steel, maraging steel, 17-4 stainless steel, 303 stainless steel, 304 stainless steel, stainless steel alloy, tungsten, aluminum, aluminum alloy, ADC-12, or any metal suitable for creating a golf club head. In many embodiments, as discussed above, the body 101 comprises a first material and the hosel 130 comprises a second material.

In some embodiments (not shown), different portions of the body 101 can be made of different materials. For example, in some embodiments, the body 101 can comprise a first portion made of a first material having a first density and a second portion made of a second material having a second density that is different than the first density. Providing different portions of the body 101 with different materials in strategic arrangements can allow mass to be distributed in advantageous ways to enhance the mass properties of the club head (i.e. provide a desirable CG position and/or increase MOI).

In some embodiments, the club head 100 may further comprise one or more weight inserts (not shown) to further control the mass distribution of the club head 100. The weight inserts can be formed separately and coupled to the body 101. The weight inserts can be separately formed and coupled to the body 101 via welding, soldering, brazing, swedging, adhesion, epoxy, mechanical fastening, or any other suitable joining method. In some embodiments, the body 101 can form one or more weight recesses (not shown) configured to receive the one or more weight inserts. In many embodiments, the weight inserts can be formed of a material comprising a density greater than the density of one or more portions of the body 101. The inclusion of the weight inserts allows high amounts of mass to be concentrated in specific locations to improve the mass properties of the club head 100.

In some embodiments, the club head 100 can comprise a strike face insert (not shown). In such embodiments, the strike face insert is independently formed prior to being coupled to the club head 100. In some embodiments, the strike face insert can be made out of a material that is the same or similar to one or more portions of the body 101. In other embodiments, the strike face insert can be made of different material than the material of the body 101. In many embodiments, the first portion 114 can form an insert cavity (not shown) configured to receive the strike face insert. The strike face can be secured by an adhesive such as glue, very high bond (VHB™) tape, epoxy or another adhesive. Alternately or additionally, the strike face can be secured by welding, soldering, screws, rivets, pins, mechanical interlock structure, or another fastening method.

The strike face insert can comprise any one or layered combination of the following: aluminum, stainless steel, copper, thermoplastic co-polyester elastomer (TPC), thermoplastic elastomer (TPE), thermoplastic urethane (TPU), steel, nickel, TPU/aluminum, TPE/aluminum, plastic/metal screen insert, polyethylene, polypropylene, polytetrafluoroethylene, polyisobutylene, polyvinyl chloride, PEBAX®, or any other desired material. PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. In some embodiments, the face insert can comprise a material such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof. In some embodiments, the strike face insert can comprise a single layer. In other embodiments, the strike face insert can comprise two layers, three layers, four layers, or five layers.

II. Compact Putter-Type Club Head with Square Shaped Body

For ease of discussion, the club head 100 is used to locate the features discussed above, which are applicable to any embodiments of the club head. In an exemplary embodiment, the club head 100 comprises a strike face 102 formed at a front end of the body 101, a heel end 104, a toe end 106 opposite the heel end 104, a rear end 108 opposite the strike face 102, a crown 110 defining a top of the body 101, and a sole 112 opposite the crown 110, wherein the sole 112 defines a bottom of the body 101. The body 101 is divided into a first portion 114 and a second portion 116. The first portion 114 comprises a strike face 102 and a transition region 120. The second portion 116 is positioned rearward from the first portion 114. The second portion 116 comprises the remainder of the body 101 and a hosel 130. The transition region 120 connects the strike face 102 to the remainder of the body 101.

The club head 100 of FIGS. 1-18 comprises a substantially prismatic and/or rectangular body 101. Referring to FIG. 2, the second portion 116 comprises a heel sidewall 107*a* and a toe sidewall 107*b*. The heel sidewall 107*a* forms the heel-side perimeter of the body 101 along the second portion 116, and likewise the toe sidewall 107*b* forms the toe-side perimeter of the body 101 along the second portion 116. The sidewalls 107*a*, 107*b* can extend in a substantially front-to-rear direction, wherein the sidewalls 107*a*, 107*b* are perpendicular to the strike face 102. In many embodiments, the sidewalls 107*a*, 107*b* can also be substantially planar, but for any recesses or weight reducing features formed therein (described in further detail below).

Referring to FIG. 2, the club head 100 further comprises an alignment feature 134. The alignment feature 134 comprises a single protrusion that extends perpendicular to the strike face 102, from the leading edge 103 to the rear edge 109. The alignment feature 134 is centered on the front-rear midplane 1025. As illustrated in FIG. 11, the alignment feature 134 is located directly above the face center 150. The alignment feature 134 assists primarily in focusing the player on the location of face center 150 at address and making sure the strike face 102 is lined up to the target line.

Referring back to FIG. 2, the club head 100 further comprises a secondary alignment feature 135. In the present embodiment, the secondary alignment feature 135 comprises a protrusion extending from the top surface of the crown 110. The secondary alignment feature 135 extends from the heel end 104 to the toe end 106, parallel to the strike face 102. In many embodiments, the secondary alignment feature 135 runs along the top edge 118 of the strike face 102. The secondary alignment feature 135 highlights the top edge 118. Due to the small strike face width $W_{SF}$, the secondary alignment feature 135 is integral in assisting the player in squaring the strike face 102 to the intended target line. The alignment feature 134 and the secondary alignment feature 135 combine to form a "T" shape that assists in aligning the face center 150 with the golf ball and squaring the strike face 102 to the intended target line at address. The secondary alignment feature 135 also helps to highlight the angle of the strike face 102 throughout the putting stroke. The secondary alignment feature 135 compensates for the fact that it can be difficult to keep track of the small strike face 102 during the putting stroke.

Figure 3:
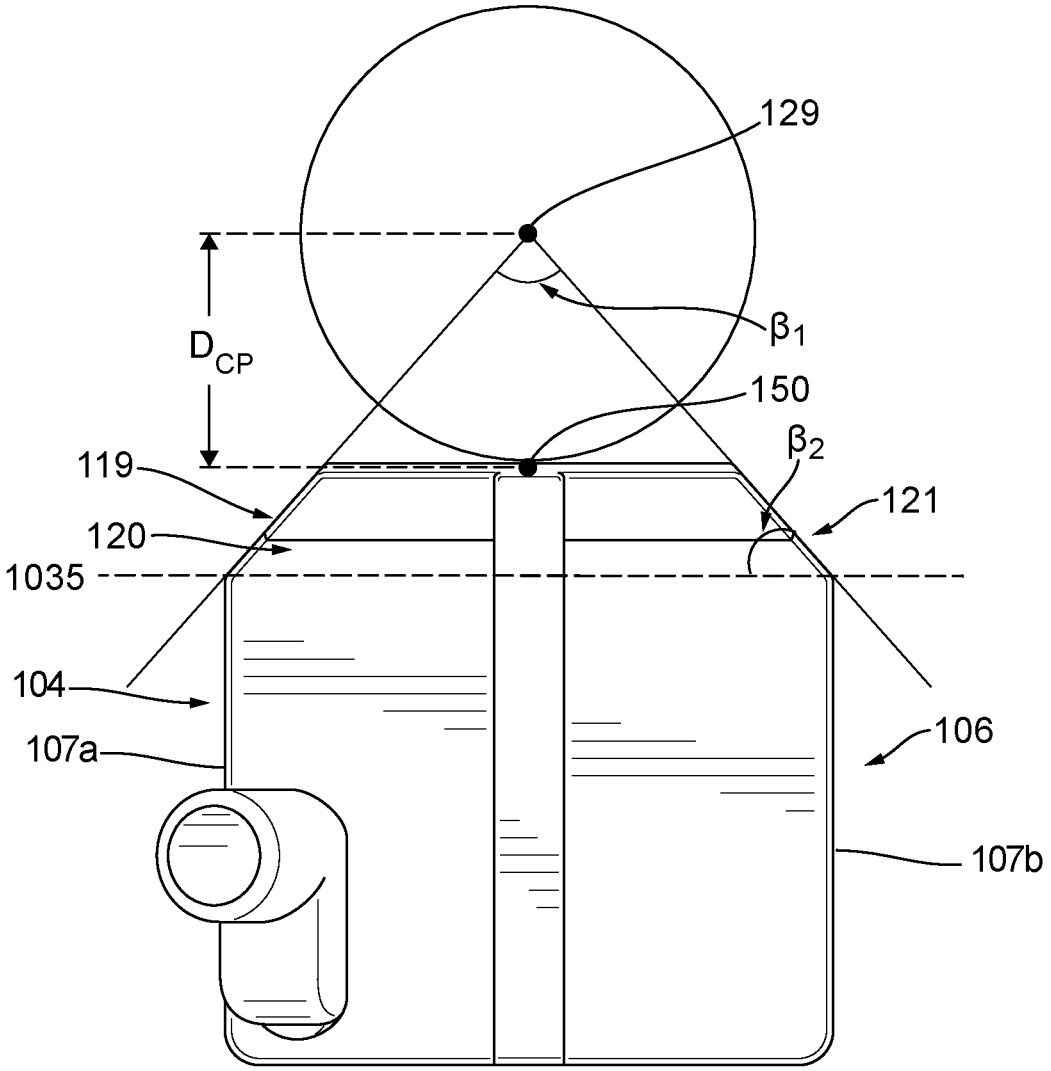
FIG. 3 illustrates a top view of the compact putter-type golf club head of FIG. 1.

The transition region 120 provides additional alignment benefits. Referring to FIG. 3, the transition region 120 comprises a first transition wall 119 and a second transition wall 121 that extend rearward from the strike face 102 and toward the second portion 116 of the body 101. The transition walls 119, 121 are angled with respect to the strike face 102 such that the width of the club head 100 increases gradually from the strike face 102 to the second portion 116. As discussed above, the transition region 120 can provide alignment benefits.

The first transition wall 119 and the second transition wall 121 can point to the center of the golf ball, drawing the user's eye to the center of the golf ball. In many embodiments, the first transition wall 119 and the second transition wall 121 can be angled inwardly towards the face center 150. Referring to FIG. 3, the first transition wall 119 and the second transition wall 121 can each define a tangent plane, and the tangent planes can converge at a convergence point 129. The convergence point 129 can be located at a convergence point distance $D_{CP}$ measured from the face center 150. In many embodiments, the first transition wall 119 and the second transition wall 121 can converge to a geometric center point of a golf ball such that the distance $D_{CP}$ can be approximately half of the diameter of a golf ball. In many other embodiments, the first transition wall 119 and the second transition wall 121 can converge to a forward-most point of a golf ball such that the distance $D_{CP}$ can be approximately equal to the diameter of a golf ball.

In many embodiments, the distance $D_{CP}$ can be between 0.65 inch and 1.75 inch. In some embodiments, the distance $D_{CP}$ can be between 0.65 inch and 0.85 inch, 0.80 inch and 1.10 inch, 1.00 inch and 1.25 inch, 1.15 inch and 1.40 inch, 1.30 inch and 1.60 inch, or between 1.50 inch and 1.75 inch. In one exemplary embodiment, the distance $D_{CP}$ can be approximately 0.83 inch, or approximately the radius of a golf ball. In another exemplary embodiment, the distance $D_{CP}$ can be approximately 1.68 inch, or approximately the diameter of a golf ball.

The alignment characteristics of the transition region 120 can further be characterized by a convergence point angle $\beta_1$ that relates the angle of the transition region walls at the convergence point 129. Referring to FIG. 3, the convergence point angle $\beta_1$ can be measured at the convergence point 129 between the tangent planes defined by the first transition wall 119 and the second transition wall 121. In many embodiments, the convergence point angle $\beta_1$ can be between 75 degrees and 90 degrees. In many embodiments, the convergence point angle $\beta_1$ can be less than 90 degrees, 89 degrees, 88 degrees, 87 degrees, 86 degrees, 85 degrees, 84 degrees, 83 degrees, 82 degrees, 81 degrees, 80 degrees, 79 degrees, 78 degrees, 77 degrees, or less than 76 degrees. Due to the inward angle of the transition walls 119, 121, the convergence point angle $\beta_1$ can be a relatively small angle.

The alignment characteristics of the transition region 120 can further be characterized by a transition wall angle $\beta_2$ that relates the angle of the transition region walls to the transition plane 1035. Referring to FIG. 3, the transition wall angle $\beta_2$ can be measured between either of the tangent planes defined by the transition walls 119,121 and the transition plane 1035. In many embodiments, the transition wall angle $\beta_2$ can be between 25 degrees and 60 degrees. In many embodiments, the transition wall angle $\beta_2$ can be less than 60 degrees, 59 degrees, 58 degrees, 57 degrees, 56 degrees, 55 degrees, 54 degrees, 53 degrees, 52 degrees, 51 degrees, 50 degrees, 49 degrees, 48 degrees, 47 degrees, 46 degrees, 45 degrees, 44 degrees, 43 degrees, 42 degrees, 41 degrees, 40 degrees, 39 degrees, 38 degrees, 37 degrees, 36 degrees, 35 degrees, 34 degrees, 33 degrees, 32 degrees, 31 degrees, 30 degrees, 29 degrees, 28 degrees, 27 degrees, or less than 26 degrees. Due to the inward angle of the transition walls 119, 121, the transition wall angle $\beta_2$ can be a relatively small angle.

In addition to the alignment benefits described above, the transition walls 119, 121 can increase the ability of the club head 100 to glide through tall grass, such as when putting from the fringe or rough. The angled transition walls 119, 121 reduce the resistance of the grass against the club head 100 by providing an oblique contact between the grass and the transition region 120. Further, the angled transition walls 119, 121 provide more consistent contact between the strike face 102 and the golf ball by displacing the grass towards the heel end 104 and toe end 106 and away from the strike face 102. Further, the transition walls 119, 121 are generally symmetric about the center of the club head 100. The symmetry helps balance the forces of the grass against the transition walls 119, 121. This balancing of forces provides stability to the club head 100 in such conditions.

Similarly, the sidewalls 107*a*, 107*b* can provide additional alignment benefits. Referring to FIG. 3, the sidewalls 107*a*, 107*b* extend in a substantially straight, front-to-rear direction. Further, the sidewalls 107*a*, 107*b* are parallel to one another and the alignment feature 134 and perpendicular to both the strike face 102 and the secondary alignment feature 135. The sidewalls 107*a*, 107*b* therefore each provide an extra frame of reference for the player relating to the club head orientation, both at setup and throughout the duration of the putting stroke. For example, because the strike face 102 is so small, it can be difficult for the player to track its orientation as the club head 100 moves throughout the stroke. The orientation of the sidewalls 107*a*, 107*b* provides a larger frame of reference for the orientation of the body 101 (and therefore of the strike face 102) that is easier for the player to track as the club head 100 is moving.

The sidewalls 107*a*, 107*b* may also provide the additional benefit of stabilizing the club head 100 on putts from the fringe or rough. The sidewalls 107*a*, 107*b* are symmetric about the center of the club head 100 and parallel to one another. Due to the symmetrical nature of the sidewalls 107*a*, 107*b*, the forces acting on sidewalls 107*a*, 107*b* by the tall grass during the putting stroke can counteract each other. Said counteracting forces provide a stabilizing effect that resists the club head 100 twisting through the rough or fringe and causing an errant shot.

Figure 13:
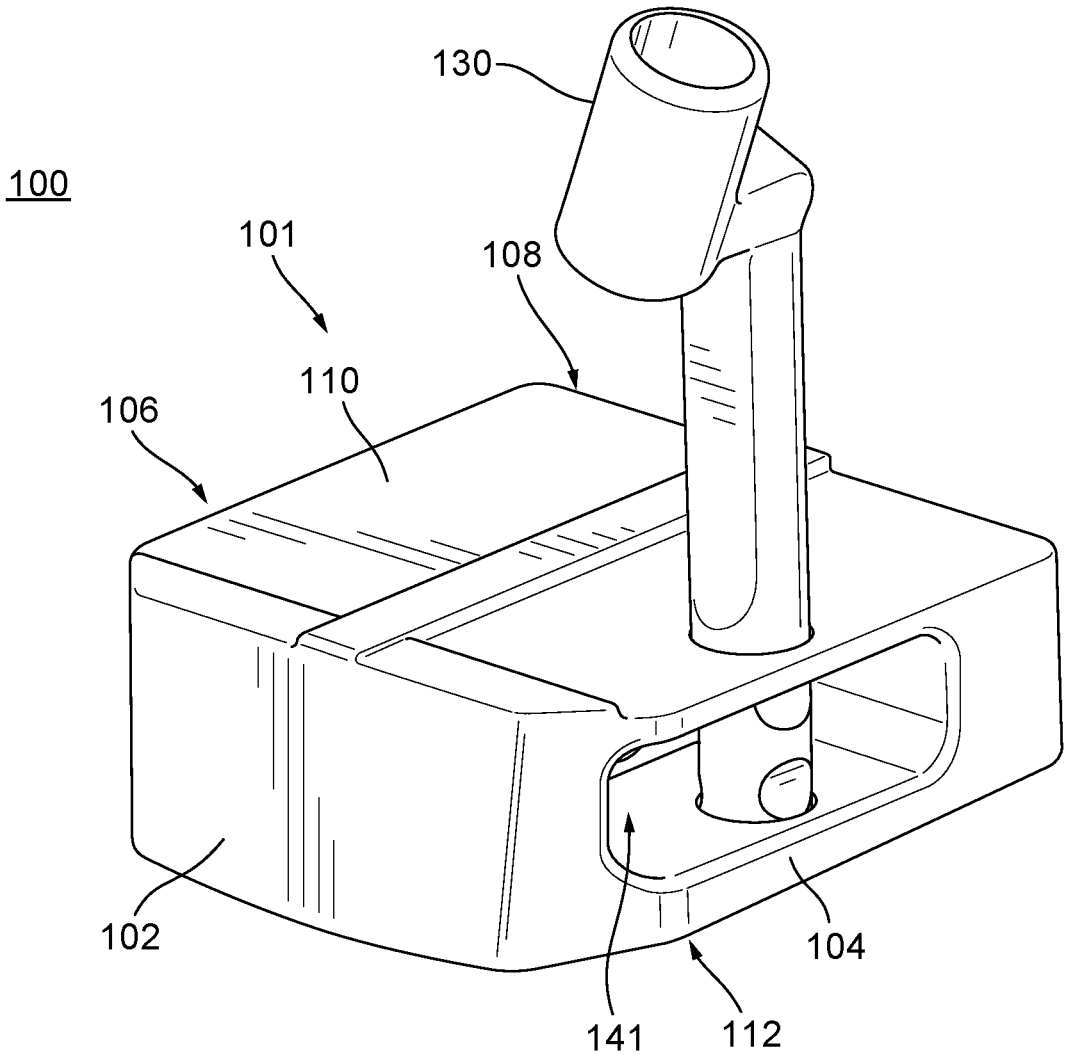
FIG. 13 illustrates a front-perspective view of a compact putter-type golf club head comprising a forward hosel.
Figure 17:
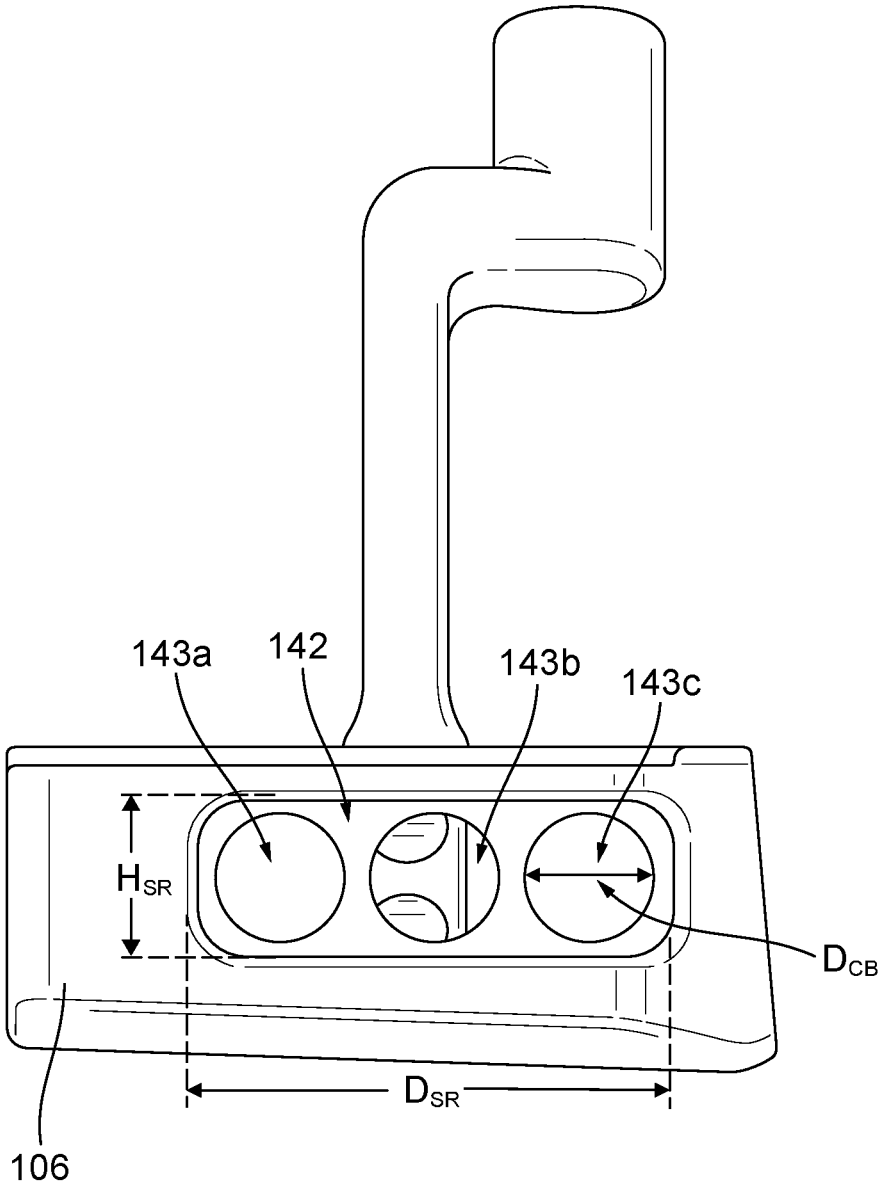
FIG. 17 illustrates a toe side view of the compact putter-type golf club head of FIG. 13.

The body 101 comprises mass reducing features 140 to create discretionary mass and improve the mass properties of the club head 100. Referring to FIGS. 4 and 17, the body 101 defines a heel-side recess 141 near the heel end 104 and a toe-side recess 142 near the toe end 106. The heel-side and toe-side recesses 141, 142 are recessed into the body 101 away from the heel end 104 and the toe end 106, respectively. In some embodiments, as illustrated in FIG. 4, the heel-side and toe-side recesses 141, 142 are symmetrical with one another about the front-rear midplane 1025. In other embodiments, as illustrated in FIGS. 13 and 17, the heel-side and toe-side recesses 141, 142 are symmetrical with one another about the front-rear midplane 1025, but the hosel 130 extends through the heel-side recess 141.

Figure 16:
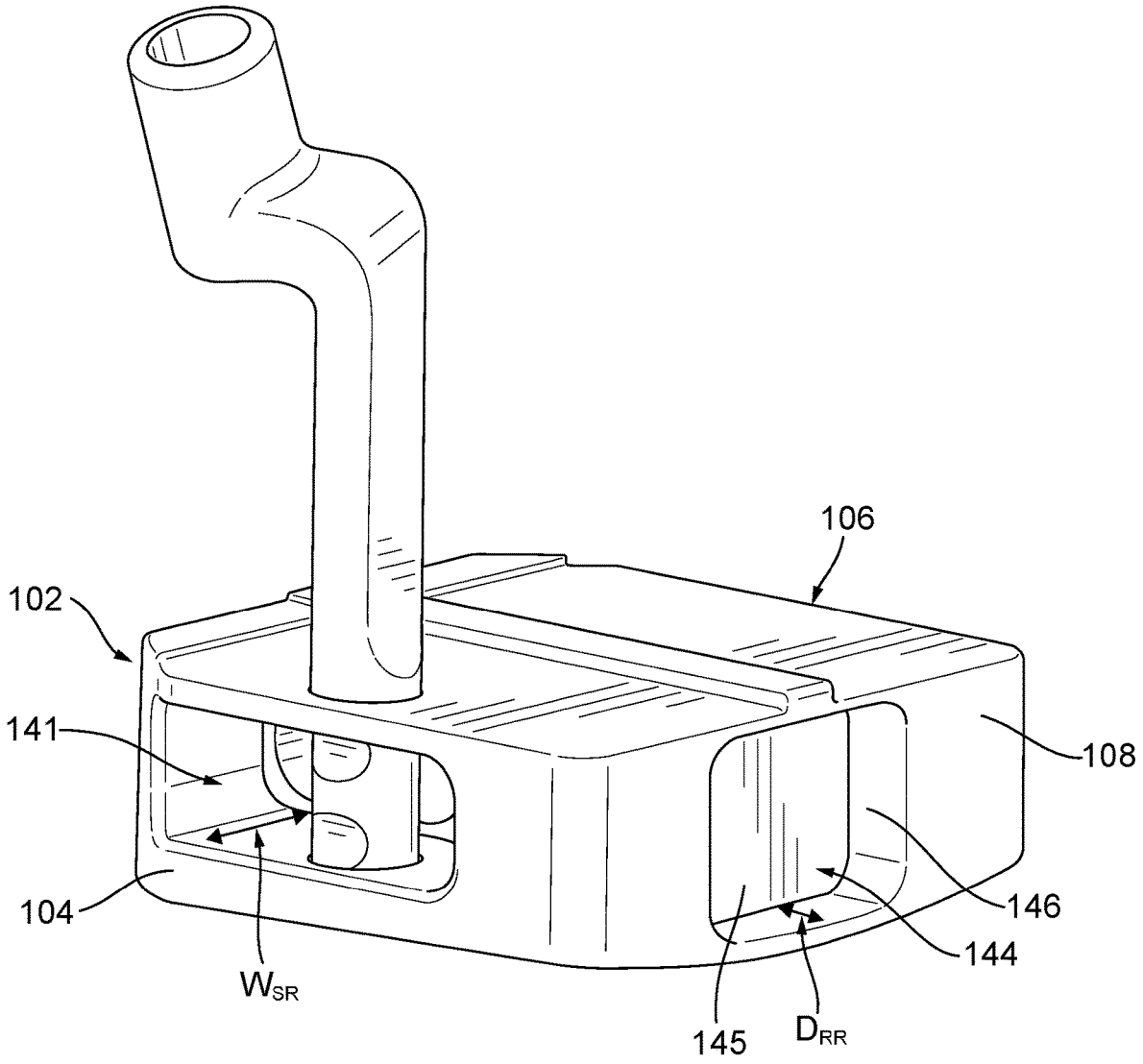
FIG. 16 illustrates a rear-heel perspective view of the compact putter-type golf club head of FIG. 13.

In some embodiments, the club head 100 can comprise heel and toe-side recesses 141, 142 to direct the CG 160 to IP axis 1030. The heel and toe-side recesses (side recesses) 141, 142 each define a side recess height $H_{SR}$ measured vertically from a lower surface to an upper surface, as illustrated in FIG. 17. In many embodiments, the side recess height $H_{SR}$ can be between 0.25 inch and 0.75 inch. The side recesses 141, 142 each further define a side recess width $W_{SR}$ measured in a heel-to-toe direction from a from an internal edge to an external edge of each of the side recesses 141, 142, as illustrated in FIG. 16. In many embodiments, the side recess width $W_{SR}$ can be between 0.25 inch and 1.00 inch. The side recesses 141, 142 each further define a side recess depth $D_{SR}$ measured from a forward end to a rearward end, as illustrated in FIG. 17. In many embodiments, the side recess depth $D_{SR}$ can be between 1.00 inch and 2.00 inches. The side recess height $H_{SR}$, side recess width $W_{SR}$, and side recess depth $D_{SR}$ can remain constant or vary throughout the side recesses 141, 142.

The club head 100 can define various ratios to characterize the heel and toe-side recesses 141, 142 relative to the solid components of the body 101. The club head 100 can define a ratio $H_{SR}/H_B$ comparing the side recess height $H_{SR}$ to the body height $H_B$. In many embodiments, the $H_{SR}/H_B$ ratio can be between 0.40 and 0.80. The club head 100 can further define a ratio $W_{SR}/W_B$ comparing the side recess width $W_{SR}$ to the body width $W_B$. In many embodiments, the $W_{SR}/W_B$ ratio can be between 0.20 and 0.50. The club head 100 can further define a ratio $D_{SR}/D_B$ comparing the side recess depth $D_{SR}$ to the body depth $D_B$. In many embodiments, the $D_{SR}/D_B$ ratio can be between 0.50 and 0.90. The heel and toe-side recesses 141, 142 can define cutout regions of the body 101 near the heel end 104 and toe end 106. These ratios are maximized to increase the cutout volume, thereby increasing the amount of discretionary mass that can be redistributed to more desirable areas of the body 101. In many embodiments, the heel and toe-side recesses 141, 142 can define a combined volume of between 10 $cm^3$ and 16 $cm^3$.

The body 101 further defines one or more central bores 143 extending through the body 101 from the heel-side recess 141 to the toe-side recess 142. In other words, the central bores 143 are located near a center of the body 101 and connect the side recesses 141, 142, which are located near the heel end 104 and toe end 106, respectively. Referring to FIG. 17, the body 101 defines a first bore 143*a*, a second bore 143*b*, and a third bore 143*c*. However, in other embodiments of the club head, the number of central bores is not limited. For example, other embodiments of the club head can include one bore, two bores, three bores, four bores, five bores, six bores, or any suitable number of bores. In many embodiments, the central bores 143 can define a cylindrical shape, as illustrated in FIG. 17. However, in other embodiments, the central bores 143 can define any other suitable shape.

Referring again to FIG. 17, each central bore 143 can define a central bore diameter $D_{CB}$ measured across the opening. In many embodiments, the central bore diameter $D_{CB}$ can be between 0.20 inch and 0.50 inch. In some embodiments, the central bore diameter $D_{CB}$ can be between 0.20 inch to 0.40 inch, 0.30 inch to 0.50 inch, or 0.45 inch to 0.50 inch. Each central bore 143 can further define a central bore width $W_{CB}$ (not pictured) measured across each central bore 143 in a heel-to-toe direction. In many embodiments, the central bore width $W_{CB}$ can be between 0.5 inch and 1.00 inch. In some embodiments, the central bore width $W_{CB}$ can be between 0.50 inches and 0.75 inches, 0.60 inches and 0.80 inches, or between 0.75 inches and 1.00 inches. The central bore diameter $D_{CB}$ and the central bore width $W_{CB}$ can remain constant or may vary throughout the central bores 143.

The club head 100 can define various ratios to characterize the central bores 143 relative to the solid components of the body 101. The club head 100 can define a ratio $D_{CB}/H_B$ comparing the central bore diameter $D_{CB}$ to the body height $H_B$. In many embodiments, the $D_{CB}/H_B$ ratio can be between 0.20 and 0.50. The club head 100 can further define a ratio $W_{CB}/W_B$ comparing the central bore width $W_{CB}$ to the body width $W_B$. In many embodiments, the $W_{CB}/W_B$ ratio can be between 0.20 and 0.50. The central bores 143 can define cutout regions of the body 101 that extend from the heel-side recess 141 to the toe-side recess 142. In many embodiments, the central bores 143 can define a combined volume of between 3 $cm^3$ to 5 $cm^3$.

Figure 18:
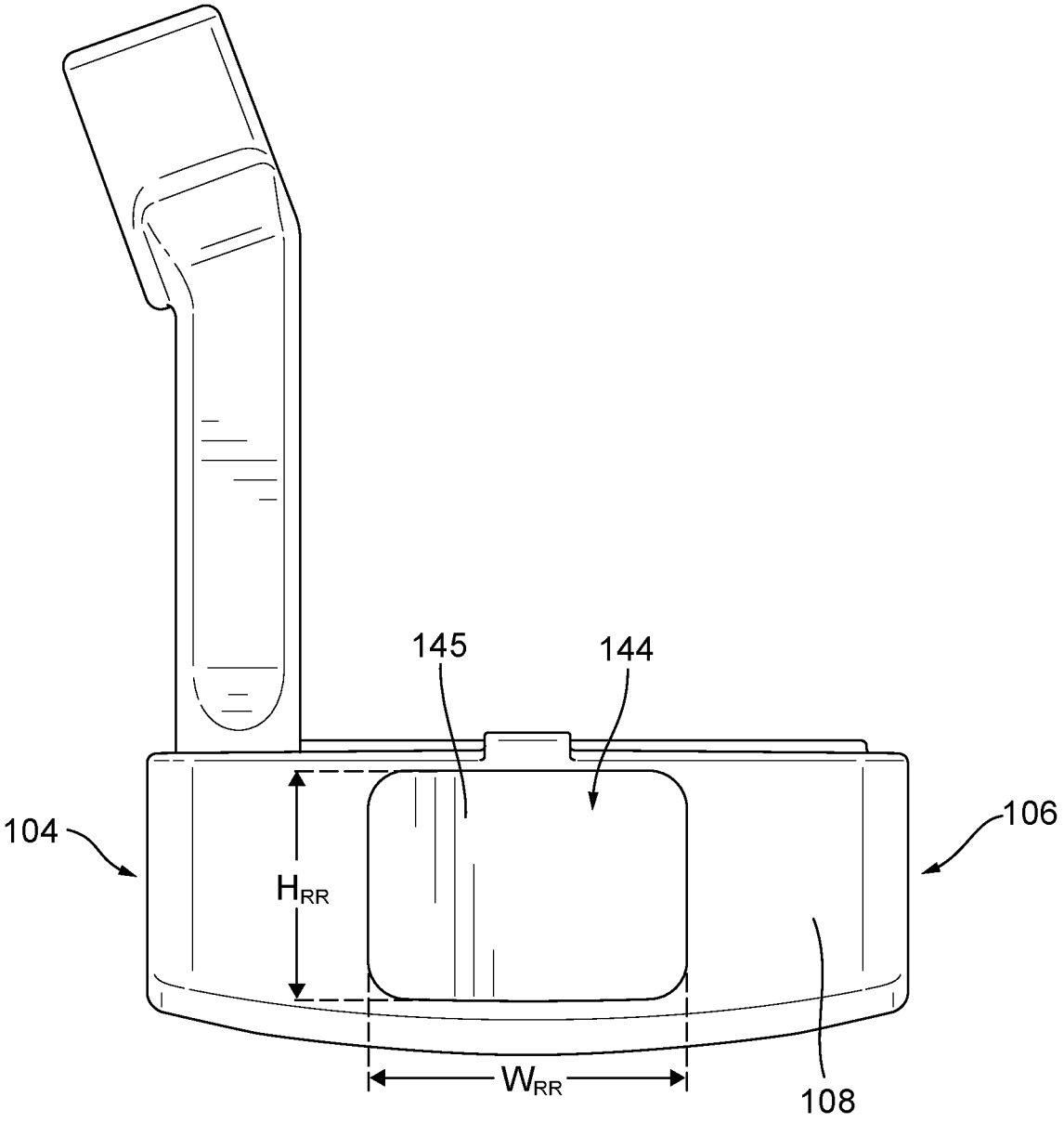
FIG. 18 illustrates a rear view of the compact putter-type golf club head of FIG. 13.

Referring to FIG. 16, the body 101 further defines a rear recess 144 that is recessed into the body 101 away from the rear end 108 via a floor 145 and a perimeter wall 146. The rear recess 144 can define a rear recess height $H_{RR}$ measured vertically from a lower surface to an upper surface of the rear recess 144, as illustrated in FIG. 18. In many embodiments, the rear recess height $H_{RR}$ can be between 0.25 inch and 0.75 inch. The rear recess 144 can further define a rear recess width $W_{RR}$ measured across the rear recess 144 in a heel-to-toe direction, as illustrated in FIG. 18. In many embodiments, the rear recess width $W_{RR}$ can be between 0.80 inch and 1.20 inches. The rear recess 144 can further define a rear recess depth $D_R$ measured from the floor 145 to the rear end 108, as illustrated in FIG. 16. In many embodiments, the rear recess depth $D_{RR}$ can be between 0.20 inch and 1.00 inch. In some embodiments, the rear recess 144 can define a stepped recess, as illustrated in FIG. 4. In such embodiments, the perimeter wall 146 can define a ledge 147. The ledge 147 provides a stepped surface within the rear recess 144 and creates a change in the rear recess width $W_{RR}$. In other embodiments, the rear recess 144 defines a constant depth, as illustrated in FIG. 16. The rear recess height $H_{RR}$, rear recess width $W_{RR}$, and rear recess depth $D_{RR}$ can remain constant or vary throughout the rear recess 144.

The club head 100 can define various ratios to characterize the rear recess 144 relative to the solid components of the body 101. The club head 100 can define a ratio $H_{RR}/H_B$ comparing the rear recess height $H_{RR}$ to the body height $H_B$. In many embodiments, the $H_{RR}/H_B$ ratio can be between 0.40 and 0.80. The club head 100 can further define a ratio $W_{RR}/W_B$ comparing the rear recess width $W_{RR}$ to the body width $W_B$. In many embodiments, the $W_{RR}/W_B$ ratio can be between 0.20 and 0.50. The club head 100 can further define a ratio $D_{RR}/D_B$ comparing the rear recess depth $D_{RR}$ to the body depth $D_B$. In many embodiments, the $D_{RR}/D_B$ ratio can be between 0.05 and 0.50. The rear recess 144 can define a cutout region near the rear end of the body 101. These ratios are maximized to increase the cutout volume, thereby increasing the amount of discretionary mass that can be redistributed to more desirable areas of the body 101. In many embodiments, the rear recess 144 can define a volume of between 2 $cm^3$ and 5 $cm^3$.

The mass reducing features 140 (the heel-side and toe-side recesses 141, 142, the central bores 143, and the rear recess 144) remove mass from near the center of gravity (CG) 160, allowing the discretionary mass created by the inclusion of the mass reducing features 140 to be allocated towards the periphery of the club head 100 to increase the club head moment of inertia (MOI). In many embodiments, the mass reducing features 140 define a combined volume of between 15 $cm^3$ to 25 $cm^3$. The mass reducing features 140 maximize the club head MOI while still allowing for a compact body 101 including a small strike face 102.

The strike face 102 of the present embodiment is substantially smaller than the strike face of a typical prior art putter-type golf club head. The strike face 102 comprises a surface area between 1.15 $in^2$ and 1.25 $in^2$. The surface area of the strike face 102 can be less than 80% of the strike face surface area of a typical prior art putter-type club head. The strike face width $W_{SF}$ can be between 1.45 inches and 1.55 inches. The strike face height $H_{SF}$ can be between 0.80 inch and 0.85 inch. The ratio $W_{SF}/H_{SF}$ can be between 1.80 and 1.90. The corner-to-corner diagonal distance $D_{SF}$ across the strike face 102 can be between 1.65 and 1.75. The apex angle $\alpha_1$ can be between 80 degrees and 90 degrees. The CG angle $\alpha_2$ can be between 120 degrees and 130 degrees.

Similar to the strike face 102, the body 101 of the present embodiment is substantially smaller than a typical prior art putter-type golf club head body. The body width $W_B$ can be between 2.10 inches and 2.30 inches. The body depth $D_B$ can be between 2.00 inches and 2.50 inches. The body height $H_B$ can be between 0.65 inches and 0.85 inches. In the present embodiment, the greatest rectangular body dimension 178 can be between 2.10 inches and 2.30 inches. The ratio $W_B/D_B$ can be less than 1.05. The ratio $W_{SF}/W_B$ can be less than 0.75. The distance $D_{BS}$ can be between 2.75 inches and 3.25 inches.

The club head 100 comprises a hosel 130 coupled to the body 101 at a hosel connection point 131. In some embodiments, the hosel connection point 131 is located in a relatively rearward position of the body 101, as illustrated in FIG. 1. Referring to FIG. 2, the club head 100 comprises a distance $D_{H-M}$ rearward from the heel-toe midplane 1020 between 0.45 inch to 0.90 inch. The club head 100 comprises a forward perpendicular distance $D_{H-F}$ from the strike face 102 ranging between 1.5 inch to 1.9 inch. The club head 100 further comprises a rearward perpendicular distance $D_{H-R}$ from the rear end 108 ranging between 0.55 inch to 0.60 inch. The club head 100 further comprises a perpendicular distance $D_{H-H}$ from the heel end 104 ranging between 0.25 inch to 0.55 inch. The rearward hosel 130 location encourages player to impact the golf ball with a positive angle of attack to influence provide topspin to the ball and produce smooth rolling putts.

In some embodiments, the hosel connection point 131 is located in a forward position of the body 101, as illustrated in FIG. 13. Referring to FIG. 14, the club head 100 comprises a distance $D_{H-M}$ forward of the heel-toe midplane 1020 between 0.01 inch to 0.10 inch. The club head 100 comprises a forward perpendicular distance $D_{H-F}$ from the strike face 102 ranging between 1.00 inch to 1.25 inches. The club head 100 further comprises a rearward perpendicular distance $D_{H-R}$ from the rear end 108 ranging between 1.00 inch to 1.25 inches. The club head 100 further comprises a perpendicular distance $D_{H-H}$ from the heel end 104 ranging between 0.25 inch to 0.50 inch. The forward hosel 130 location contributes to the improved forgiveness of the club head 100.

Figure 15:
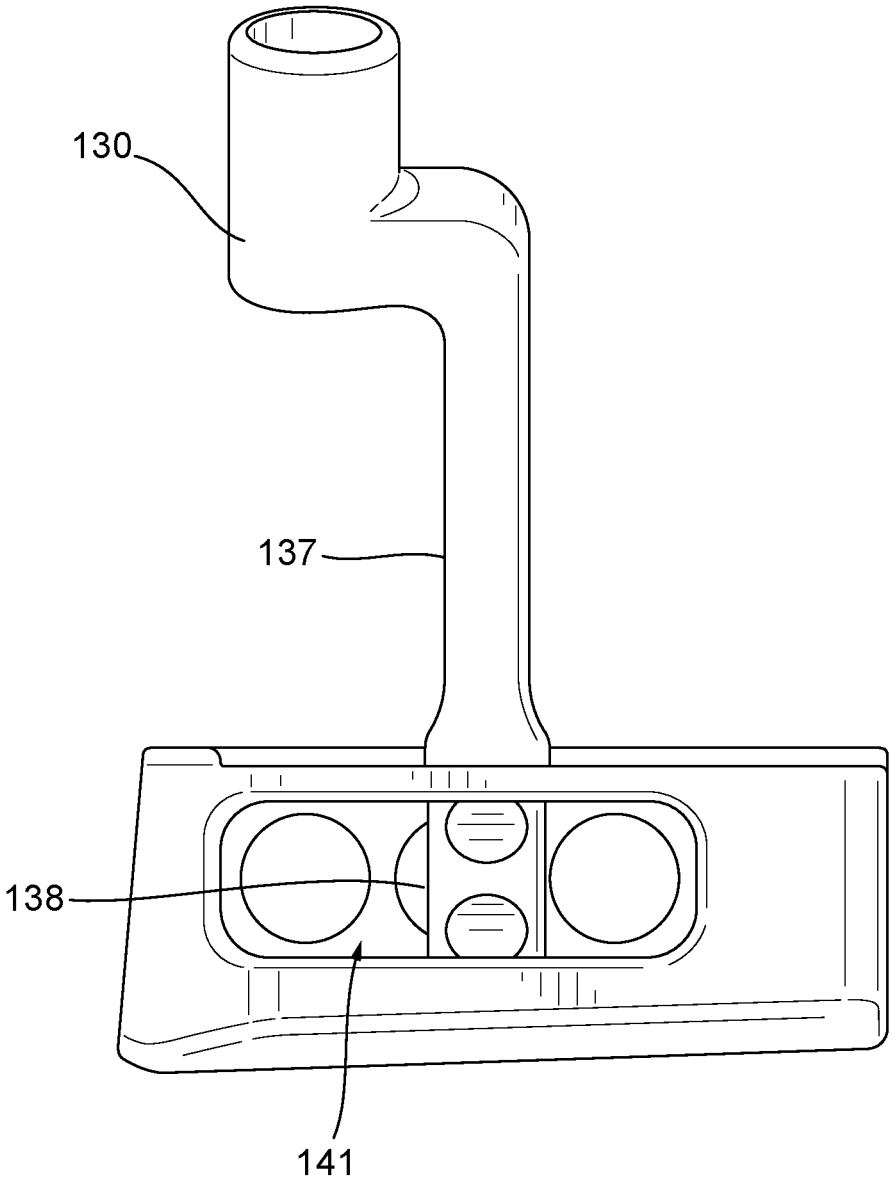
FIG. 15 illustrates a heel side view of the compact putter-type golf club head of FIG. 13.

Alternatively, in other embodiments, the hosel connection point 131 is located near the crown 110, as illustrated in FIG. 1. In other embodiments, the hosel connection point 131 is located within the body 101. Referring to FIG. 15, the hosel 130 can comprise a hosel upper portion 137 located above the body 101, and a hosel lower portion 138 located within the body 101. In such an embodiment, the hosel 130 extends through an upper portion of the body and through the heel-side recess 141. In some embodiments, as illustrated in FIG. 14, the body 101 defines a hosel aperture 139 for receiving the hosel 130. In other embodiments, the club head 100 further comprises a bore (not shown) that extends through the heel-side recess 141. In such an embodiment, the hosel lower portion 138 is received within the bore. The location of the hosel connection point 131 can influence certain characteristics such as the club head CG and MOI.

The club head 100 defines a moment of inertia ($MOI_{xx}$) measured about the X'-axis 1070, a moment of inertia ($MOI_{yy}$) measured about the Y'-axis 1080, and a moment of inertia ($MOI_{zz}$) measured about the Z'-axis 1090. The MOI values $MOI_{xx}$, $MOI_{yy}$, and $MOI_{zz}$ are maximized to maximize the forgiveness of the club head 100 on off-center impacts with a golf ball. The club head 100 comprises an $MOI_{xx}$ between 1000 g·cm$^2$ to 2000 g·cm$^2$. The club head 100 comprises an $MOI_{yy}$ between 2000 g·cm$^2$ to 3000 g·cm$^2$. The club head 100 comprises an $MOI_{xx}$ between 1000 g·cm$^2$ to 2000 g·cm$^2$. The $MOI_{yy}/W_B$ ratio of the club head 100 can be greater than 850. The ratio $MOI_{yy}/A_{SF}$ of the club head 100 can be greater than 1500.

The CG position can be described relative to the primary coordinate system based at the origin point 128. Referring to FIGS. 8-10, the CG position can be located relative to the origin point 128 at a horizontal distance $X_O$ (not pictured) along the X-axis 1040, a height $Y_O$ along the Y-axis 1050, and a depth $Z_O$ along the Z-axis 1060.

The club head 100 comprises a CG position $X_O$ along the X-axis 1040 between 0.01 inch to 0.10 inch toeward of the origin point 128. The club head 100 comprises a CG height $Y_O$ between 0.40 inch to 0.50 inch. The club head 100 comprises a CG depth $Z_O$ between 1.00 inch to 1.25 inches inch. The club head 100 comprises a CG height $Y_{GP}$ between 0.50 inch to 0.60 inch.

The distance $D_{IP}$ of the club head 100 can be between 1.10 inches to 1.20 inches. The distance $X_{IP}$ of the club head 100 can be between 0.01 inch to 0.10 inch. The distance $Y_{IP}$ of the club head 100 can be between 0.01 inch to 0.15 inch.

The shaft axis 1075 of club head 100 can be located rearward of the CG 160. The club head 100 comprises a $D_{S-CG}$ offset distance between the CG 160 and the shaft axis 1075 between 0.01 inch and 0.90 inch.

In some embodiments, the first portion 114 is configured to provide a substantially solid portion of the body 101 directly behind the strike face 102. In some embodiments, the first portion 114 comprises a large concentration of mass, such that a significant portion of the mass of the body 101 is located in the relatively small first portion 114. The larger concentration of mass directly behind the strike face 102 provided by the substantially solid first portion 114 contributes to a desirable, solid feel at impact.

As discussed above, the first portion 114 is defined as the region forward of the transition plane 1035. The first portion 114 defines generally the forwardmost 5% to 25% of the body 101. The first portion 114 comprises a mass in a range of 70 grams to 90 grams. As discussed above, the body 101 has a mass in a range of 300 grams to 375 grams. Therefore, the first portion 114 comprises between 20% to 40% of the mass of the body 101.

The first portion 114 further comprises a volume in a range of 5 cm$^3$ to 15 cm$^3$. As discussed above, the body 101 has a volume in a range of 20 cm$^3$ to 75 cm$^3$. Therefore, the first portion 114 comprises between 20% to 30% of the volume of the body 101.

III. Compact Putter Head with Mass Reducing Features and Weight Inserts

Figure 19:
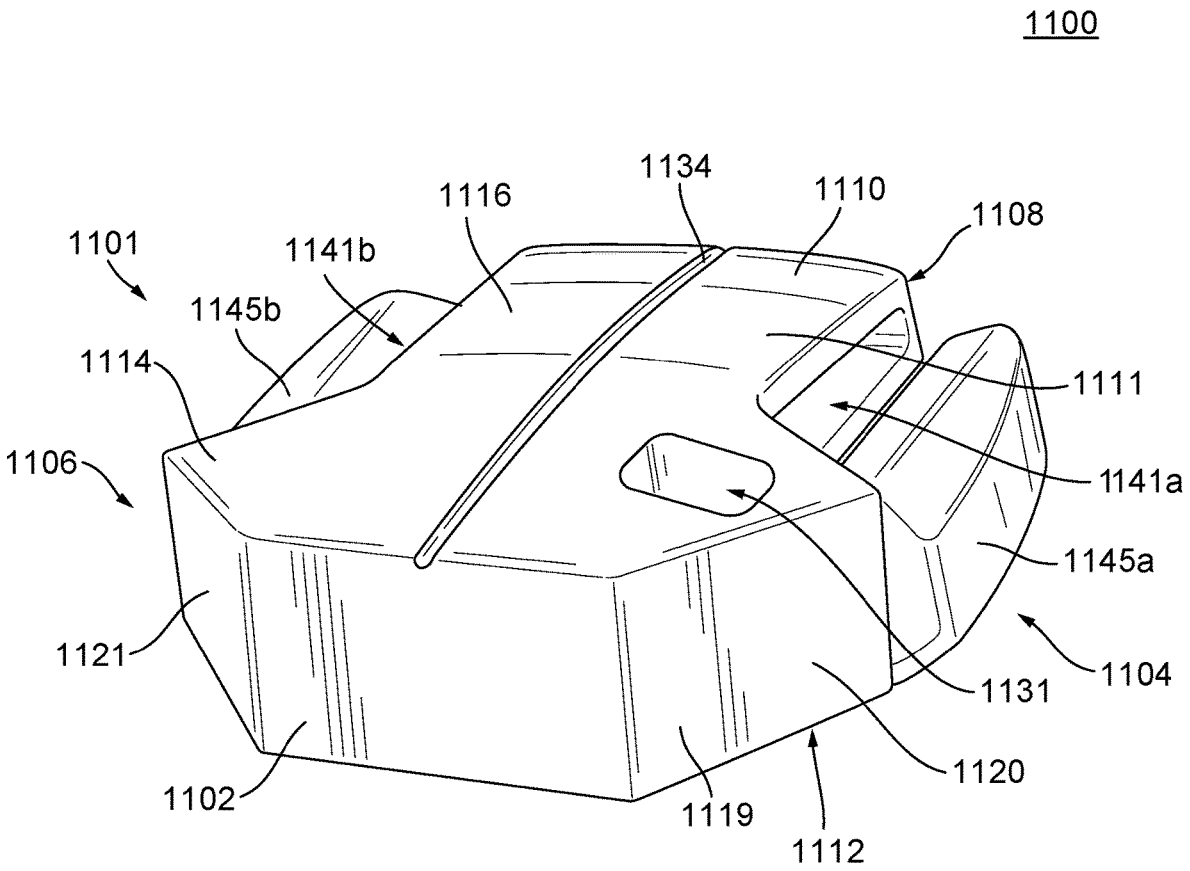
FIG. 19 illustrates a top-perspective view of a compact putter-type golf club head comprising mass reducing features and weight inserts.

FIG. 19 illustrates an embodiment of a compact putter-type club head 1100 comprising a main body 1101 with one or more recesses 1141*a*, 1141*b* and one or more weight inserts 1145*a*, 1145*b* attached to the main body 1101. The compact putter-type club head 1100 comprises similar dimensions and relationships to the putter-type club head 100, as discussed above. Specifically, the putter-type club head 1100 comprises similar dimensions and/or dimensional parameters related to a small strike face, a compact body, the hosel positioning, the shaft axis, the transition region, the center of gravity (CG), and the moment of inertia (MOI). The compact putter-type club head 1100 comprises a high MOI due to a hollowed central portion (created by the recesses 1141*a*, 1141*b*) and dense perimeter weighting.

The main body 1101 can form a central portion of the club head 1100, and the one or more weight inserts 1145*a*, 1145*b* can be located near the perimeter. The main body 1101 can define one or more mass reducing features in the form of one or more recesses, which allow discretionary mass to be reallocated to the one or more weight inserts to improve MOI. The main body 1101 is formed from a first, low-density material and the one or more weight inserts 1145*a*, 1145*b* are formed from a second, high-density material. The putter-type club head 1100 is similar to the putter-type club head 100 and like reference numbers are used to describe the putter-type club head 1100 (for example, the club head 1100 comprises a crown 1110, a sole 1112, a heel end 1104, a toe end 1106, etc.).

The putter-type club head 1100 is divided into a first portion 1114 at the front end of the club head 1100 and a second portion 1116 rearward of the first portion 1114. The first portion 1114 can comprise the strike face 1102 and a transition region 1120. The transition region 1120 connects the strike face 1102 to the second portion 1116. The transition region 1120 can comprise a first transition wall 1119, a second transition wall 1121, and a forward portion of the main body 1101. The second portion 1116 can comprise a rearward portion of the main body 1101 and the one or more weights.

The transition region 1120 provides alignment benefits for the putter-type club head 1100. The transition walls 1119, 1121 are angled with respect to the strike face 1102 such that the width of the club head 1100 increases gradually from the strike face 1102 to the second portion 1116. In some embodiments, the first transition wall 1119 and the second transition wall 1121 can be angled such that they point to the center of a golf ball at address, drawing the user's eye to center of the golf ball. In other embodiments, the first transition wall 1119 and the second transition wall 1121 can converge to a forward-most point of the golf ball at address, drawing the user's eye to the forward-most point of a golf ball. The transition region 1120 of the putter-type club head 1100 can comprise similar dimensions to the transition region 120 of the putter-type club head 100.

The main body 1101 comprises a low-density material (i.e., the first material). The main body 1101 comprises the strike face 1102, the rear end 1108, the crown 1110, and the sole 1112. The strike face 1102 is substantially smaller than the strike face of a typical putter-type golf club head. The small strike face 102 focuses the player on the center of the strike face 1102 by providing a smaller, more precise target location for the player to strike the ball. The main body 1101 further defines a hosel connection point 1131. As discussed above, the putter-type club head 1100 can comprise any of the hosel configurations described herein and further comprises similar dimensions to the hosel 130 of the putter-type club head 100. As described above, the club head 1100 can comprise a substantially forward or rearward hosel connection point 1131. The main body 1101 further comprises a crown bridge 1111 that extends between the strike face 1102 and the rear end 1108 and forms a substantial portion of the crown 1110. The main body 1101 further comprises an upright member (not shown) beneath the crown bridge 1111 that extends in a front-to-rear direction through the main body 1101. The upright member extends generally perpendicular from the crown bridge 1111 and structurally supports the crown bridge 1111 to provide additional structural support to the main body 1101.

To further remove mass from a central portion of the club head 1100, the main body 1101 defines one or more mass reducing features. The embodiment illustrated in FIG. 19 defines a heel-side recess 1141*a*, and a toe-side recess 1141*b*. However, the putter-type club head 1100 can define any suitable number of recesses. The upright member extends in a front-to-rear direction through the main body 1101 and separates or defines the heel-side recess 1141*a* from the toe-side recess 1141*b*. Each recess 1141*a*, 1141*b* is further defined by rear recess wall proximate the rear end 1108 and a front recess wall near the strike face 1102, a recess ceiling near the crown 1110, and a recess floor near the sole 1112. The upright member, the front recess wall, the rear recess wall, the recess ceiling, and the recess floor together define each recess 1141*a*, 1141*b*.

The main body 1101 further defines a rear recess (not shown) that is recessed into the main body 1101 away from the rear end 1108. The rear recess creates a discontinuous surface near the rear end 1108 to conform with USGA standards, which require club heads to have no more than one striking surface. The recesses 1141*a*, 1141*b* of the putter-type club head 1100 can comprise similar dimensions to the side recesses 141, 142, of the putter-type club head 100. The recesses allow weight to be removed from a center portion of the putter-type club head 1100 thereby allowing weight to be reallocated to the perimeter. In many embodiments, the mass removed by the inclusion of the recesses 1141*a*, 1141*b* can be reallocated by increasing the mass of the weights 1145*a*, 1145*b* (discussed in further detail below). Increasing perimeter weighting increases the MOI of the putter-type club head 1100 thereby providing greater forgiveness.

The main body 1101 comprises one or more alignment features 1134 located on the crown 1110. The alignment feature 1134 illustrated in FIG. 19, comprises a single line extending across the crown 1110 from the strike face 1102 to the rear end 1108. However, the alignment feature 1134 can comprise any one or combination of the alignment features disclosed herein. The alignment feature 1134 provides visual feedback as to whether the club head 1100 is properly aligned at address. In addition to the alignment feature 1134, the small strike face 1102 and the compact nature of the main body 1101 itself acts as an aid in alignment by focusing the player on the center of the strike face 1102 and forcing the player to manually align the club head 1100.

The main body 1101 defines a central portion of the putter-type club head 1100 and comprises the alignment feature 1134 and the one or more recesses 1141*a*, 1141*b*. The putter-type club head 1100 further comprises one or more weight inserts 1145*a*, 1145*b* attached to the main body 1101 to increase the perimeter weighting and improve MOI. The embodiment illustrated in FIG. 19 comprises a heel-side weight 1145*a*, and a toe-side weight 1145*b*. The heel-side weight 1145*a* is located near the heel end 1104, and the toe-side weight 1145*b* is located near the toe end 1106. Both the heel-side weight 1145*a* and the toe-side weight 1145*b* extend in a direction away from the ground or upward from the sole 1112.

The weights 1145*a*, 1145*b* are affixed to the main body 1101 such that the main body 1101 is positioned in between the one or more weights 1145*a*, 1145*b*. Further, the recesses 1141*a*, 1141*b* can be positioned between the weights 1145*a*, 1145*b*. Specifically, the toe-side recess 1141*b* can be positioned between the toe-side weight 1145*b* and the upright member, and the heel-side recess 1141*a* can be positioned between the heel-side weight 1145*a* and the upright member.

The recesses 1141*a*, 1141*b* remove weight from the central portion of the main body 1101 to allow the weight to be reallocated to the weights 1145*a*, 1145*b*. The combination of the weight reducing features and perimeter weights increases the MOI of the putter-type club head 1100. Furthermore, the mass of the weights 1145*a*, 1145*b* can be tailored to achieve a desired swing weight or overall putter head mass.

The embodiment illustrated in FIG. 19 comprises a heel-side weight 1145*a* and a toe-side weight 1145*b*. However, the putter-type club head 1100 can comprise any suitable number of weights. In some embodiments, the putter-type club head 1100 can comprise 1 weight, 2 weights, 3 weights, 4 weights, 5 weights, 6 weights, 7 weights, 8 weights, 9 weights, or any suitable number of weights. Each weight can comprise a mass between 2 grams to 7 grams. In some embodiments, the mass of each weight is between 2-5 grams, 3-7 grams or 1-6 grams. In some embodiments, the mass of each weight is approximately 1 gram, 2 grams, 3 grams, 4 grams, 5 grams, 6 grams, or 7 grams. Each weight can have the same mass, or the mass of each weight can vary. The weights can be any one or combination of the following shapes: rectangular, triangular, pyramidal, spherical, semicircular, square, cylindrical, ovular, elliptical, trapezoidal, pentagonal, hexagonal, octagonal, or any other desired geometric or non-geometric shape. The one or more weights 1145*a*, 1145*b* can be affixed to the main body 1101 via any combination of welding, soldering, brazing, swedging, adhesion, epoxy, mechanical fastening, or any other suitable joining method.

The combination of the main body 1101 comprising the low-density first material, and the weights 1145*a*, 1145*b* comprising the high-density second material creates a high MOI putter-type club head 1100. The recesses 1141*a*, 1141*b* remove mass from the central portion of the main body 1101 to allow the mass to be reallocated to the weights 1145*a*, 1145*b*. The toe-side weight 1145*b* and the heel-side weight 1145*a* provide areas of high-density, concentrated mass near the perimeter of the putter-type club head 1100 at a maximum distance away from a center of gravity of the putter-type club head 1300. The putter-type club head 1100 can further be formed from any of the materials previously described herein.

IV. Compact Putter-Type Club Head with Spade-Shaped Body

Figure 20:
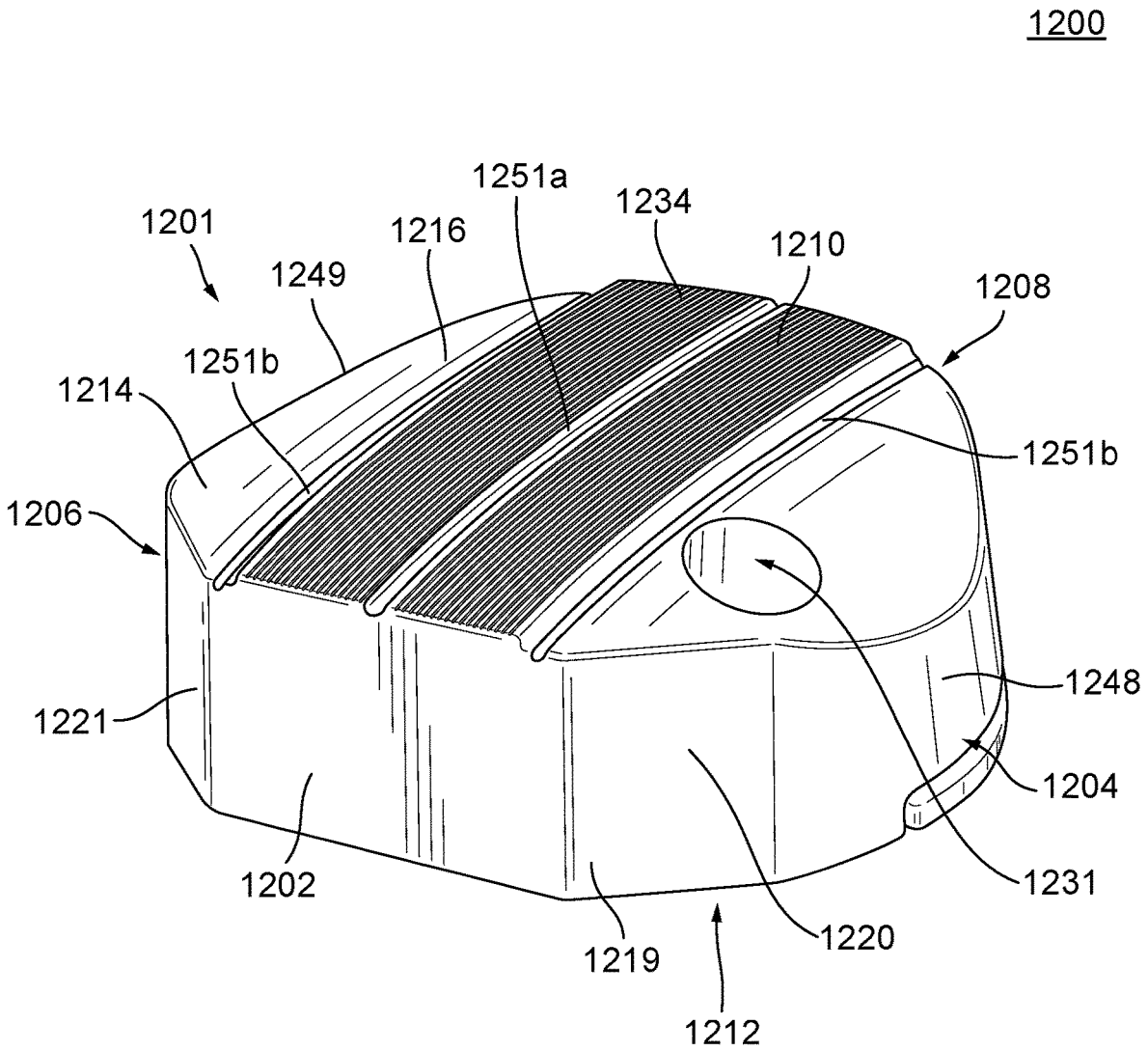
FIG. 20 illustrates a top-perspective view of a compact putter-type golf club head comprising a spade-shaped body, according to a first embodiment.

FIG. 20 illustrates an embodiment of a compact putter-type club head 1200 comprising a spade-shaped body 1201. The putter-type club head 1200 is similar to the putter-type club head 100 and like reference numbers are used to describe the putter-type club head 1200 (for example, the club head 1200 comprises a crown 1210, a sole 1212, a heel end 1204, a toe end 1206, etc.). The spade-shaped compact putter-type club head 1200 comprises similar dimensions and relationships to the club head 100, as discussed above. Specifically, the spade-shaped compact putter-type club head 1200 comprises similar dimensions and/or dimensional relationships related to a small strike face, a compact body, the hosel positioning, the shaft axis, the transition region, the center of gravity (CG), and the moment of inertia (MOI). Providing the club head with a spade-shaped creates a high MOI due to bowed peripheral edges that provide an increased body width near the heel-toe midplane.

The club head 1200 comprises a body 1201 shaped to provide a small strike face 1202 while retaining a relatively high MOI. The club head 1200 is divided into a first portion 1214 at the front end of the club head 1200 and a second portion 1216 rearward of the first portion 1214. The first portion 1214 can comprise the strike face 1202 and a transition region 1220. The transition region 1220 connects the strike face 1202 to the second portion 1216. The transition region 1220 can comprise a first transition wall 1219, a second transition wall 1221, and a forward portion of the body 1201. The second portion 1216 can comprise a rearward portion of the body 1201. The second portion is the portion of the body 1201 rearward of the transition region 1220.

The transition region 1220 provides alignment benefits to the putter-type club head 1200. The transition walls 1219, 1221 are angled with respect to the strike face 1202 such that the width of the club head 1200 increases gradually from the strike face 1202 to the second portion 1216. In some embodiments, the first transition wall 1219 and the second transition wall 1221 can be angled such that they point to the center of a golf ball at address, drawing the user's eye to center of the golf ball. In other embodiments, the first transition wall 1219 and the second transition wall 1221 can converge to a forward-most point of the golf ball at address, drawing the user's eye to the forward-most point of a golf ball. The transition region 1220 of the putter-type club head 1200 can comprise similar dimensions to the transition region 120 of the putter-type club head 100.

The body 1201 comprises the strike face 1202, the rear end 1208, the crown 1210, and the sole 1212. The strike face 1202 is substantially smaller than the strike face of a typical putter-type golf club head. The small strike face 1202 focuses the player on the center of the strike face 1202 by providing a smaller, more precise target location for the player to strike the ball. The body 1201 further defines a hosel connection point 1231. As discussed above, the putter-type club head 1200 can comprise any of the hosel configurations described herein and further comprises similar dimensions to the hosel 130 of the putter-type club head 100. In the illustrated embodiment of FIG. 20, the club head 1200 can comprise a substantially forward or rearward hosel connection point 1231.

As illustrated in FIG. 20, the club head 1200 comprises a heel-side periphery 1248 located at the heel end 1204 and a toe-side periphery 1249 located at the toe end 1206. The heel-side periphery 1248 and toe-side periphery 1249 each extend rearward from the transition region 1220 toward the rear end 1208. The heel-side periphery 1248 and toe-side periphery 1249 define sidewalls of the club head 1200. In many embodiments, the heel-side periphery 1248 and toe-side periphery 1249 follow a curvilinear path around the periphery of the club head 1200. In the illustrated embodiment of FIG. 20, the middle of the heel-side periphery 1248 and toe-side periphery 1249 are bowed outward such that the body width is greater towards the heel-toe midplane than towards the strike face 1202 or toward the rear end 1208. In general, the maximum body width of the club head 1200 is located within the second portion 1216, between the heel-side periphery 1248 and toe-side periphery 1249. The bowed shape of the heel-side periphery 1248 and toe-side periphery 1249 provides the club head 1200 with a greater overall body width while still allowing for a small strike face 1202. The club head 1200 therefore provides both an increased MOI due to the shaping of the club head 1200, as well as the focusing effect associated with the small strike face 1202 (described in detail above).

The crown 1210, in most embodiments, spans the entire width of the putter head 1200 in a heel-to-toe direction from the toe-side periphery 1249 to the heel-side periphery 1248. Furthermore, the crown 1210 can comprise an alignment feature 1234. The alignment feature 1234 illustrated in FIG. 20, comprises a plurality of grooves 1251*a*, 1251*b* extending across the crown 1210 from the strike face 1202 to the rear end 1208. In the illustrated embodiment, the alignment feature 1234 comprises a central groove 1251*a* aligned with the center of the strike face 1202 and two boundary grooves 1251*b* on either side of the alignment feature 1234. In some embodiments, the distance between the boundary grooves 1251*b* can be the same as the width of a golf ball. In other embodiments, the distance between the boundary grooves 1251*b* can be approximately equal to the face width. In other embodiments, the alignment feature 1234 can comprise any one or combination of the alignment features disclosed herein. The alignment feature 1234 provides visual feedback as to whether the club head 1200 is properly aligned at address. In addition to the alignment feature 1234, the small strike face 1202 and the compact nature of the club head 1200 itself acts as an aid in alignment by focusing the player on the center of the strike face 1202 and forcing the player to manually align the club head 1200.

Figure 21:
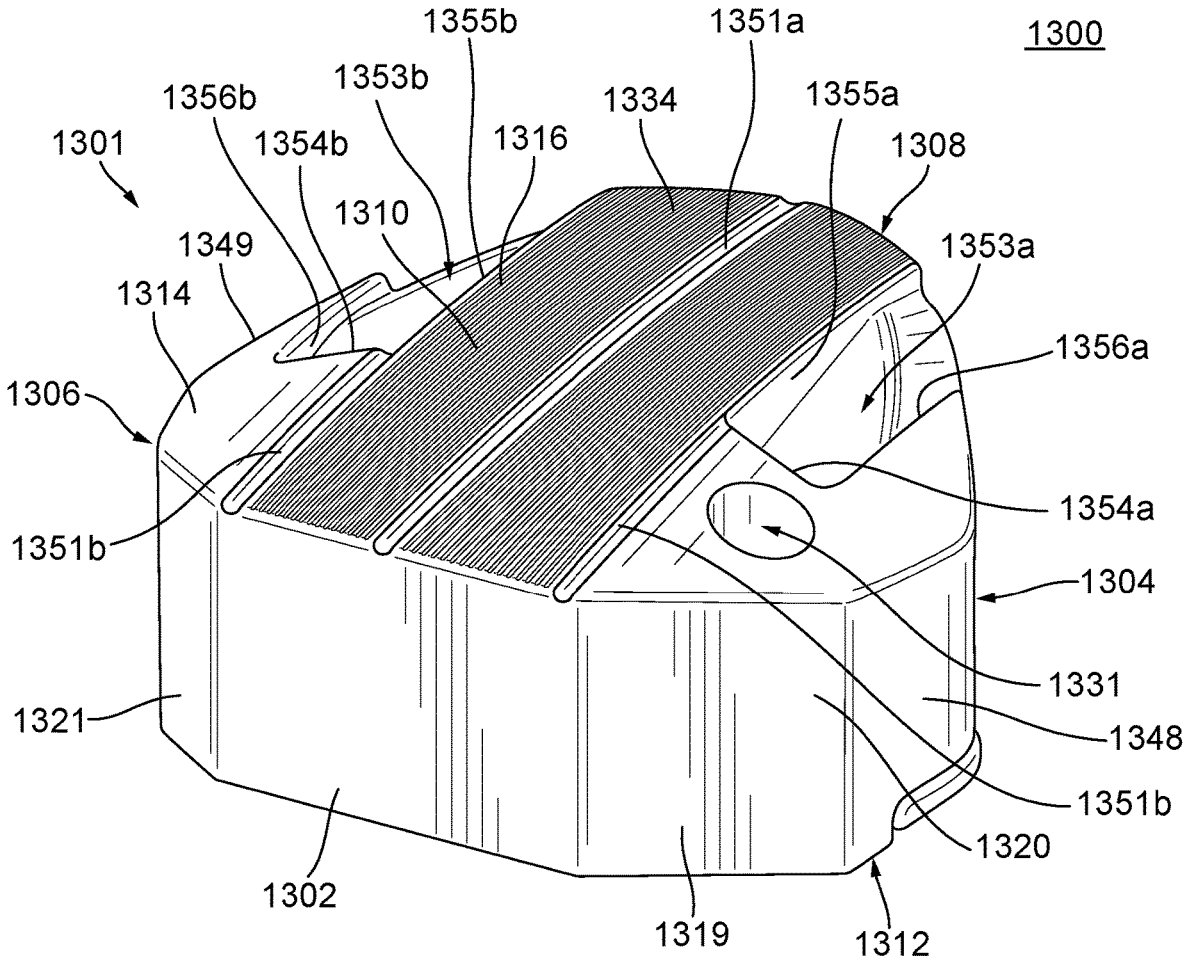
FIG. 21 illustrates a top-perspective view of a compact putter-type golf club head comprising a spade-shaped body, according to a second embodiment.

FIG. 21 illustrates another embodiment of a compact putter-type club head 1300 comprising a spade-shaped body 1301. The putter-type club head 1300 is similar to the putter-type club head 100 and like reference numbers are used to describe the putter-type club head 1300 (for example, the club head 1300 comprises a crown 1310, a sole 1312, a heel end 1304, a toe end 1306, etc.). Club head 1300 is substantially similar to club head 1200, but for differences in the alignment feature 1334. Alignment feature 1334 comprises a central groove 1351*a* extending across the crown 1310 from the strike face 1302 to the rear end 1308. The central groove 1351*a* can be aligned with the center of the strike face 1302. The alignment feature 1334 further comprises two boundary grooves 1351*b* on either side of the alignment feature 1334. The boundary grooves 1351*b* can be substantially similar to boundary grooves 1251*b*, but that the boundary grooves 1351*b* do not extend all the way to the rear end 1308. Instead, the boundary grooves 1351*b* terminate at the forward walls 1354*a*, 1354*b* of the crown recesses 1353*a*, 1353*b* (described in further detail below).

The crown recesses 1353*a*, 1353*b* frame a rearward portion of the alignment feature 1334. The club head 1300 comprises a heel-side crown recess 1353*a* extending in a front-to-rear direction, located between the alignment feature 1334 and the heel-side periphery 1348. The club head 1300 further comprises a toe-side crown recess 1353*b* extending in a front-to-rear direction, located between the alignment feature 1334 and the toe-side periphery 1349. The crown recesses 1353*a*, 1353*b* are sunken into the surface of the crown 1310. Each crown recess 1353*a*, 1353*b* is respectively bounded by a forward wall 1354*a*, 1354*b*, an inner wall 1355*a*, 1355*b* proximate the alignment feature 1334, and a peripheral wall 1356*a*, 1356*b* opposite the inner wall 1355*a*, 1355*b*. In the illustrated embodiment of FIG. 21, the crown recesses 1353*a*, 1353*b* are devoid of a rear wall, such that the crown recesses 1353*a*, 1353*b* are open to the rear end 1308. The inner walls 1355*a*, 1355*b* directly abut and the run alongside a rearward portion of the alignment feature 1334. Further, the inner walls 1355*a*, 1355*b* extend in line with the boundary grooves 1351*b*. The crown recesses 1353*a*, 1353*b* create a stark visual contrast between the crown 1310 and the alignment feature 1334, increasing the focusing effect of the alignment feature 1334. Further, the crown recesses 1353*a*, 1353*b* can act as a pair of mass reducing features, by reducing the mass of the crown 1310 and allowing said mass to be redistributed throughout the club head 1300.

Figure 22:
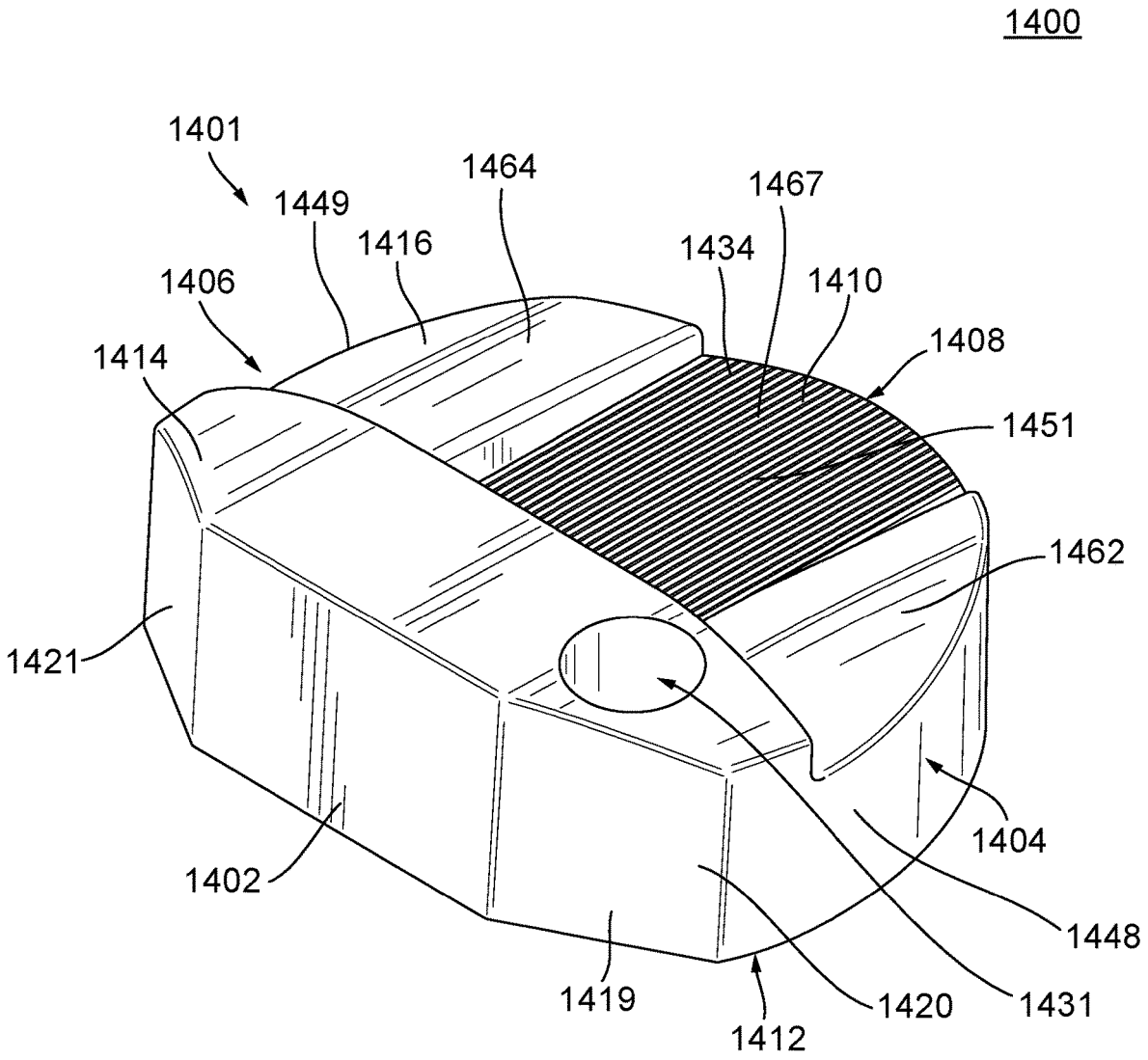
FIG. 22 illustrates a top-perspective view of a compact putter-type golf club head comprising a spade-shaped body, according to a third embodiment.

FIG. 22 illustrates another embodiment of a compact putter-type club head 1400 comprising a spade-shaped body 1401. The putter-type club head 1400 is similar to the putter-type club head 100 and like reference numbers are used to describe the putter-type club head 1400 (for example, the club head 1400 comprises a crown 1410, a sole 1412, a heel end 1404, a toe end 1406, etc.). The putter-type club head 1400 is substantially similar to club heads 1200 and 1300, but for differences in the shaping of the crown 1410 and the alignment feature 1434. The crown 1410 comprises a stepped-down height, such that the crown 1410 is at a maximum height in the first portion 1414 and steps down to a lower height in the second portion 1416.

The second portion 1416 of the putter-type club head 1400 comprises a heel portion 1462, a toe portion 1464, and a central rear platform 1467 disposed between the heel portion 1462 and the toe portion 1464. In the present embodiment, the central rear platform 1467 takes the form of a trough, wherein the central rear platform 1467 is sunken relative to the heel portion 1462 and the toe portion 1464. As such, the heel portion 1462 and the toe portion 1464 can each comprise a greater height than the central rear platform 1467. Providing the central rear platform 1467 in the form of a trough removes mass from the center of the body 1401 (where the central rear platform 1467 is located) and allows said mass to be redistributed to the heel portion 1462 and the toe portion 1464 to increase MOI. The central rear platform 1467 further comprises an alignment feature 1434. Locating the alignment feature 1434 on the central rear platform 1467 provides the alignment feature 1434 at a sunken height relative to the remainder of the body 1401, which provides a stark visual contrast between the alignment feature 1434 and the rest of the body 1401 and increases the focusing effect of the alignment feature 1434. In the present embodiment of FIG. 22, the alignment feature 1434 comprises a plurality of grooves 1451 similar to alignment features 1234 and 1334. It should be noted that in other embodiments, the alignment feature 1434 can comprise any one or combination of the alignment features disclosed herein.

In the embodiment illustrated in FIG. 22, the heel portion 1462 and the toe portion 1464 are formed integrally with the body 1401. In other embodiments, however, the heel portion 1462 and the toe portion 1464 can be formed as (or can include) one or more weight inserts. In such embodiments, the weight inserts can be formed from a second material of a greater density that the body material. In such embodiments, the heel portion 1462 can comprise a heel-side weight and the toe portion 1464 can comprise a toe-side weight. The heel-side weight and the toe-side weight can be included to increase the perimeter weighting and improve MOI.

In embodiments wherein the heel portion 1462 and the toe portion 1464 comprise one or more weight inserts, the putter-type club head 1400 can comprise any suitable number of weights. In some embodiments, the putter-type club head 1400 can comprise 1 weight, 2 weights, 3 weights, 4 weights, 5 weights, 6 weights, 7 weights, 8 weights, 9 weights, or any suitable number of weights. Each weight can comprise a mass between 2 grams to 7 grams. In some embodiments, the mass of each weight is between 2-5 grams, 3-7 grams or 1-6 grams. In some embodiments, the mass of each weight is approximately 1 gram, 2 grams, 3 grams, 4 grams, 5 grams, 6 grams, or 7 grams. Each weight can have the same mass, or the mass of each weight can vary. The weights can be any one or combination of the following shapes: rectangular, triangular, pyramidal, spherical, semicircular, square, cylindrical, ovular, elliptical, trapezoidal, pentagonal, hexagonal, octagonal, or any other desired geometric or non-geometric shape. The one or more weights inserts can be affixed to the body 1401 via any combination of welding, soldering, brazing, swedging, adhesion, epoxy, mechanical fastening, or any other suitable joining method. In some embodiments, the weight inserts can be similar to the weights 1145*a*, 1145*b* of club head 1100.

Figure 23:
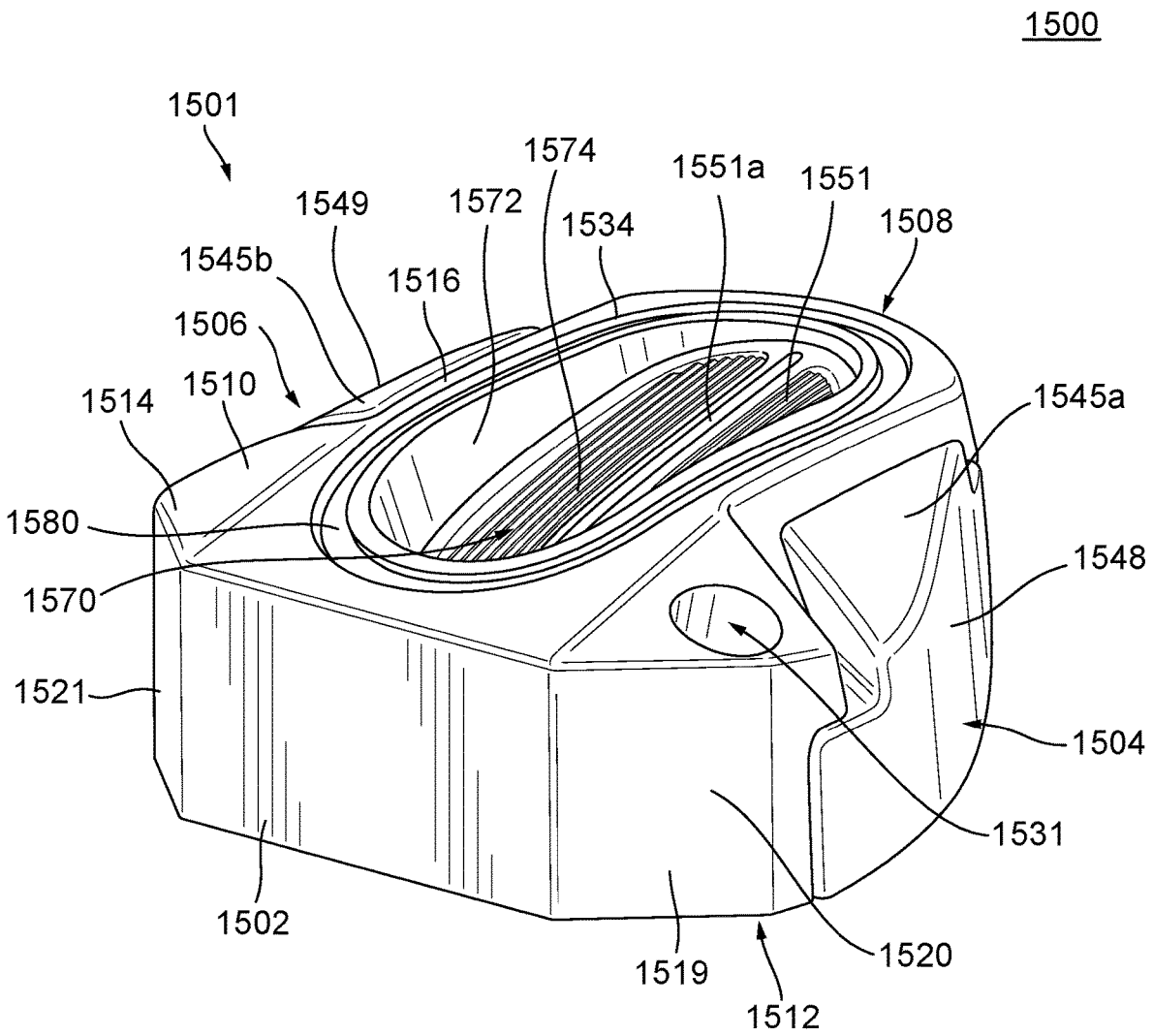
FIG. 23 illustrates a top-perspective view of a compact putter-type golf club head comprising a spade-shaped body, according to a fourth embodiment.

FIG. 23 illustrates another embodiment of a compact putter-type club head 1500 comprising a spade-shaped body 1501. The putter-type club head 1500 is similar to the putter-type club head 100 and like reference numbers are used to describe the putter-type club head 1500 (for example, the club head 1500 comprises a crown 1510, a sole 1512, a heel end 1504, a toe end 1506, etc.). Club head 1500 is substantially similar to club heads 1200 and 1300, and 1400, but for differences in the alignment feature 1534 and the inclusion of a weight inserts 1545*a*, 1545*b* (described in further detail below). In particular, the putter-type club head 1500 includes an alignment feature 1534 having a ball-outlining feature 1580.

The club head 1500 comprises a main body 1501 and one or more weight inserts 1545*a*, 1545*b* attached thereto. The main body 1501 is substantially T-shaped, wherein the first portion 1514 is wider than the second portion 1516. The first portion 1514 extends all the way from the heel end 1504 to the toe end 1506. The second portion 1516 of the main body 1501 extends rearward from the first portion 1514, perpendicular to the strike face 1502. The second portion 1516 is narrower than the first portion 1514, such that the second portion 1516 is inset from the perimeter of the club head 1500 on the heel end 1504 and the toe end 1506. As illustrated in FIG. 23, the heel-side periphery 1548 and the toe-side periphery 1549 are formed by the weight inserts 1545*a*, 1545*b*, rather than by the main body 1501.

As mentioned above, the club head 1500 comprises a heel-side weight 1545*a* and a toe-side weight 1545*b* to increase the perimeter weighting and improve MOI. The weight inserts 1545*a*, 1545*b* are affixed to the main body 1501 such that the main body 1501 (specifically the second portion 1516 of the main body 1501) is positioned in between the one or more weight inserts 1545*a*, 1545*b*. The weight inserts 1545*a*, 1545*b* can be substantially similar to weights 1145*a*, 1145*b* of club head 1100 and/or any other weight inserts described herein.

The main body 1501 comprises one or more alignment features 1534 located on the crown 1510. The alignment feature 1534 illustrated in FIG. 23, comprises a central recess 1570 and a ball-outlining feature 1580. The central recess 1570 removes mass from the crown 1510, thereby allowing mass to be moved toward the perimeter of the club head 1500 and/or into the weights 1545*a*, 1545*b*. The central recess 1570 is located near a middle of the main body 1501. The central recess 1570 is defined by a recess wall 1572 and a recess floor 1574. The recess floor 1574 is recessed into the crown 1510 and the recess wall 1572 circumscribes the recess floor 1574. The recess floor 1574 is parallel to the ground plane to provide a parallel surface to the ground plane for portions of the alignment feature 1534. In many embodiments, such as the embodiment of FIG. 23, the central recess 1570 is ovular or racetrack shaped.

The alignment feature 1534 further comprises a ball-outlining feature 1580. The ball-outlining feature 1580 is formed integrally with the crown 1510 and generally follows the perimeter of the central recess 1570. The ball-outlining feature 1580 is centered on the center of the strike face 1502 and positioned at an offset from the strike face 1502. The ball-outlining feature 1580 is approximately the width of a golf ball to help frame the golf ball. The ball-outlining feature 1580 generally resembles an elongated golf ball to help the viewer visualize the trajectory of the golf ball. In some embodiments, the ball-outlining feature 1580 is recessed into surface of the crown 1510, thereby defining a channel. However, in other embodiments, the ball-outlining feature 1580 can be flush with the crown 1510 or protrude upward from the crown 1510.

The alignment feature 1534 further comprises a plurality of grooves including a central groove 1551*a* bordered on each side by a lateral groove 1551*b*. The plurality of grooves 1551*a*, 1551*b* are located on the recess floor 1574 and extend through the entire length of the central recess 1570. The grooves 1551*a*, 1551*b* extend perpendicularly to the strike face 1502 towards the rear end 1508. The central groove 1551*a* is aligned with the center of the strike face 1502.

The alignment feature 1534 provides multiple benefits to the club head 1500. The shape and size of the central recess 1570 and the ball-outlining feature 1580 help frame the golf ball, and the plurality of grooves 1551*a*, 1551*b* help align the club head 1500 with the intended target line. Each of these features increases the focusing effect of the club head 1500. Further, the central recess 1570 of the alignment feature 1534 removes mass from the crown 1510 to redistribute to the perimeter and increase MOI.

V. Compact Putter-Type Club Head with a Rear Gap

Figure 24:
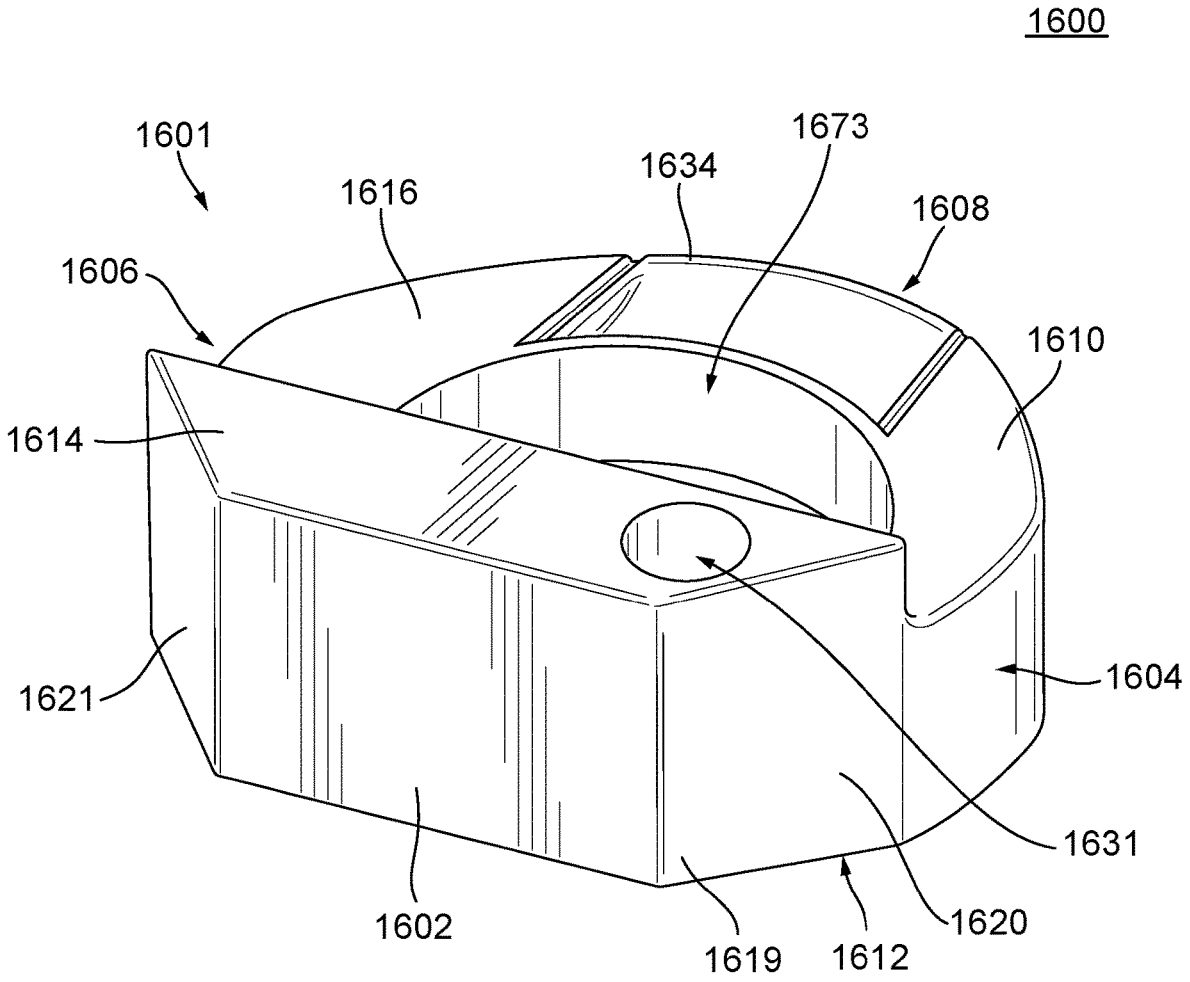
FIG. 24 illustrates a top-perspective view of a compact putter-type golf club head comprising a rear gap, according to a first embodiment.
Figure 25:
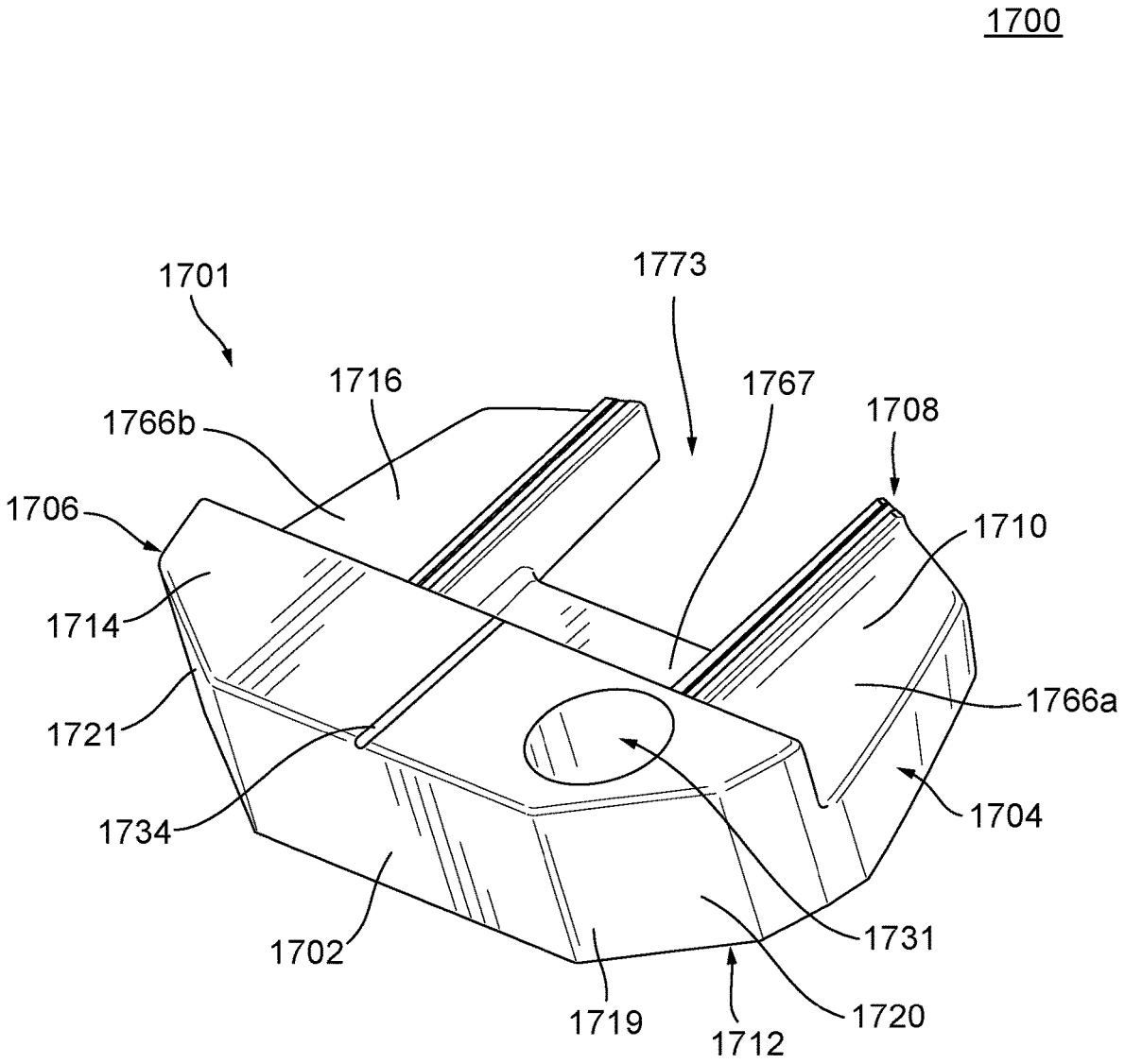
FIG. 25 illustrates a top-perspective view of a compact putter-type golf club head comprising a rear gap, according to a second embodiment.

FIGS. 24 and 25 illustrate various embodiments of a compact putter-type club head comprising a rear gap. The compact putter-type club heads with a rear gap comprise similar dimensions and relationships to the putter-type club head 100, as discussed above. Specifically, the compact putter-type club heads illustrated in FIGS. 24 and 25 comprises similar dimensions and/or dimensional relationships related to a small strike face, a compact body, the hosel positioning, the shaft axis, the transition region, the center of gravity (CG), and the moment of inertia (MOI). The rear gap creates a ball retrieval feature to easily allow the user to retrieve their ball. Further, the rear gap removes mass from a central portion of the body and reallocates the mass towards the perimeter to increase the MOI.

The compact putter-type club heads illustrated in FIGS. 24 and 25 each comprise a gap defined in a rearward portion of the body. FIG. 24 illustrates an embodiment of a compact putter-type club head 1600 comprising an enclosed, circularly-shaped rear gap 1673, and FIG. 25 illustrates an embodiment of a compact putter-type club head 1700 comprising a gap 1773 open toward a rear end of the body. The rear gap can allow weight to be reallocated to the perimeter or the extremities of the club head. Increasing perimeter weighting increases the MOI of the putter-type club head thereby providing greater forgiveness. The rear gap can further provide a ball-retrieval feature. The putter-type club heads 1600, 1700 comprising a rear gap are similar to the putter-type club head 100 and like reference numbers are used to describe the putter-type club heads 1600, 1700 (for example, the club head 1600 comprises a crown 1610, a sole 1612, a heel end 1604, a toe end 1606, etc.).

The putter-type club head 1600 is divided into a first portion 1614 at the front end of the club head 1600 and a second portion 1616 rearward of the first portion 1614. The first portion 1614 can comprise the strike face 1602 and a transition region 1620. The transition region 1620 connects the strike face 1802 to the second portion 1616. The transition region 1620 can comprise the strike face 1602, a first transition wall 1619, a second transition wall 1621, and a forward portion of the body 1601. The second portion 1616 can comprise a rearward portion of the body 1601. The crown 1610 comprises a stepped-down height, such that the crown 1610 is at a maximum height in the first portion 1614 and steps down to a lower height in the second portion 1616.

The body 1601 comprises the strike face 1602, the rear end 1608, the crown 1610, and the sole 1612. The strike face 1602 is substantially smaller than the strike face of a typical putter-type golf club head. The small strike face 1602 focuses the player on the center of the strike face 1602 by providing a smaller, more precise target location for the player to strike the ball. The body 1601 further defines a hosel connection point 1631. As discussed above, the putter-type club head 1600 can comprise any of the hosel configurations described herein and further comprises similar dimensions to the hosel 130 of the putter-type club head 100. As described above, the club head 1600 can comprise a substantially forward or rearward hosel connection point 1631.

Referring to FIG. 24, the second portion 1616 comprises the rearward portion of the body 1601 and is positioned at a lower height than the first portion 1614. The second portion 1616 is generally semi-circle shaped. The second portion 1616 comprises a rearward portion of the crown 1610. In the illustrated embodiment, the crown 1610 comprises a convex surface relative to the ground plane. In other embodiments, the crown 1610 can comprise a flat surface, or a concave surface relative to the ground plane.

The second portion 1616 defines a rear gap 1673 extending through the body 1601 from the crown 1610 to the sole 1612. In other words, the rear gap 1673 forms a void in the central portion of the body 1601. In many embodiments, the rear gap 1673 comprises a diameter that generally corresponds to the width of a golf ball (approximately 4.27 cm). In many embodiments, the rear gap 1673 comprises a diameter that is slightly smaller than the diameter of a golf ball to allow the rear gap 1673 to retain the golf ball. In these embodiments, the rear gap 1673 provides a ball retrieval feature. In other embodiments, the rear gap 1673 can comprise a diameter that is larger or smaller than the width of a golf ball. The rear gap 1673 removes mass from near the center of the body 1601, allowing mass to be allocated towards the periphery of the club head 1600 to increase the club head moment of inertia (MOI). The rear gap 1673 can further provide a ball-retrieval feature.

The second portion 1616 of the club head 1600 further comprises an alignment feature 1634 disposed on the crown 1610. In the embodiment illustrated in FIG. 24, the alignment feature 1634 comprises a plurality of grooves. It should be noted that, in other embodiments, the alignment feature 1634 can comprise any one or combination of the alignment features disclosed herein.

FIG. 25 illustrates another embodiment of a compact putter-type golf club head 1700 comprising a rear gap 1773. Club head 1700 is substantially similar to club head 1600, in that the crown 1710 comprises a stepped-down height, such that the crown 1710 is at a maximum height in the first portion 1714 and steps down to a lower height in the second portion 1716. The body 1701, however, comprises a rear gap 1773 formed between a heel-side wing 1766*a* and a toe-side wing 1766*b*. A central rear platform 1767 is defined between the heel-side wing 1766*a* and the toe-side wing 1766*b*. Therefore, the rear gap 1773 is an open-ended gap, in comparison to the rear gap 1673, which is enclosed within the second portion 1616 of the club head 1600.

The heel-side wing 1766*a* extends rearward from the first portion 1714 near the heel end 1704, and the toe-side wing 1766*b* extends rearward from the first portion 1714 near the toe end 1706. In most embodiments, the wings 1766*a*, 1766*b* extend perpendicularly from the first portion 1714, such that a right angle (90° angle) is formed at the junction of the wings 1766*a*, 1766*b* and the first portion 1714. However, in other embodiments, the wings 1766*a*, 1766*b* can extend from the first portion 1714 in any direction, such that any angle (0°-180°) can be formed at the junction of the wings 1766*a*, 1766*b* and the first portion 1714. In some embodiments, the heel-side wing 1766*a* and the toe-side wing 1766*b* can be parallel with one another, while in some embodiments, the heel-side wing 1766*a* and the toe-side wing 1766*b* are not parallel.

As discussed above, the rear gap 1773 can remove mass from a central portion of the golf club head 1700, allowing the mass to be allocated to the perimeter to improve MOI. Further, the rear gap 1773 can provide a ball-retrieval feature. The rear gap 1773 is defined rearward of the central rear platform 1767 between the heel-side wing 1766*a* and the toe-side wing 1766*b*. The rear gap 1773 forms a void in the body 1701 near the rear end 1708. In many embodiments, the rear gap 1773 comprises a diameter that generally corresponds to the width of a golf ball (approximately 4.27 cm). In many embodiments, the rear gap 1773 comprises a diameter that is slightly smaller than the diameter of a golf ball to allow the rear gap 1773 to retain the golf ball. In these embodiments, the rear gap 1773 provides a ball retrieval feature. In other embodiments, the rear gap 1773 can comprise a diameter that is larger or smaller than the width of a golf ball. In the illustrated embodiment of FIG. 25, the rear gap 1773 comprises a generally rectangular shape. In other embodiments, the rear gap 1773 can be circular, curvilinear, triangular, trapezoidal, parabolic, golf ball shaped, square, or any other desired geometric shape.

Furthermore, the crown 1710 comprises an alignment feature 1734 that differs from the alignment feature of the club head 1600. The alignment feature 1734 includes a central line positioned on the first portion, and a plurality of peripheral lines positioned on the second portion 1716. In other embodiments, the alignment feature 1734 can comprise any one or combination of the alignment features disclosed herein.

VI. Compact Putter-Type Club Head with Extrusions

Figure 26:
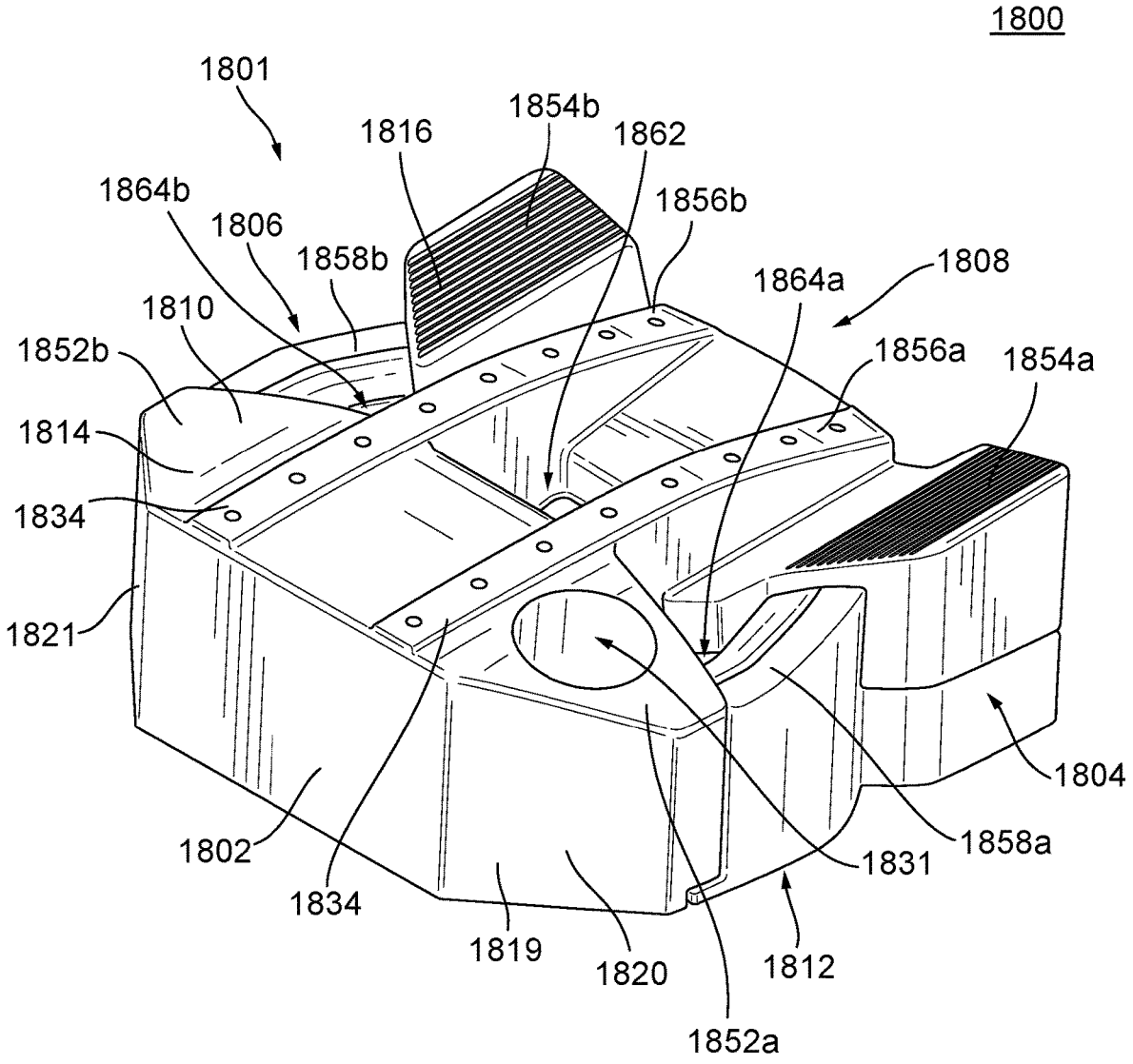
FIG. 26 illustrates a top-perspective view of a compact putter-type golf club head comprising extrusions, according to a first embodiment.
Figure 27:
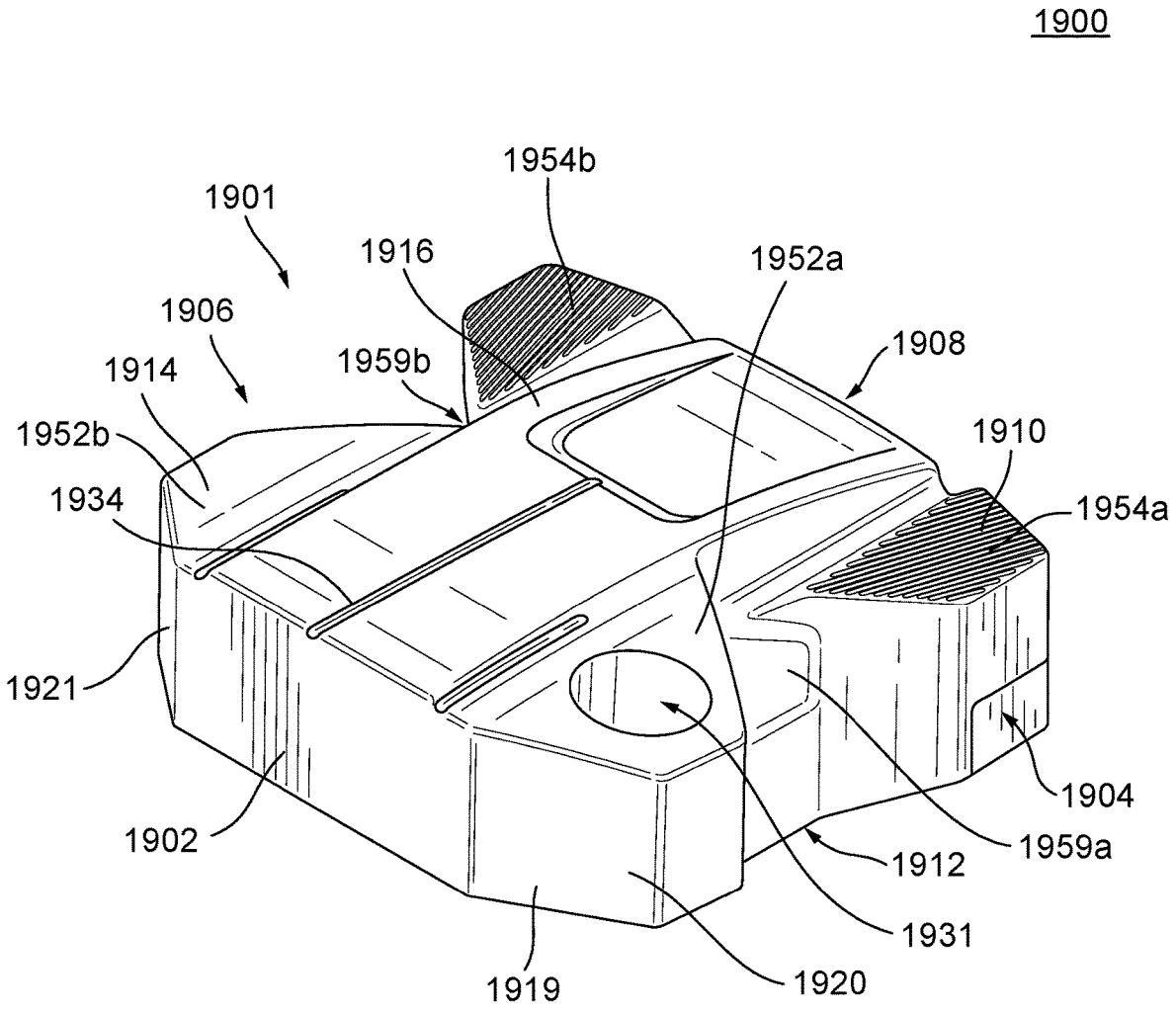
FIG. 27 illustrates a top-perspective view of a compact putter-type golf club head comprising extrusions, according to a second embodiment.
Figure 28:
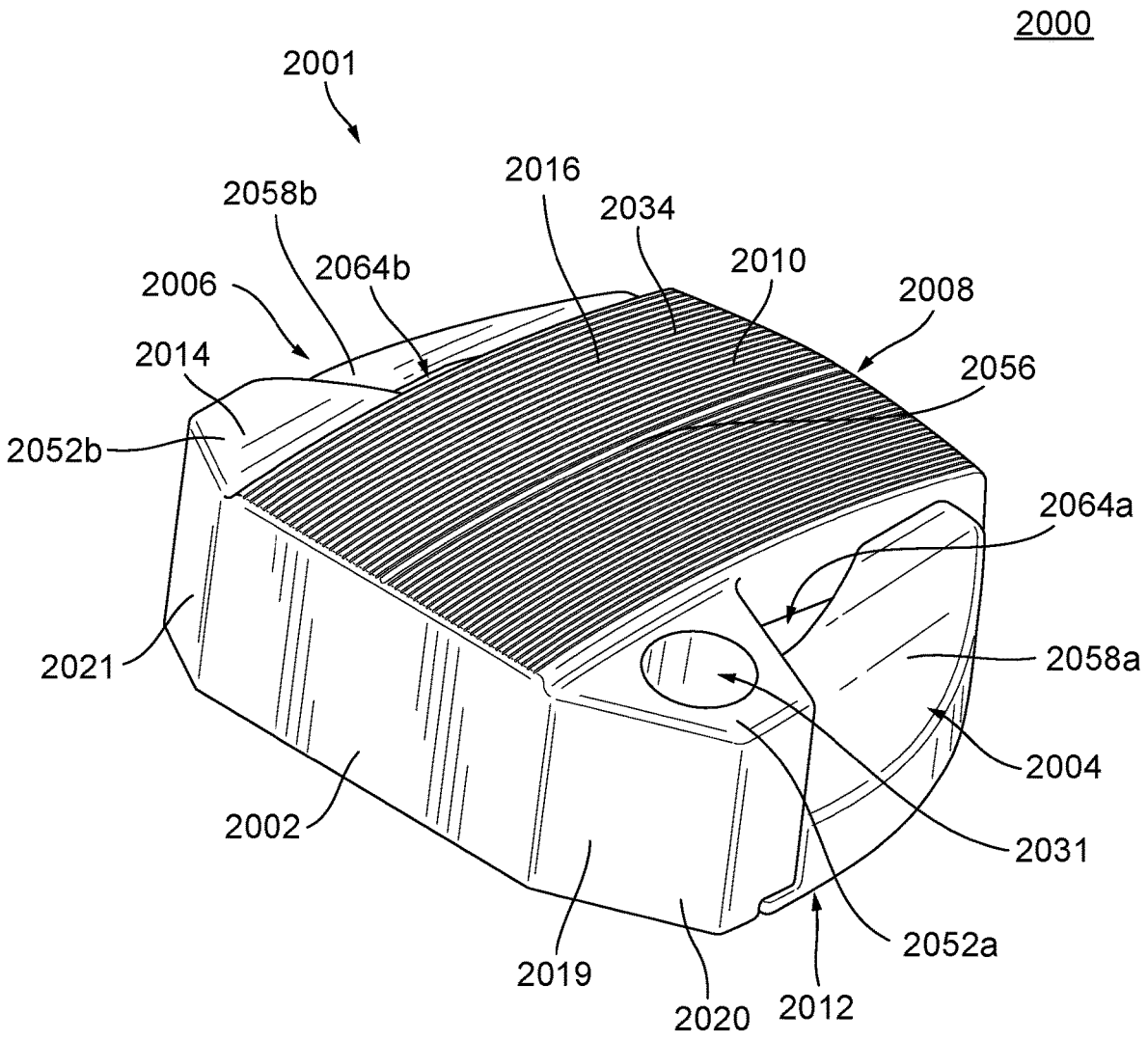
FIG. 28 illustrates a top-perspective view of a compact putter-type golf club head comprising extrusions, according to a third embodiment.
Figure 29:
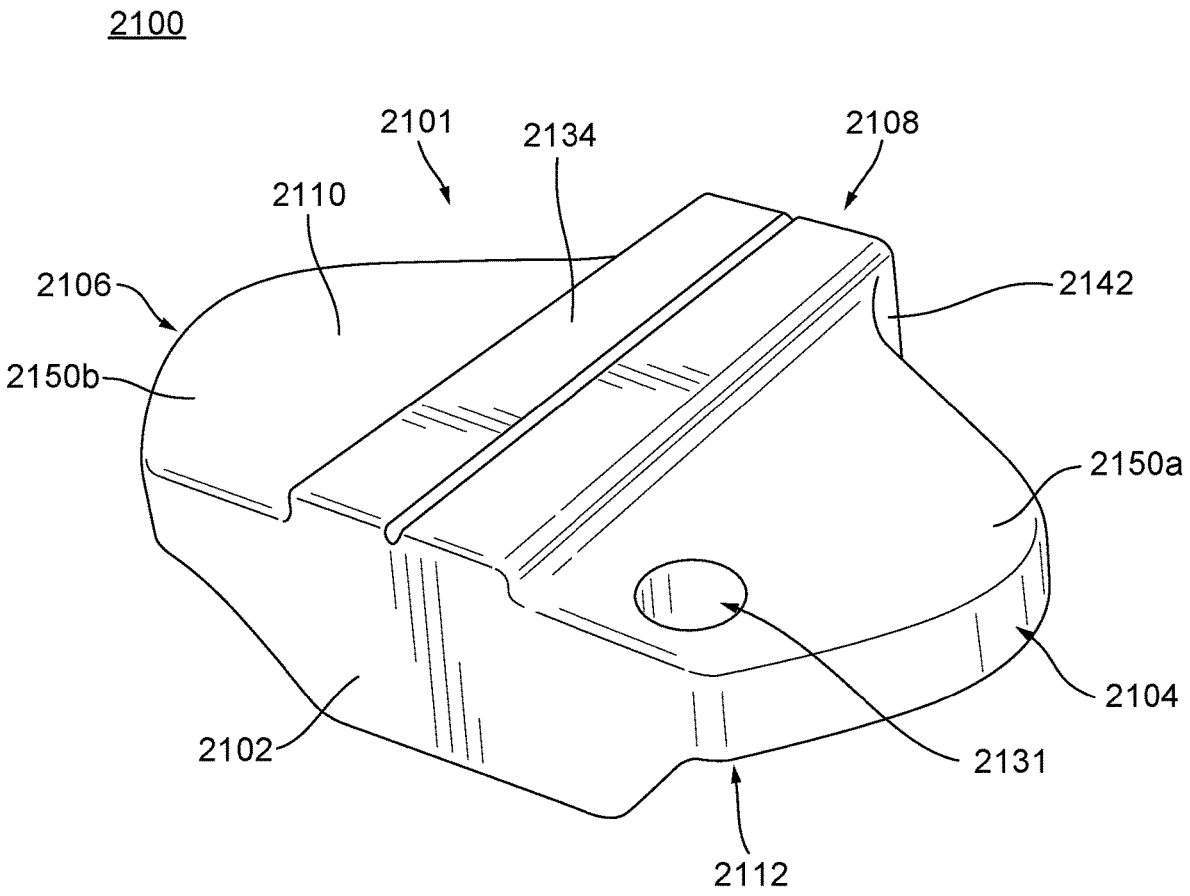
FIG. 29 illustrates a top-perspective view of a compact putter-type golf club head comprising heel and toe wings.

FIGS. 26-28 illustrate various embodiments of a compact putter-type club head comprising extrusions. FIGS. 26 and 27 illustrate various embodiments of a compact putter-type club head comprising forward and rearward extrusions, and FIG. 28 illustrates an embodiment of a compact putter-type club head comprising only forward extrusions. The compact putter-type club heads with extrusions comprise similar dimensions and relationships to the putter-type club head 100, as discussed above. Specifically, the compact putter-type club heads illustrated in FIGS. 26-28 comprises similar dimensions and/or dimensional relationships related to a small strike face, a compact body, the hosel positioning, the shaft axis, the transition region, the center of gravity (CG), and the moment of inertia (MOI). The extrusions concentrate mass near the front and/or rear on the heel end and the toe end. The extrusions thereby provide a high amount of perimeter weighting to increase MOI.

The compact putter-type club heads illustrated in FIGS. 26 and 27 each comprise an hourglass-shaped body. The hourglass shape is defined by extruded forward and rearward sections that create a narrower midsection of the body. The compact putter-type club heads illustrated in FIG. 28 comprises a T-shaped body defined by extruded forward sections. The extruded sections allow weight to be reallocated to the perimeter or the extremities of the club head. Increasing perimeter weighting increases the MOI of the putter-type club head thereby providing greater forgiveness. The putter-type club heads 1800, 1900, 2000 comprising extruded sections are similar to the putter-type club head 100 and like reference numbers are used to describe the putter-type club heads 1800, 1900, 2000 (for example, the club head 1800 comprises a crown 1810, a sole 1812, a heel end 1804, a toe end 1806, etc.).

The putter-type club head 1800 is divided into a first portion 1814 at the front end of the club head 1800 and a second portion 1816 rearward of the first portion 1814. The first portion 1814 can comprise the strike face 1802, a transition region 1820, and the forward extrusions 1852*a*, 1852*b*. The transition region 1820 connects the strike face 1802 to the second portion 1816. The transition region can comprise the strike face 1802, a first transition wall 1819, a second transition wall 1821, and a forward portion of the body 1801. The second portion 1816 can comprise a rearward portion of the body 1801 and the rearward extrusions 1854*a*, 1854*b*.

The transition region 1820 provides an alignment feature to the putter-type club head 1800. The transition walls 1819, 1821 are angled with respect to the strike face 1802 such that the width of the club head 1800 increases gradually from the strike face 1802 to the second portion 1816. In some embodiments, the first transition wall 1819 and the second transition wall 1821 can be angled such that they point to the center of a golf ball at address, drawing the user's eye to center of the golf ball. In other embodiments, the first transition wall 1819 and the second transition wall 1821 can converge to a forward-most point of the golf ball at address, drawing the user's eye to the forward-most point of a golf ball. The transition region 1820 of the putter-type club head 1800 can comprise similar dimensions to the transition region 120 of the putter-type club head 100.

The body 1801 comprises the strike face 1802, the rear end 1808, the crown 1810, and the sole 1812. The strike face 1802 is substantially smaller than the strike face of a typical putter-type golf club head. The small strike face 1802 focuses the player on the center of the strike face 1802 by providing a smaller, more precise target location for the player to strike the ball. The body 1801 further defines a hosel connection point 1831. As discussed above, the putter-type club head 1800 can comprise any of the hosel configurations described herein and further comprises similar dimensions to the hosel 130 of the putter-type club head 100. As described above, the club head 1800 can comprise a substantially forward or rearward hosel connection point 1831.

Referring to FIG. 26, the body 1801 comprises a forward heel-side extrusion 1852*a*, a forward toe-side extrusion 1852*b*, a rearward heel-side extrusion 1854*a*, and a rearward toe-side extrusion 1854*b*. The extrusions 1852*a*, 1852*b*, 1854*a*, 1854*b* are positioned near the perimeter of the body 1801. The extrusions 1852*a*, 1852*b*, 1854*a*, 1854*b* increase perimeter weighting, increasing the MOI of the putter-type club head thereby providing greater forgiveness.

The body 1801 further comprises side rails 1858*a*, 1858*b* extending from a forward portion to a rearward portion of the body 1801 and forming a portion of the crown 1810. More specifically, the heel-side rail 1858*a* extends from the forward heel-side extrusion 1852*a* toward the rearward heel-side extrusion 1854*a*, and the toe-side rail 1858*b* extends from the forward toe-side extrusion 1852*b* toward the rearward toe-side extrusion 1854*b*. The side rails 1858*a*, 1858*b* each form a portion of the crown 1810 and the sole 1812. Further, the side rails 1858*a*, 1858*b* form a portion of the heel end 1804 and the toe end 1806, respectively.

The body 1801 further comprises crown bridges 1856*a*, 1856*b* extending from the strikeface 1802 to the rear end 1808 and forming a portion of the crown 1810. The crown bridges 1856*a*, 1856*b* are positioned in a generally central portion of the body 1801 (i.e., away from the heel end 1804 and the toe end 1806). However, the heel-side crown bridge 1856*a* is positioned slightly closer to the heel end 1804, and the toe-side crown bridge 1856*b* is positioned slightly closer to the toe end 1806.

In some embodiments, the crown bridges 1856*a*, 1856*b* descend from the strike face 1802 to the rear end 1808 (i.e., decrease in height toward the rear end 1808). In some embodiments, the crown bridges 1856*a*, 1856*b* can be substantially flat from the strike face 1802 to the rear end 1808 or ascend from the from the strike face 1802 to the rear end 1808. In most embodiments, the ascent or descent of the crown bridges 1856*a*, 1856*b* can be linear, curvilinear, parabolic, sinusoidal, or a function of polynomial. In many embodiments, the heel-side crown bridge 1856*a* and the toe-side crown bridge 1856*b* are generally parallel to one another and perpendicular to the strike face 1802. However, in some embodiments, the heel-side crown bridge 1856*a* and the toe-side crown bridge 1856*b* are not parallel to one another and/or not perpendicular to the strike face 1802.

To remove mass from a central portion of the club head 1800, the body 1801 defines one or more mass reducing features. Each of the mass reducing features is defined by one or more of the forward extrusions 1852*a*, 1852*b*, the rearward extrusions 1854*a*, 1854*b*, the crown bridges 1856*a*, 1856*b*, and the side rails 1858*a*, 1858*b*. A central aperture 1862 is defined rearward of the first portion 1814 between the heel-side crown bridge 1856*a* and the toe-side crown bridge 1856*b*. The body further defines side apertures 1864*a*, 1864*b*. The heel-side aperture 1864*a* is defined rearward of the forward heel-side extrusion 1852*a* between the heel-side crown bridge 1856*a* and the heel-side rail 1858*a*. The toe-side aperture 1864*b* is defined rearward of the forward toe-side extrusion 1852*b* between the toe-side crown bridge 1856*b* and the toe-side rail 1858*b*.

The apertures 1862, 1864*a*, 1864*b* each extend through the body 1801 from the crown 1810 to the sole 1812. In other words, the central aperture 1862 forms a void in the central portion of the body 1801, and the side apertures 1864*a*, 1864*b* form voids in the body 1801 near the heel end 1804 and the toe end 1806, respectively. The apertures 1862, 1864*a*, 1864*b* can be any one of the following shapes: rectangular, triangular, semi-circular, circular, circular, circular, square, ovular, elliptical, trapezoidal, pentagonal, hexagonal, octagonal, or any other desired geometric or non-geometric shape. The apertures 1862, 1864*a*, 1864*b* shift a majority of the volume and mass of the body 1801 to the extremities.

The body 1801 further defines a rear recess (not shown) that is recessed into the body 1801 away from the rear end 1808. The rear recess creates a discontinuous surface near the rear end 1808 to conform with USGA standards, which require club heads to have no more than one striking surface. The rear recess of the putter-type club head 1800 can comprise similar dimensions to the rear recess 144 of the putter-type club head 100. The rear recess, in addition to the apertures 1862, 1864*a*, 1864*b*, allow weight to be reallocated to the perimeter. Increasing perimeter weighting increases the MOI of the putter-type club head 1800, thereby providing greater forgiveness.

The body 1801 further comprises one or more alignment features 1834 located on the crown 1810. The alignment feature illustrated in FIG. 26, comprises one or more indicia positioned on the crown bridges 1856*a*, 1856*b* extending across the crown 1810 from the strike face 1802 to the rear end 1808. However, the alignment feature can comprise any one or combination of the alignment features disclosed herein. The alignment feature provides visual feedback as to whether the club head 1800 is properly aligned at address. In addition to the alignment feature, the small strike face 1802 and the compact nature of the putter-type club head 1800 itself acts as an aid in alignment by focusing the player on the center of the strike face 1802 and forcing the player to manually align the club head 1800.

FIG. 27 illustrates another embodiment of a compact putter-type club head 1900 comprising an hourglass-shaped body 1901. Club head 1900 is substantially similar to club head 1800, in that club head 1900 comprises forward extrusions 1952*a*, 1952*b* and rearward extrusions 1954*a*, 1954*b*. Club head 1900, however, comprises a solid body 1901 devoid of any crown bridges, side rails, and apertures. Instead, the body 1901 comprises a solid crown 1910 that extends from the strike face 1902 toward the rear end 1908. Further, the body comprises side bridges 1959*a*, 1959*b* that extend between the forward extrusions 1952*a*, 1952*b* and the rearward extrusions 1954*a*, 1954*b*. The crown 1910 and the side bridges 1959*a*, 1959*b* are devoid of any apertures.

The body 1901 further defines a rear recess (not shown) that is recessed into the body 1901 away from the rear end

1908. The rear recess creates a discontinuous surface near the rear end 1908 to conform with USGA standards, which require club heads to have no more than one striking surface. The rear recess and the extrusions 1952*a*, 1952*b*, 1954*a*, 1954*b* increase perimeter weighting, increasing the MOI of the putter-type club head thereby providing greater forgiveness. Furthermore, the crown 1910 comprises an alignment feature 1934 that differs from the alignment feature of the club head 1800. The alignment feature 1934 includes a central line and two peripheral lines. In other embodiments, the alignment feature 1934 can comprise any one or combination of the alignment features disclosed herein.

FIG. 28 illustrates another embodiment of a compact putter-type club head 2000 comprising extrusions. Club head 2000 is substantially similar to club head 1800, in that club head 2000 comprises forward extrusions 2052*a*, 2052*b* and side rails 2058*a*, 2058*b*. The body 2001 also similarly defines side apertures 2064*a*, 2064*b* rearward of the forward extrusions 2052*a*, 2052*b*. The body 2001, however, includes only a single crown bridge 2056 extending between the strike face 2002 and the rear end 2008. Therefore, the club head 2000 differs from the club head 1800 in that club head 2000 is devoid of a central aperture. The front portion 2014 and the crown bridge 2056 form a T-shaped portion of the body 2001. The club head 2000 further differs from the club head 1800 in that club head 2000 does not include rearward extrusions. Instead, the side rails 2058*a*, 2058*b* extend rearward from the forward extrusions 2052*a*, 2052*b* and connect to the crown bridge 2056 near the rear end 2008.

The body 2001 further defines a rear recess (not shown) that is recessed into the body 2001 away from the rear end 2008. The rear recess creates a discontinuous surface near the rear end 2008 to conform with USGA standards, which require club heads to have no more than one striking surface. The rear recess, the forward extrusions 2052*a*, 2052*b*, and the side rails 2058*a*, 2058*b* increase perimeter weighting, increasing the MOI of the putter-type club head thereby providing greater forgiveness. Furthermore, the crown 2010 comprises an alignment feature 2034 that differs from the alignment feature of the club head 1800. The alignment feature 2034 includes a central line and a plurality of peripheral lines. In other embodiments, the alignment feature 2034 can comprise any one or combination of the alignment features disclosed herein.

VII. Compact Putter-Type Club Head with Heel and Toe Wings

FIGS. 29-34 illustrate an embodiment of a compact putter-type club head 2100 comprising a plurality of wings 2150*a*, 2150*b* and a sole 2112 configured to glide through the rough with minimal resistance. The putter-type club head 2100 is similar to the putter-type club head 100 and like reference numbers are used to describe the putter-type club head 2100 (for example, the club head 2100 comprises a crown 2110, a sole 2112, a heel end 2104, a toe end 2106, etc.). The compact putter-type club head 2100 comprises similar dimensions and relationships to the putter-type club head 100, as discussed above. Specifically, the putter-type club head 2100 can comprises similar dimensions and/or dimensional relationships related to a small strike face, a compact body, the hosel positioning, the shaft axis, the transition region, the center of gravity (CG), and the moment of inertia (MOI).

The club head 2100 provides a focusing effect similar to that of previous embodiments described herein. The club head 2100 comprises a small strike face 2102 and body profile that focuses the player on making a good putting stroke. In comparison to the previously discussed embodiments, the club head 2100 does not comprise transition walls to align to help focus the player on the center of the strike face. Instead, the crown 2110 comprises a prominent, elongate alignment feature 2134 that focuses the player on the intended start line.

Figure 30:
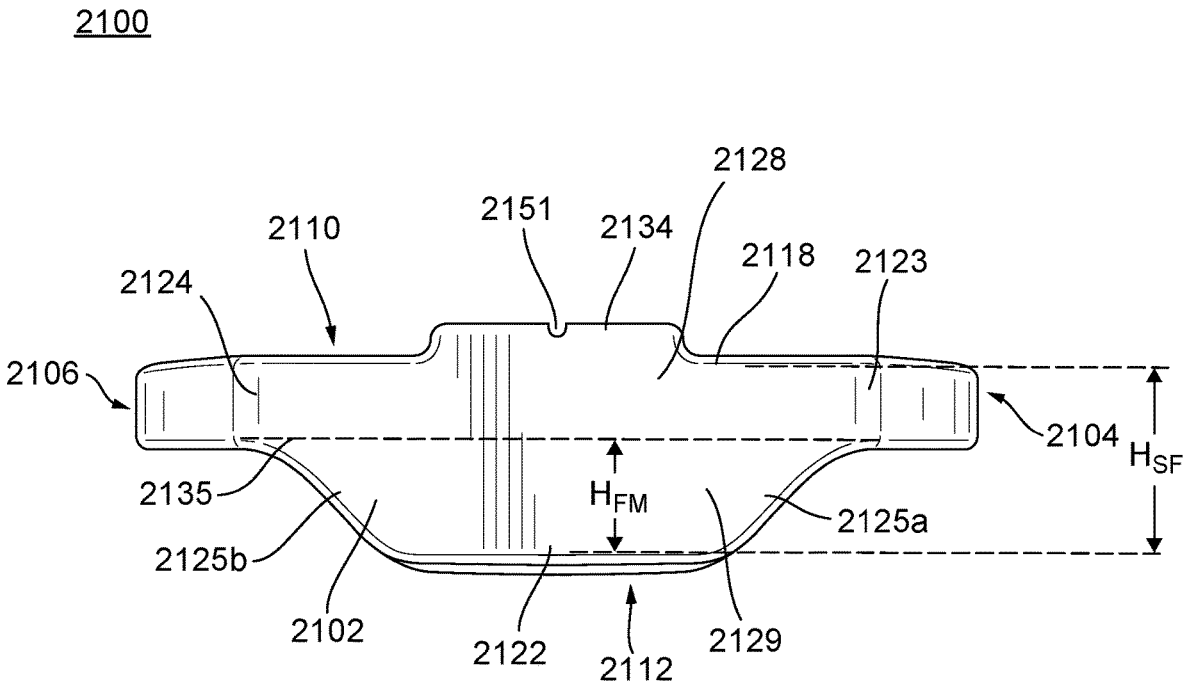
FIG. 30 illustrates a front view of the compact putter-type golf club head of FIG. 29.

Referring to FIG. 30, the club head 2100 comprises a strike face 2102 that is wider near the crown 2110 than near the sole 2112. The strike face 2102 comprises a top edge 2118, a bottom edge 2122, a heel edge 2123, a toe edge 2124, and a plurality of transition edges 2125*a*, 2125*b*. The transition edges include a heel-side transition edge 2125*a* and a toe-side transition edge 2125*b*. The heel-side transition edge 2125*a* connects the bottom edge 2122 to the heel edge 2123, and the toe-side transition edge 2125*b* connects the bottom edge 2122 to the toe edge 2124. As illustrated in FIG. 30, The transition edges 2125*a*, 2125*b* can be angled outward from the bottom edge 2122.

The strike face 2102 can comprise an upper portion 2128 and a lower portion 2129. The upper portion 2128 and lower portion 2129 are separated by a strike face midline 2135. The strike face midline 2135 is an imaginary line extending horizontally across the strike face midline 2135 from the juncture between the heel-side transition edge 2125*a* and the heel edge 2123 and the juncture between the toe-side transition edge 2125*b* and the toe edge 2124. The strike face 2102 comprises a midline height $H_{FM}$ measured vertically from the bottom edge 2122 to the strike face midline 2135. In many embodiments, the midline height can be between 0.30 and 0.50 inches. In some embodiments, the midline height can be between 0.30 and 0.325 inches, between 0.325 and 0.35 inches, between 0.35 and 0.375 inches, between 0.375 and 0.40 inches, between 0.40 and 0.425 inches, between 0.425 and 0.45 inches, between 0.45 and 0.475 inches, or between 0.475 and 5.0 inches. In many embodiments, the midline height can be between 35% and 65% of the strike face height $H_{SF}$. In some embodiments, the midline height can be between 35% and 40%, between 40% and 45%, between 45% and 50%, between 50% and 55%, between 55% and 60%, or between 60% and 65%.

The strike face 2102 comprises an upper portion 2128 that is larger than the lower portion 2129. The larger upper portion 2128 provides a large enough surface area for contacting a golf ball and inspiring confidence in the golfer, whereas the smaller lower portion 2129 allows the club head 2100 to glide through tall grass (such as when putting out of the rough) with minimal resistance.

In many embodiments, the strike face width increases from the bottom edge 2122 to the strike face midline 2135. FIG. 30 illustrates the slope of the transition edges 2125*a*, 2125*b* from the lower portion 2129 to the strike face midline 2135. In general, the upper portion 2128 of the strike face 2102 comprises a greater width than the lower portion 2129. In the illustrated embodiment of FIG. 30, the upper portion 2128 of the strike face 2102 comprises a constant width, however in other embodiments, the upper portion 2128 can comprise a variable width.

In many embodiments, the upper portion 2128 comprises a greater surface area than the lower portion 2129. In some embodiments, the strike face 2102 comprises a first face surface area ratio defined as the surface area of the upper portion 2128 divided by the surface area of the lower portion 2129. In many embodiments, the first face surface area ratio is greater than 1.25. In some embodiments, the first face surface area ratio can be greater than 1.50, greater than 1.75, greater than 2.0, greater than 2.25, greater than 2.50, greater than 2.75, or greater than 3.0. A first face surface area ratio greater than 1.25 is achievable by a strike face 2102 having a greater surface area within an upper portion 2128. Most prior art putters comprise substantially rectangular faces and have a first face surface area ratio closer to approximately 1.00.

The shape of the strike face 2102 can be characterized by a second face surface area defined as the surface area of the strike face 2102 divided by the strike face width $W_{SF}$. In many embodiments, the second face surface area ratio can be less than 0.75 inch. In some embodiments, the second surface area ratio can be less than 0.70 inch, less than 0.65 inch, less than 0.60 inch, less than 0.55 inch, or less than 0.50 inch. Most prior art putters comprise substantially rectangular faces and have a second face surface area ratio that is significantly larger than that of the compact putter-type club head 2100.

The variable width of the strike face 2102 creates a top edge 2118 with a greater length than the bottom edge 2122. In many embodiments, the top edge 2118 can comprise a length (measured in a heel-to-toe direction) between 1.75 and 2.5 inches. In some embodiments, the length of the top edge 2118 can be greater than 1.75 inches, greater than 1.80 inches, greater than 1.85 inches, greater than 1.90 inches, greater than 1.95 inches, greater than 2.0 inches, greater than 2.05 inches, greater than 2.10 inches, greater than 2.15 inches, greater than 2.20 inches, greater than 2.25 inch, greater than 2.30 inches, greater than 2.35 inches, greater than 2.40 inches, greater than 2.45 inches, or greater than 2.5 inches.

In many embodiments, the bottom edge 2122 can comprise a length (measured in a heel-to-toe direction) between 0.75 and 1.5 inches. In some embodiments, the length of the bottom edge 2122 can be less than 1.5 inches, less than 1.45 inches, less than 1.40 inches, less than 1.35 inches, less than 1.30 inches, less than 1.25 inches, less than 1.20 inches, less than 1.15 inches, less than 1.10 inches, less than 1.05 inches, less than 1.0 inch, less than 0.95 inch, less than 0.90 inch, less than 0.85 inch, less than 0.80 inch, or less than 0.75 inch.

The shape of the strike face 2102 can further be characterized by an edge length ratio defined as the length of the top edge 2118 divided by the length of the bottom edge 2122. In many embodiments, the edge length ratio can be greater than 1.5. In some embodiments, the edge length ratio can be greater than 1.75, greater than 2.0, greater than 2.25, greater than 2.50, greater than 2.75, or greater than 3.0.

As mentioned above, the strike face 2102 provides a large upper portion 2128 to inspire confidence in the golfer, and a smaller lower portion 2129 that allows the club head 2100 to glide through tall grass when putting through the rough or fringe. The large upper portion 2128 makes the strike face 2102 appear to the golfer large enough to make solid contact with the ball. The small lower portion 2129 provides less surface area in contact with the grass and works in conjunction with the body geometry (discussed in further detail below) to pass easily through taller grass.

Figure 31:
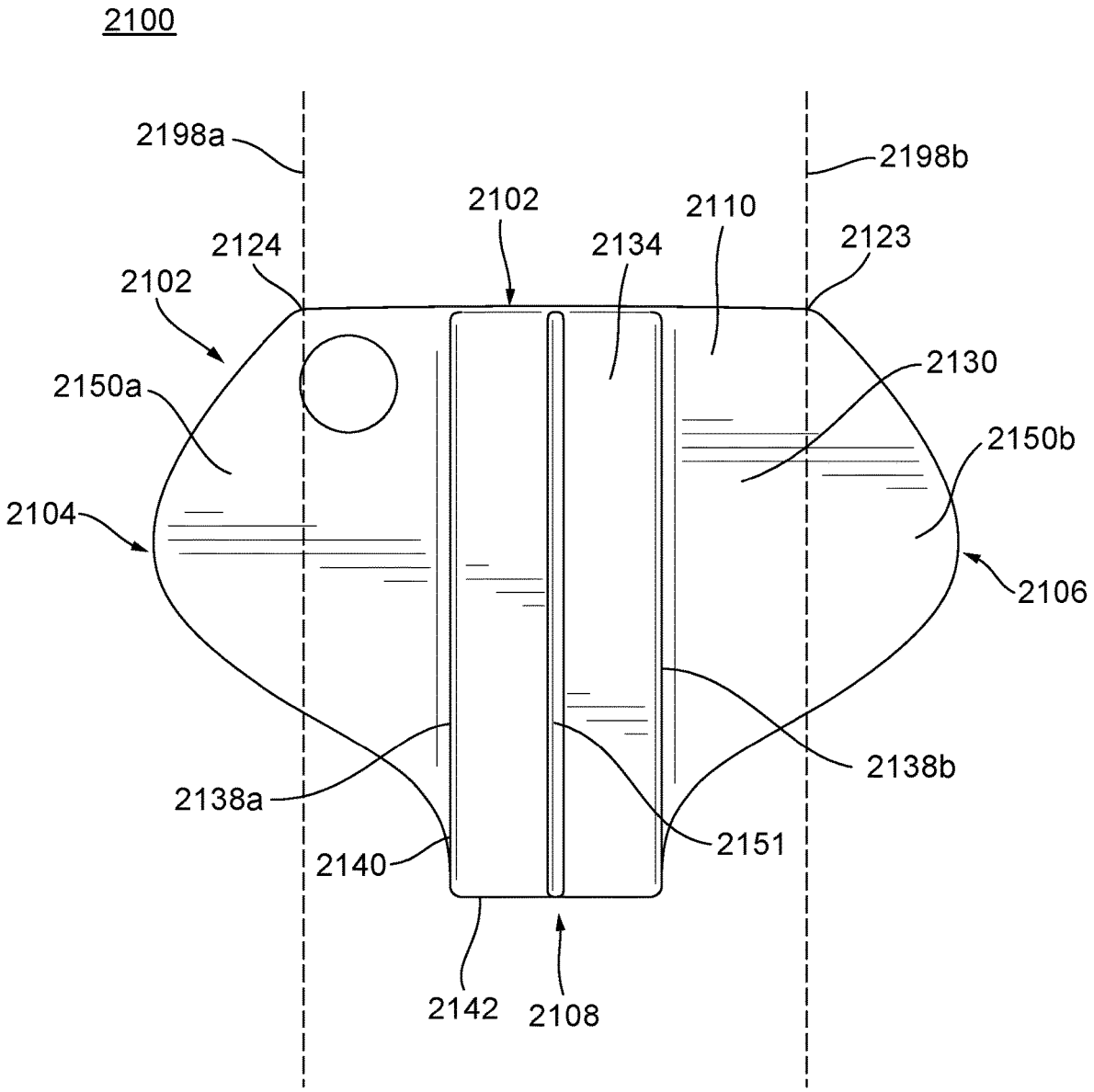
FIG. 31 illustrates a top view of the compact putter-type golf club head of FIG. 29.
Figure 33:
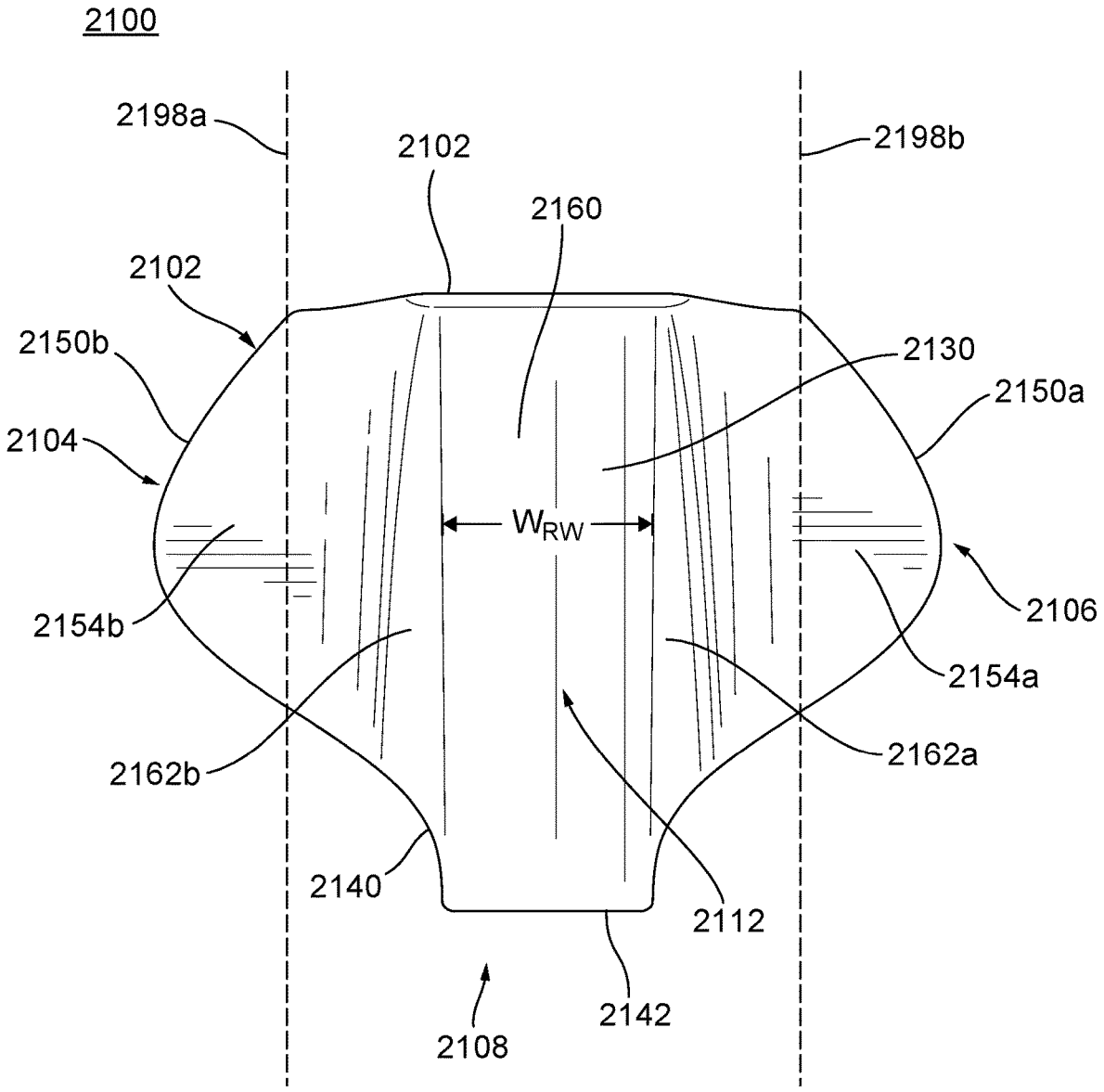
FIG. 33 illustrates a sole view of the compact putter-type golf club head of FIG. 29.

Referring to FIGS. 31 and 33, the body 2101 comprises a central body 2130, a heel-side wing 2150*a* and a toe-side wing 2150*b*. The central body 2130 forms a central portion of the body 2101. The central body 2130 is bounded by a first central body plane 2198*a* and a second central body plane 2198*b*. The central body planes 2198*a*, 2198*b* are vertical planes extending in a front-to-rear direction and intersecting the heel edge 2123 and the toe edge 2124 of the strike face 2102, respectively.

The wings 2150*a*, 2150*b* extend outwardly from the central body 2130 (i.e. extend outwardly from the central body planes 2198*a*, 2198*b*, respectively). The heel-side wing 2150*a* extends outwardly from the central body 2130 and forms the heel end 2104 of the club head 2100. Similarly, the toe-side wing 2150*b* extends outwardly from the central body 2130 and forms the toe end 2106 of the club head 2100. In the illustrated embodiment of FIGS. 29-34, the middle of the wings 2150*a*, 2150*b* are bowed outwardly such that the body width is greater towards the heel-toe midplane than towards the strike face 2102 or toward the rear end 2108. In general, the maximum body width of the club head 2100 is located between the heel-side wing 2150*a* and the toe-side wing 2150*b*. The bowed shape of the wings 2150*a*, 2150*b* provides the club head 2100 with a greater overall body width while still allowing for a small strike face 2102. The club head 2100 therefore provides both an increased MOI due to the shaping of the club head 2100, as well as the focusing effect associated with the small strike face 2102 (described in detail above).

Figure 32:
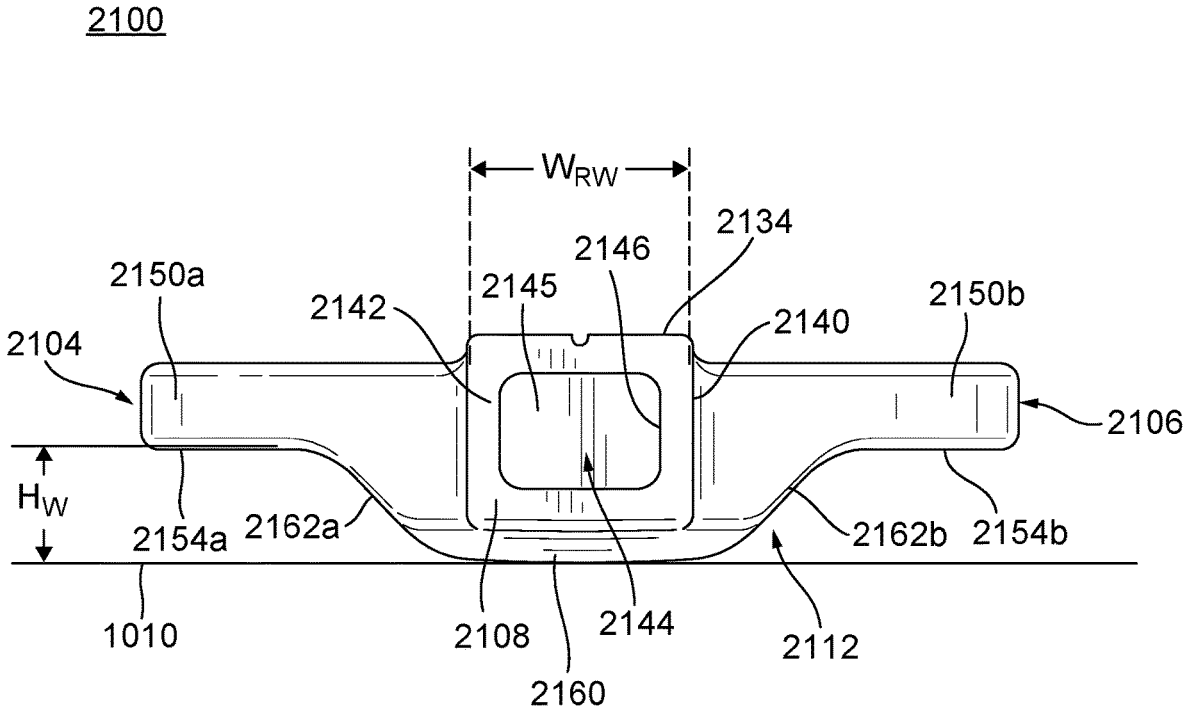
FIG. 32 illustrates a rear view of the compact putter-type golf club head of FIG. 29.

Near the rear end 2108, the central body 2130 narrows and forms a tail 2140. In many embodiments, the tail 2140 can be shaped to correspond to an alignment feature 2134 on the crown 2110 (described in further detail below). The tail 2140 can match the shape of the alignment feature 2134 to visually accentuate the alignment feature 2134. The tail 2140 forms a rear wall 2142 at the club head rear end 2108. The rear wall 2142 can be substantially narrow in comparison to the strike face 2102 and the remainder of the body 2101. As illustrated in FIG. 32, the rear wall 2142 comprises a width $W_{RW}$ measured in a heel-to-toe direction. In many embodiments, the rear wall width $W_{RW}$ can be between 0.75 and 1.0 inch. In some embodiments, the rear wall width $W_{RW}$ can be between 0.75 inch and 0.85 inch, between 0.80 inch and 0.90 inch, between 0.85 inch and 0.95 inch, or between 0.90 inch and 1 inch. In some embodiments, the rear wall width $W_{RW}$ can be less than 1.0 inch, less than 0.95 inch, less than 0.90 inch, less than 0.85 inch, less than 0.80 inch, or less than 0.75 inch.

As mentioned above, the rear wall 2142 can be substantially narrow in comparison to both the strike face 2102 and the remainder of the body 2101. The club head 2100 can comprise a ratio $W_{RW}/W_B$ defined as the rear wall width $W_{RW}$ divided by the body width $W_B$. In many embodiments, the ratio $W_{RW}/W_B$ can be less than 0.4. In some embodiments, the ratio $W_{RW}/W_B$ can be less than 0.35, less than 0.30, less than 0.25, or less than 0.20.

Further, the club head 2100 can comprise a ratio $W_{RW}/W_{SF}$ defined as the rear wall width $W_{RW}$ divided by the strike face width $W_{SF}$. In many embodiments, the ratio $W_{RW}/W_{SF}$ can be less than 0.45. In some embodiments, the ratio $W_{RW}/W_B$ can be less than 0.40, less than 0.35, less than 0.35, less than 0.30, less than 0.25, or less than 0.20. The narrow rear wall 2142 visually highlights the alignment feature 2134. In many embodiments, the narrow rear wall 2142 is the same width as the alignment feature 2134. The narrow rear wall makes the rear end of the alignment feature 2134 appear more prominent and elongated, thereby enhancing the focusing effect of the alignment feature 2134.

As illustrated in FIG. 32, the rear wall 2142 can further comprise a rear recess 2144. The rear recess 2144 is recessed into the surface of the rear wall 2142 away from the rear end 2108 via a floor 2145 and a perimeter wall 2146. The rear recess 2144 can be substantially similar to rear recess 144, or any of the various rear recess embodiments described herein. Specifically, the rear recess 2144 can comprises similar dimensions to rear recess 144 in relation to the rear recess width $W_{RR}$ and rear recess depth $D_R$. The rear recess 2144 can act as a mass reducing feature by removing mass from the rear wall 2142. The mass removed by the rear recess 2144 can be reallocated to provide perimeter weighting and increase the MOI of the putter-type club head 2100 thereby providing greater forgiveness.

Referring to FIGS. 30 and 31, the club head 2100 comprises a crown 2110 formed by top surfaces of the central body 2130 and the wings 2150*a*, 2150*b*. The crown 2110 comprises an alignment feature 2134. The alignment feature 2134 is elongated and continuous, extending the entirety of the club head length from the strike face 2102 to the rear wall 2142. In the illustrated embodiment of FIGS. 29-34, the alignment feature 2134 is formed as a raised portion of the crown 2110. The elongate and raised nature of the alignment feature 2134 provides a stark visual contrast to the remainder of the crown 2110. Specifically, the length of the alignment feature 2134 allows the golfer to better visualize his or her intended starting line. The alignment feature 2134 can comprise a heel-side wall 2138*a* and a toe-side wall 2138*b*. In many embodiments, the alignment feature walls 2138*a*, 2138*b* are parallel to one another and perpendicular to the strike face 2102. The alignment feature 2134 further comprises a central groove 2151 aligned with the center of the strike face 2102 and extending parallel to the alignment feature walls 2138*a*, 2138*b*. As alluded to above, the alignment feature 2134 can be complemented by the shaping of the tail 2140. At the tail 2140, the heel-side wall 2138*a* and the toe-side wall 2138*b* of the alignment feature 2134 converge with the heel end 2104 and the toe end 2106 of the body 2101. At address, as illustrated in FIG. 31, the only portion of the tail 2140 visible to the golfer is the alignment feature 2134. Shaping the body 2101 to converge with the alignment feature walls 2138*a*, 2138*b* highlights the length of the alignment feature 2134 and enhances the focusing effect.

The club head 2100 further comprises a sole 2112 comprising a geometry configured to glide through the rough with minimal resistance. As illustrated in FIG. 33, the sole 2112 is formed by the bottom of the central body 2130 and the wings 2150*a*, 2150*b*. The sole 2112 comprises a central sole surface 2160, a heel-side wing underside surface 2154*a*, a toe-side wing underside surface 2154*b*, and a plurality of transition surfaces 2162*a*, 2162*b* connecting the central sole surface 2160 to the wing underside surfaces 2154*a*, 2154*b*.

The central sole surface 2160 forms the bottom-most surface of the sole 2112 (and therefore the bottom-most surface of the club head 2100). In many cases, particularly when putting on the green or out of short grass, the central sole surface 2160 is the only portion of the sole 2112 that touches the ground at address. In many embodiments, the central sole surface 2160 comprises a substantially flat bottom surface. The central sole surface 2160 extends the entirety of the club head length from the strike face 2102 to the rear wall 2142. In many embodiments, the shape of the central sole surface 2160 can correspond to the shape of the alignment feature 2134. For example, from a bottom view, the profile of the central sole surface 2160 can match the profile of the alignment feature 2134 as viewed from the top. In some embodiments, the central sole surface 2160 can be slightly wider than the alignment feature 2134 to provide a more stable base for the club head 2100 at address. Matching the shape of the central sole surface 2160 with the shape of the alignment feature 2134 enhances the ability of the golfer to align the club head 2100. Although the sole 2112 is not visible at address, the alignment feature 2134 allows the golfer to visualize how the central sole surface 2160 is resting on the ground.

The central sole surface 2160 can be substantially narrow relative to the rest of the body 2101. As illustrated in FIG. 33, the club head 2100 comprises a central sole width $W_{CS}$, measured in a heel-to-toe direction. In many embodiments, the central sole width $W_{CS}$ can be between 0.60 and 1.5 inches. In some embodiments, the central sole width $W_{CS}$ can be between 0.60 inch and 0.75 inch, between 0.75 inch and 1.0 inch, between 1.0 inch and 1.25 inches, or between 1.25 inches and 1.50 inches. In many embodiments, the central sole width $W_{CS}$ can be less than 1.5 inches, less than 1.25 inches, less than 1.0 inch, less than 0.75 inch, or less than 0.60 inch. On putts out of the rough, the narrow central sole surface allows the club head to glide through the taller grass by providing a smaller surface area of the sole in contact with the grass.

The central sole surface 2160 is substantially narrow compared to the body width $W_B$. The relationship between the central sole surface 2160 and the body 2101 can be characterized by a ratio $W_{CS}/W_B$ defined as the central sole width $W_{CS}$ divided by the body width $W_B$. In many embodiments, the $W_{CS}/W_B$ ratio can be less than 0.5, less than 0.45, less than 0.40, less than 0.35, less than 0.30, or less than 0.25.

Figure 34:
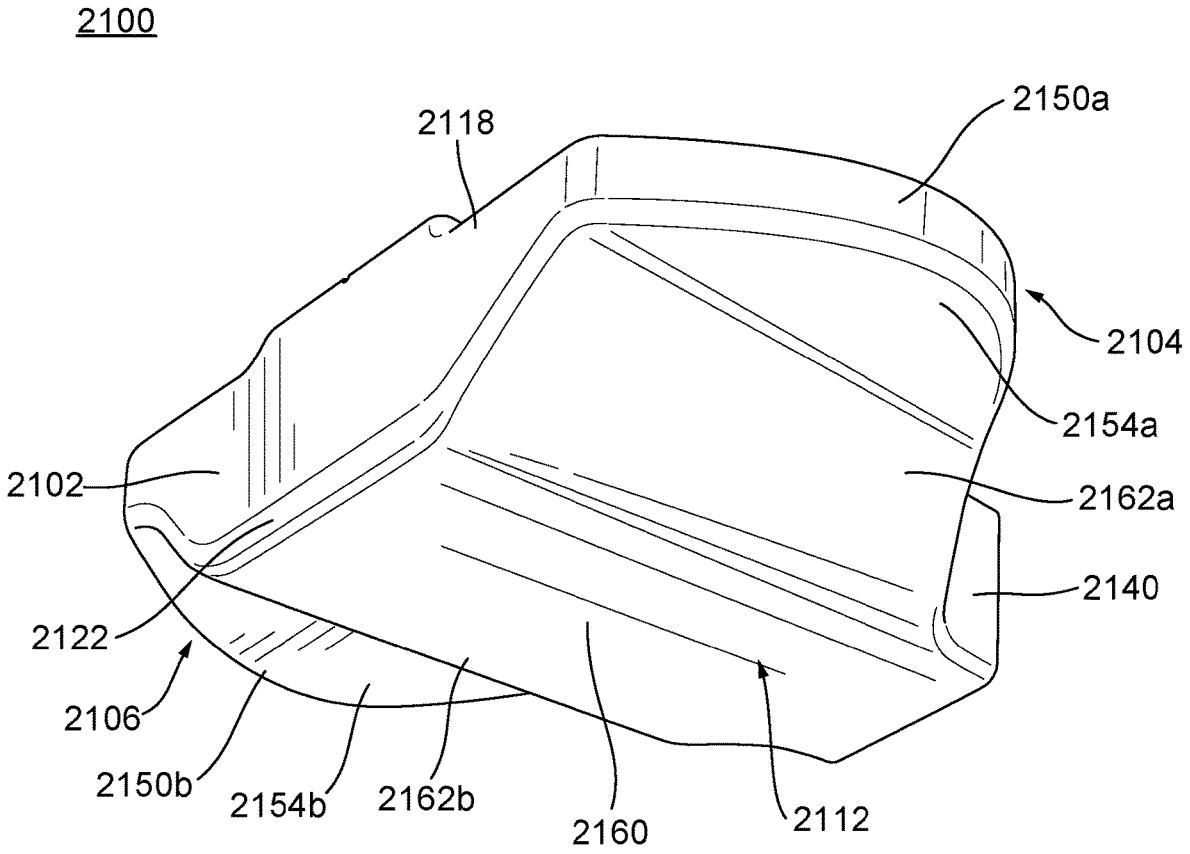
FIG. 34 illustrates a bottom-perspective view of the compact putter-type golf club head of FIG. 29.

In many embodiments, the wing underside surfaces 2154*a*, 2154*b* are substantially parallel to the crown 2110 and/or the central sole surface 2160. As illustrated in FIGS. 32 and 34, the wing underside surfaces 2154*a*, 2154*b* are raised relative to the central sole surface 2160. As illustrated in FIG. 32, the wings 2150*a*, 2150*b* are raised by a wing height $H_W$ measured vertically between the ground plane 1010 and the wing underside surfaces 2154*a*, 2154*b*. In many embodiments, the wing height $H_W$ can be between 0.25 and 0.60 inches. In some embodiments, the wing height $H_W$ can be between 0.25 inch and 0.35 inch, between 0.30 inch and 0.40 inch, between 0.35 inch and 0.45 inch, between 0.40 inch and 0.50 inch, between 0.45 inch and 0.55 inch, or between 0.50 inch and 0.60 inch. In many embodiments, the wing height $H_W$ can be greater than 0.25 inches, greater than 0.30 inch, greater than 0.35 inch, greater than 0.40 inch, greater than 0.45 inch, greater than 0.50 inch, greater than 0.55 inch, or greater than 0.60 inch. Raising the wing underside surfaces 2154*a*, 2154*b* contributes the gliding effect of the club head 2100 through the rough, because the wing underside surfaces 2154*a*, 2154*b* are raised above the grass in many cases.

As mentioned above, the sole 2112 comprises a plurality of transition surfaces 2162*a*, 2162*b* connecting the central sole surface 2160 to the wing underside surfaces 2154*a*, 2154*b*. The sole 2112 comprises a heel-side transition surface 2162*a* extending between and connecting the central sole surface 2160 and the heel-side wing underside surface 2154*a*. Similarly, the sole 2112 further comprises a toe-side transition surface 2162*b* extending between and connecting the central sole surface 2160 and the toe-side wing underside surface 2154*b*. As illustrated in FIGS. 32 and 34, The transition surfaces 2162*a*, 2162*b* are sloped upward and away from the central sole surface 2160 to provide a transition between the central sole surface 2160 and the raised wing underside surfaces 2154*a*, 2154*b*. In the illustrated embodiment, the slope of the transition surfaces 2162*a*, 2162*b* can substantially match the slope of the strike face transition edges 2125*a*, 2125*b*. Similar to the strike face 2102, the sole 2112 is narrowest at the bottom and then increases in width as the transition walls extend toward the wing underside surfaces 2154*a*, 2154*b*.

The overall shape of the sole 2112 acts like the hull on a boat to allow the club head to glide through the rough. When putting from the rough or fringe, the bottom of the sole 2112 is where the majority of the club head 2100 contacts the grass. The sole 2112 is narrow at the bottom to reduce the total contact area between the club head 2100 and the grass. This sole 2112 shaping works in conjunction with the shape of the strike face 2102 to provided minimal contact and resistance between the club head 2100 and the grass. Further, the sloped transition surfaces 2162*a*, 2162*b* contact the grass at an oblique angle, pushing the grass away from the center of the club head 2100 and providing stability throughout the putting stroke.

EXAMPLES

I. Example 1: Compact Putter Vs. Blade-Style Putter

Further described herein is a comparison of performance results between a compact putter and a typical blade-style putter. The results compared the effects of the size and shaping of the club head on putting performance. The strike face width and strike face surface area of the compact putter were significantly smaller than those of the blade-style putter. As discussed above, the small strike face focuses the player on the center of the strike face by providing a smaller, more precise target location for the player to strike the ball. The performance test demonstrated the effect that the small strike face has on putting performance.

The compact putter was substantially similar to the compact putter-type club head 100, illustrated in FIG. 1. The compact putter comprised a strike face substantially smaller than the strike faces of many prior art putter-type golf club heads. The strike face width $W_{SF}$ was approximately 1.50 inches, the body width $W_B$ was approximately 2.25 inches, and the strike face surface area was approximately 1.19 $in^2$. The compact putter defined a ratio $W_{SF}/W_B$ comparing the strike face width $W_{SF}$ to the body width $W_B$ of approximately 0.68. The compact putter further included a transition region connecting the wider body to the narrower strike face.

The blade-style putter was substantially similar to many prior art putters in both sizing and shaping. The strike face width $W_{SF}$ was approximately 4.40 inches, the body width $W_B$ was approximately 4.40 inches, and the strike face surface area was approximately 3.29 $in^2$. The blade-style putter defined a ratio $W_{SF}/W_B$ comparing the strike face width $W_{SF}$ to the body width $W_B$ of approximately 1.0. Similar to most typical prior art putters, the body and strike face of the blade-style putter were similar in width, and the blade-style putter did not include a transition region. (63.8% smaller)

The overall performance of the compact putter and the blade-style putter were compared in a player performance test. A representative number of players hit a plurality of putts with each putter. For each player, a "putting handicap" metric associated with each club was determined. The putting handicap is an encompassing putting performance metric and represents the expected difference in number of strokes per round (based only on putting performance) relative to par for a given player. The putting handicap is a similar to a traditional golf handicap in terms of representing player performance, with the putting handicap being specific to putting performance. Similar to a traditional golf handicap, a lower value represents improved performance, with a value of 0 being associated with a level of performance associated with shooting even par. The putting handicap is a composite metric calculated from a combination of club head delivery characteristics at impact including face closure rate, face angle, loft angle, lie angle, and tempo.

On average, there was a negligible difference in putting handicap between the compact putter and the blade-style putter. The average putting handicap value of all players with the compact putter was 1.71, while the average putting handicap value of all players with the blade-style putter was 1.34. Although the average handicap was slightly higher for the compact putter, the difference (0.37) corresponds to only a fraction of a stroke per 18-hole round. The negligible difference illustrates that in general, the compact putter is a viable alternative to a traditional blade-style putter.

Further, of the players sampled, 42% exhibited improved performance with the compact putter over the blade-style putter. This 42% demonstrated an average improvement of 3.04 in putting handicap. The maximum improvement exhibited by a player with the compact putter over the blade-style putter was 5.07. As mentioned above, putting performance tends to be very player specific. The results of the player test illustrate that a large number of players (42% of those sampled) would experience significant improvements in putting performance (3 fewer strokes per 18-hole round on average, and up to 5 fewer strokes per 18-hole round in some cases) by playing the compact putter in comparison to a traditional prior-art putter.

Four participants were surveyed on their qualitative observations relating to the compact putter during the player test. The selected players were asked to observe and record their experience with the compact putter before and after hitting their putts. All four selected players noted that the feel of the compact putter at impact was desirable. Three out of the four selected players stated that their performance with the compact putter exceeded their initial expectations. Three out of the four selected players recorded a positive experience related to the focusing and alignment aspect of the compact putter. Such strong positive feedback illustrates the benefits of the compact putter's focusing effect. The sampled players were satisfied with the ability to align and perform with the compact putter, despite unfamiliarity with its unconventional size and shape.

As mentioned above, the similarities in putting handicap between the compact putter and the blade-style putter indicate that the compact putter is a viable alternative to a more traditionally shaped putter head. As illustrated by the player-specific results and qualitative feedback, the unique features of the compact putter, such as the smaller face, smaller overall profile, and transition walls that act as an alignment feature, provide significant performance increases for certain players. These features provide a focusing effect that is desirable and effective for a significant subset of players.

II. Example 2: Compact Putter Vs. Competitor Compact Putter

Further described herein is a comparison of performance results between a compact putter having a transition region and a compact putter devoid of a transition region. Similar to Example 1, these results compared the effects that the size and shaping of the club head had on putting performance. However, the results demonstrated in this example more specifically focus on the effect that the transition region has on putting performance. As discussed above, the transition region walls provide a wider body and a higher MOIyy relative to the size of the face (characterized by the $W_{SF}/W_B$ ratio and $MOI_{yy}/A_{SF}$ ratio, respectively). Further, the transition region walls can point to the center of the golf ball, providing a focusing effect by drawing the user's eye to the center of the golf ball. The performance test demonstrated the effect that the transition region has on putting performance.

The compact putter including the transition region (hereafter referred to as the "exemplary compact putter") was substantially similar to the compact putter described in Example 1 (and the compact putter-type club head 100 illustrated in FIG. 1). As discussed above, the exemplary compact putter defined a ratio $W_{SF}/W_B$ comparing the strike face width $W_{SF}$ to the body width $W_B$ of approximately 0.68. The exemplary compact putter further defined a ratio $MOI_{yy}/A_{SF}$ comparing the strike face area to the moment of inertia ($MOI_{yy}$) of approximately 260 g. The exemplary compact putter further included a transition region connecting the wider body to the narrower strike face.

The control putter was a compact putter devoid of a transition region. The control compact putter was substantially square shaped in a top-down view. The strike face width $W_{SF}$ was approximately 2.01 inches, the body width $W_B$ was approximately 2.01 inches, and the strike face surface area was approximately 2.08 $in^2$. The control compact putter defined a ratio $W_{SF}/W_B$ comparing the strike face width $W_{SF}$ to the body width $W_B$ of approximately 1.0. The control compact putter further defined a ratio $MOI_{yy}/A_{SF}$ comparing the strike face area to the moment of inertia ($MOI_{yy}$) of approximately 92 g. The body and strike face of the control compact putter were similar in width, and the control compact putter did not include a transition region.

The overall performance of the exemplary compact putter and the control compact putter were compared in a player performance test similar to the player performance test of Example 1. Again, a representative number of players hit a plurality of putts with each putter. Similar to Example 1, the putting handicap metric described above was determined for each player and each club.

The exemplary compact putter demonstrated a significant improvement in the average putting handicap in comparison to the control compact putter. The average putting handicap value with the control compact putter was 4.27, and the average putting handicap value of all players with the exemplary compact putter was 1.71 (60% reduction).

Further, of the players sampled, 58% exhibited improved performance with the exemplary compact putter over the control compact putter. This 58% demonstrated a significant average improvement of 7.22 in putting handicap. The maximum improvement exhibited by a player with the exemplary compact putter over the control compact putter was 12.82. The results of the player test indicate that a majority of players (58% of those sampled) would experience significant improvements in putting performance (7.22 fewer strokes per 18-hole round on average, and up to 12.8 fewer strokes per 18-hole round in some cases) by playing the exemplary compact putter in comparison to the control compact putter.

The players were surveyed after the performance test to compare their overall experience using the exemplary compact putter and the control compact putter. A majority of participants (84%) rated the exemplary compact putter as desirable. In comparison, only 44% of participants rated the control compact putter as desirable. In a direct comparison, 58% of players preferred the exemplary compact putter over the control compact putter. Only 5% of players preferred the control compact putter to the exemplary compact putter, with the remaining 37% of players having no preference.

The player performance and qualitative feedback illustrates the benefits of the exemplary compact putter over the control compact putter. The transition region of the exemplary compact putter provides a focusing effect by pointing towards the golf ball and further allows for a wider, higher MOI body while retaining a small, focused strike face. In comparison, the control compact putter has a square body devoid of a transition region that creates a lower-MOI club head and provides no focusing effect. The overall shaping (including the transition region) of the exemplary club head provides more forgiveness and enhances the ability to align the putter head, resulting in a club head with improved overall performance.

CLAUSES

A putter-type golf club head comprising: a body comprising: a strike face bounded by a strike face perimeter and comprising a geometric center, a loft plane, a strike face surface area $A_{SF}$, and a leading edge; a heel end, a toe end, a crown, a sole, and a rear end opposite the strike face, and a center of gravity; an origin point located at a center of the leading edge; wherein the strike face comprises a strike face width $W_{SF}$ less than 1.55 inches, the strike face width $W_{SF}$ measured across the strike face in a heel end-toe end direction; a first portion and a second portion, wherein the first portion comprises the strike face, and a transition region, and the second portion is positioned rearward from the first portion and comprises a remainder of the body; wherein the transition region comprises a first transition wall and a second transition wall, and wherein the first and second transition walls extend from the strike face to connect the strike face to the second portion; wherein the putter-type golf club head further comprises a moment of inertia $MOI_{yy}$ between 1000 $g \cdot cm^2$ to 2000 $g \cdot cm^2$; and wherein a ratio $MOI_{yy}/A_{SF}$ of the moment of inertia $MOI_{yy}$ to the strike face surface area $A_{SF}$ is greater than 230 g.

A putter-type golf club head comprising: a body comprising: a crown, a sole, a heel end, a toe end, a strike face, and a rear end opposite the strike face, a strike face bounded by a strike face perimeter and comprising a geometric center, a strike face surface area $A_{SF}$, and a leading edge; a heel end, a toe end, a crown, a sole, and a rear end opposite the strike face, and a center of gravity; an origin point located at a center of the leading edge; wherein the strike face comprises a strike face width $W_{SF}$ less than 1.55 inches, the strike face width $W_{SF}$ measured across the strike face in a heel end-toe end direction; wherein the strike face perimeter comprises a multi-sided shape having a high-heel corner, a low-heel corner, a high-toe corner, and a low-toe corner; wherein the strike face further comprises a distance $D_{SF}$ measured diagonally from the low-heel corner of the strike face to the high-toe corner of the strike face, and wherein the distance $D_{SF}$ is less than 1.75 inches; wherein the body further defines a distance $D_{BS}$ measured from the low-heel corner of the strike face to a high-toe corner of the rear end; wherein the distance $D_{BS}$ is between 2.75 inches and 3.15 inches; a first portion and a second portion, wherein the first portion comprises the strike face, and a transition region, and the second portion is positioned rearward from the first portion and comprises a remainder of the body; and wherein the transition region comprises a first transition wall and a second transition wall, and wherein the first and second transition walls extend from the strike face to connect the strike face to the second portion.

A putter-type golf club head comprising: a body comprising: a strike face bounded by a strike face perimeter and comprising a geometric center, a loft plane, a strike face surface area $A_{SF}$, and a leading edge; a heel end, a toe end, a crown, a sole, and a rear end opposite the strike face, and a center of gravity; an origin point located at a center of the leading edge; wherein the strike face comprises a strike face width $W_{SF}$ less than 1.55 inches, the strike face width $W_{SF}$ measured across the strike face in a heel end-toe end direction; wherein the strike face perimeter comprises a multi-sided shape having a high-heel corner, a low-heel corner, a high-toe corner, and a low-toe corner; wherein the strike face further comprises a top edge and an apex located at a center of the top edge; wherein the putter-type golf club head further defines an apex angle $\alpha_1$ measured between a first reference line connecting the apex and the low-heel corner of the strike face and a second reference line connecting the apex and the low-toe corner of the strike face; wherein the apex angle $\alpha_1$ is between 80 degrees and 90 degrees; wherein the strike face further defines a CG projection point; wherein the CG projection point is defined as a projection of the center of gravity normal to the loft plane onto the strike face; wherein the putter-type golf club head further defines a center of gravity (CG) angle $\alpha_2$ measured between a first reference line connecting the CG projection point and the low-heel corner and a second reference line connecting the CG projection point and a low-toe corner; wherein the center of gravity (CG) angle $\alpha_2$ is between 115 degrees and 130 degrees; a first portion and a second portion, wherein the first portion comprises the strike face, and a transition region, and the second portion is positioned rearward from the first portion and comprises a remainder of the body; wherein the transition region comprises a first transition wall and a second transition wall, and wherein the first and second transition walls extend from the strike face to connect the strike face to the second portion.

A putter-type golf club head comprising: a body comprising: a volume less than 50 $cm^3$; a strike face bounded by a strike face perimeter and comprising a geometric center, a loft plane, a strike face surface area $A_{SF}$, and a leading edge; wherein the strike face comprises a strike face surface area less than 1.50 $in^2$; a heel end, a toe end, a crown, a sole, a rear end opposite the strike face, and a center of gravity; an origin point located at a center of the leading edge; wherein the strike face comprises a strike face width $W_{SF}$ measured across the strike face in a heel end-toe end direction; wherein the strike face further defines a strike face height $H_{SF}$, and wherein a ratio of the strike face height $H_{SF}$ to the strike face width $W_{SF}$ is less than 1.90; wherein the strike face comprises a strike face perimeter less than 5 inches; a first portion and a second portion, wherein the first portion comprises the strike face, and a transition region, and the second portion is positioned rearward from the first portion and comprises a remainder of the body; wherein the transition region comprises a first transition wall and a second transition wall, and wherein the first and second transition walls extend from the strike face to connect the strike face to the second portion.

The invention claimed is:

1. A putter-type golf club head comprising:

a body comprising:

a strike face bounded by a strike face perimeter and comprising a geometric center, a loft plane, a strike face surface area $A_{SF}$, and a leading edge;

a heel end, a toe end, a crown, a sole, and a rear end opposite the strike face, and a center of gravity;

an origin point located at a center of the leading edge;

wherein the strike face comprises a strike face width $W_{SF}$ less than 1.55 inches, the strike face width $W_{SF}$ measured across the strike face in a heel end-toe end direction;

wherein the strike face perimeter comprises a multi-sided shape having a high-heel corner, a low-heel corner, a high-toe corner, and a low-toe corner;

wherein the strike face further comprises a distance $D_{SF}$ measured diagonally from the low-heel corner of the strike face to the high-toe corner of the strike face, and wherein the distance $D_{SF}$ is less than 1.75 inches;

a first portion and a second portion, wherein the first portion comprises the strike face, and a transition region, and the second portion is positioned rearward from the first portion and comprises a remainder of the body;

wherein the transition region comprises a first transition wall and a second transition wall, and wherein the first and second transition walls extend from the strike face to connect the strike face to the second portion;

wherein the body defines a vertical midplane extending in the heel end-toe end direction and in a crown-sole direction and located halfway between the strike face and the rear end;

wherein the body further comprises a body width $W_B$ less than 2.30 inches, the body width $W_B$ measured between the heel end and the toe end in the heel end-toe end direction;

wherein the body further comprises a body depth $D_B$ less than 2.50 inches, the body depth $D_B$ measured between the strike face and the rear end in a strike face-rear end direction;

wherein a ratio $W_{SF}/W_B$ of the strike face width $W_{SF}$ to the body width $W_B$ is less than 0.75;

a hosel attached to the body at a hosel connection point centered with respect to a hosel aperture defined in the body, the hosel aperture configured to receive the hosel, wherein the hosel comprises a hosel bore;

wherein the hosel connection point is located rearward of the vertical midplane;

wherein the putter-type golf club head further comprises a moment of inertia $MOI_{yy}$ between 1000 g·$cm^2$ to 2000 g·$cm^2$; and wherein a ratio $MOI_{yy}/A_{SF}$ of the moment of inertia $MOI_{yy}$ to the strike face surface area $A_{SF}$ is greater than 230 g.

2. The putter-type golf club head of claim 1, wherein the hosel bore defines a shaft axis concentric with the hosel bore, and wherein the shaft axis is rearward of the center of gravity.

3. The putter-type golf club head of claim 1, further comprising a loft angle greater than 5 degrees.

4. The putter-type golf club head of claim 1, wherein the strike face further defines a strike face height $H_{SF}$ measured across the strike face in the crown-sole direction, and wherein a ratio $H_{SF}/W_{SF}$ of the strike face height $H_{SF}$ to the strike face width $W_{SF}$ is less than 1.90.

5. The putter-type golf club head of claim 1, wherein the strike face further comprises:

a top edge and an apex located at a center of the top edge;

wherein the putter-type golf club head further defines an apex angle $\alpha_1$ measured between a first reference line connecting the apex and the low-heel corner of the strike face and a second reference line connecting the apex and the low-toe corner of the strike face;

wherein the apex angle $\alpha_1$ is between 80 degrees and 90 degrees.

6. The putter-type golf club head of claim 1, wherein the strike face further defines a CG projection point;

wherein the CG projection point is defined as a projection of the center of gravity normal to the loft plane onto the strike face;

wherein the putter-type golf club head further defines a center of gravity (CG) angle $\alpha_2$ measured between a first reference line connecting the CG projection point and the low-heel corner and a second reference line connecting the CG projection point and a low-toe corner;

wherein the center of gravity (CG) angle $\alpha_2$ is between 115 degrees and 130 degrees.

7. The putter-type golf club head of claim 1, wherein the body further defines a distance $D_{BS}$ measured from the low-heel corner of the strike face to a high-toe corner of the rear end; wherein the distance $D_{BS}$ is between 2.75 inches and 3.15 inches.

8. The putter-type golf club head of claim 1, wherein the hosel connection point is located at a rearward perpendicular distance $D_{H-R}$ from the rear end, and wherein the rearward perpendicular distance $D_{H-R}$ is between 0.55 inch to 0.60 inch.

9. The putter-type golf club head of claim 1, wherein the hosel connection point is located at a forward perpendicular distance $D_{H-F}$ from the strike face, and wherein the forward perpendicular distance $D_{H-F}$ is between 1.5 inches to 1.9 inches.

10. The putter-type golf club head of claim 1, further comprising:

a coordinate system centered about the origin point, the coordinate system comprising an X-axis, a Y-axis, and a Z-axis;

wherein the X-axis extends in a heel-to-toe direction;

wherein the Y-axis extends in a crown-to-sole direction;

wherein the Z-axis extends in a front-to-rear direction;

wherein the center of gravity is located at a distance $X_O$ along the X-axis between 0.01 inch to 0.10 inch;

wherein the center of gravity is located at a height $Y_O$ along the Y-axis between 0.30 inch to 0.60 inch; and wherein the center of gravity is located at a depth $Z_O$ between 1.00 inch to 1.25 inches.

11. A putter-type golf club head comprising:

a body comprising:

a crown, a sole, a heel end, a toe end, a strike face, and a rear end opposite the strike face, a strike face bounded by a strike face perimeter and comprising a geometric center, a strike face surface area $A_{SF}$, and a leading edge;

a heel end, a toe end, a crown, a sole, and a rear end opposite the strike face, and a center of gravity;

an origin point located at a center of the leading edge;

wherein the strike face comprises a strike face width $W_{SF}$ less than 1.55 inches, the strike face width $W_{SF}$ measured across the strike face in a heel end-toe end direction;

wherein the strike face perimeter comprises a multi-sided shape having a high-heel corner, a low-heel corner, a high-toe corner, and a low-toe corner;

wherein the strike face further comprises a distance $D_{SF}$ measured diagonally from the low-heel corner of the strike face to the high-toe corner of the strike face, and wherein the distance $D_{SF}$ is less than 1.75 inches;

a first portion and a second portion, wherein the first portion comprises the strike face, and a transition region, and the second portion is positioned rearward from the first portion and comprises a remainder of the body;

wherein the transition region comprises a first transition wall and a second transition wall, and wherein the first and second transition walls extend from the strike face to connect the strike face to the second portion;

wherein the body defines a vertical midplane extending in the heel end-toe end direction and in a crown-sole direction and located halfway between the strike face and the rear end;

wherein the body further comprises a body width $W_B$ less than 2.30 inches, the body width $W_B$ measured between the heel end and the toe end in the heel end-toe end direction;

wherein the body further comprises a body depth $D_B$ less than 2.50 inches, the body depth $D_B$ measured between the strike face and the rear end in a strike face-rear end direction;

wherein a ratio $W_{SF}/W_B$ of the strike face width $W_{SF}$ to the body width $W_B$ is less than 0.75;

a hosel attached to the body at a hosel connection point centered with respect to a hosel aperture defined in the body, the hosel aperture configured to receive the hosel, wherein the hosel comprises a hosel bore;

wherein the hosel connection point is located forward of the vertical midplane;

wherein the putter-type golf club head further comprises a moment of inertia $MOI_{yy}$ between 1000 g·cm$^2$ to 2000 g·cm$^2$; and wherein a ratio $MOI_{yy}/A_{SF}$ of the moment of inertia $MOI_{yy}$ to the strike face surface area $A_{SF}$ is greater than 230 g.

12. The putter-type golf club head of claim 11, wherein the hosel connection point is located at a rearward perpendicular distance $D_{H-R}$ from the rear end, and wherein the rearward perpendicular distance $D_{H-R}$ is between 1.20 inches and 1.30 inches.

13. The putter-type golf club head of claim 11, wherein the hosel connection point is located at a forward perpendicular distance $D_{H-F}$ from the strike face, and wherein the forward perpendicular distance $D_{H-F}$ is between 1.00 inch to 1.15 inches.

14. A putter-type golf club head comprising:

a body comprising:

a volume less than 50 cm$^3$;

a strike face bounded by a strike face perimeter and comprising a geometric center, a loft plane, a strike face surface area $A_{SF}$, a leading edge, a top edge, and an apex located at a center of the top edge;

wherein the strike face further defines a CG projection point where a projection of the center of gravity (CG) is normal to a loft plane onto the strike face;

a heel end, a toe end, a crown, a sole, and a rear end opposite the strike face;

an origin point located at a center of the leading edge;

wherein the strike face comprises a strike face width $W_{SF}$ measured across the strike face in a heel end-toe end direction;

wherein the strike face perimeter comprises a multi-sided shape having a high-heel corner, a low-heel corner, a high-toe corner, and a low-toe corner;

wherein the putter-type golf club head defines an apex angle $\alpha_1$ measured between a first reference line connecting the apex and the low-heel corner and a second reference line connecting the apex and the low-toe corner of the strike face;

wherein the apex angle $\alpha_1$ is between 80 degrees and 90 degrees:

wherein the putter-type golf club head further defines a center of gravity (CG) angle $\alpha_2$ measured between a first reference line connecting the CG projection point and the low-heel corner and a second reference line connecting the CG projection point and the low-toe corner;

wherein the center of gravity (CG) angle $\alpha_2$ is between 115 degrees and 130 degrees;

a first portion and a second portion, wherein the first portion comprises the strike face, and a transition region, and the second portion is positioned rearward from the first portion and comprises a remainder of the body;

wherein the transition region comprises a first transition wall and a second transition wall, and wherein the first and second transition walls extend from the strike face to connect the strike face to the second portion;

wherein the body further comprises a body width $W_B$ less than 2.30 inches, the body width $W_B$ measured between the heel end and the toe end in the heel end-toe end direction;

wherein the body further comprises a body depth $D_B$ less than 2.50 inches, the body depth $D_B$ measured between the strike face and the rear end in a strike face-rear end direction; and wherein a ratio $W_{SF}/W_B$ of the strike face width $W_{SF}$ to the body width $W_B$ is less than 0.75.

15. The putter-type golf club head of claim 14, further comprising a loft angle greater than 5 degrees.

16. The putter-type golf club head of claim 14, wherein the strike face comprises a strike face surface area less than 1.50 $in^2$.

17. The putter-type golf club head of claim 14, wherein the strike face comprises a strike face perimeter less than 5 inches.

18. The putter-type golf club head of claim 14, wherein the strike face further defines a strike face height $H_{SF}$, and wherein a ratio of the strike face height $H_{SF}$ to the strike face width $W_{SF}$ is less than 1.90.

* * * * *